US006412934B1

(12) United States Patent
Moriyama et al.

(10) Patent No.: US 6,412,934 B1
(45) **Date of Patent: *Jul. 2, 2002**

(54) INK JET PRINTING METHOD AND APPARATUS

(75) Inventors: Jiro Moriyama, Kawasaki; Toshiyuki Onishi, Yokohama; Hiroshi Tajika, Yokohama; Toshiharu Inui, Yokohama; Hitoshi Sugimoto, Yokohama; Kiichiro Takahashi, Kawasaki; Masao Kato; Minako Kato, both of Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/511,230

(22) Filed: Aug. 4, 1995

(30) Foreign Application Priority Data

| | | |
|---|---|---|
| Aug. 10, 1994 | (JP) | 6-188198 |
| Sep. 2, 1994 | (JP) | 6-210244 |
| Feb. 13, 1995 | (JP) | 7-023805 |
| Feb. 13, 1995 | (JP) | 7-023807 |
| Feb. 13, 1995 | (JP) | 7-023865 |

(51) Int. Cl.[7] ..... B41J 2/17
(52) U.S. Cl. ..... 347/96
(58) Field of Search ..... 347/43, 21, 16, 347/6, 7, 96, 98, 20, 101

(56) References Cited

U.S. PATENT DOCUMENTS

| | | | | |
|---|---|---|---|---|
| 4,313,124 | A | | 1/1982 | Hara |
| 4,345,262 | A | | 8/1982 | Shirato et al. |
| 4,459,600 | A | | 7/1984 | Sato et al. |
| 4,463,359 | A | | 7/1984 | Ayata et al. |
| 4,538,160 | A | | 8/1985 | Uchiyama |
| 4,558,333 | A | | 12/1985 | Sugitani et al. |
| 4,599,627 | A | | 7/1986 | Vollert |
| 4,608,577 | A | | 8/1986 | Hori |
| 4,686,538 | A | | 8/1987 | Kouzato |
| 4,723,129 | A | | 2/1988 | Endo et al. |
| 4,740,796 | A | | 4/1988 | Endo et al. |
| 5,635,969 | A | * | 6/1997 | Allen ..... 347/96 |

FOREIGN PATENT DOCUMENTS

| | | |
|---|---|---|
| DE | 3543495 | 6/1986 |
| EP | 0 137 313 A1 | 4/1985 |
| EP | 0534634 | 3/1993 |
| EP | 0581135 | 2/1994 |
| EP | 0 657 849 | 6/1995 |
| JP | 51006725 | 1/1976 |
| JP | 53024486 | 3/1978 |
| JP | 54043733 | 4/1979 |
| JP | 54056847 | 5/1979 |
| JP | 55150396 | 11/1980 |
| JP | 56084992 | 7/1981 |
| JP | 58128862 | 8/1983 |
| JP | 59123670 | 7/1984 |
| JP | 59138461 | 8/1984 |
| JP | 60017260 | 4/1985 |
| JP | 61231284 | 10/1986 |
| JP | 61-249755 | 11/1986 |
| JP | 63299971 | 12/1988 |
| JP | 1-44756 | 2/1989 |
| JP | 64063185 | 3/1989 |
| JP | 1-114450 | 5/1989 |
| JP | 1141085 | 6/1989 |

* cited by examiner

*Primary Examiner*—John Barlow
*Assistant Examiner*—An H. Do
(74) *Attorney, Agent, or Firm*—Fitzpatrick, Cella, Harper & Scinto

(57) ABSTRACT

An ink jet printing method uses an ink jet ejecting portion for ejecting ink on a printing material and a print quality improving liquid ejecting portion for ejecting print quality improving liquid on the printing material. The application mode of the print quality improving liquid is different depending on the printing mode in which a printing operation is carried out.

64 Claims, 40 Drawing Sheets

INK JET PRINTING METHOD AND APPARATUS

FIELD OF THE INVENTION AND RELATED ART

The present invention relates to an ink jet printing apparatus which forms letters and pictures by means of ejecting ink droplets onto a print medium.

The present invention also relates to an ink jet printing method. According to this method, dye containing color ink is ejected on the print medium so as to mix or react with colorless or light colored liquid (print quality improver liquid) which contains various compounds capable of rendering the dye in the ink insoluble, thereby producing a highly reliable print with improved water resistance, light resistance, or the like properties, or a high density image of high quality, which suffers little from feathering or color bleeding.

Further, the present invention relates to a color ink jet printing method for printing color images clearly and with high density. More specifically, it relates to a printing method in which a set of color inks, such as yellow (Y), magenta (M) and cyan (C), or green (G), red (R) and blue (B), is used in combination with black (Bk) ink.

The present invention is applicable to all of the apparatuses which use a print medium such as paper, fabric, leather, unwoven fabric, or the like, as well as metals. As for specific examples of such apparatuses, it is possible to list office equipment or industrial production equipment, such as printers, copying machines, or facsimiles.

The printing method based on the ink jet system is widely used in printers, copying machines, facsimiles, and the like since it is advantageous in that the operating noise is low, the running cost is low, its size can be easily reduced, or it can be easily converted to print color images.

However, in order to produce "highly reliable printed products" or "printed images of high quality" using the conventional ink jet printing method, it was necessary to use specific paper suitable for the purpose; in other words, it was necessary to use dedicated paper with an ink absorbing layer. In recent years, a method has been put to practical use, which accomplishes these objectives by means of improving the ink so that the desirable results can be obtained using "plain" paper used in large quantity in the printer or copying machines. However, the level of quality reachable using this method has been unsatisfactory.

As for the method in which the ink is modified to improve the water resistance of the image, a method has been known, in which the water resistance is given to the coloring material contained in the ink. The problem is that the ink used in this method is rendered difficult to re-dissolve in the water once the ink dries; therefore, it is liable to plug the nozzles of the printing head and also makes the performances of the plugged nozzles difficult to restore. Of course, these problems can be prevented, but the prevention requires a complicated structure.

Japanese Laid-Open Patent Application No. 84,992/1981 discloses a method, in which the print medium is coated in advance with a material capable of fixing the dye to the print medium. This method, however, requires the use of a specific print medium, and also, cannot prevent increases in the size and cost of the apparatus, since the material for fixing the dye has to be coated. Further, it is rather difficult to reliably coat the dye fixing material to a predetermined thickness.

Also, Japanese Laid-Open Patent Application No. 63,185/1989 discloses a technology for adhering to the print medium a type of colorless ink capable of rendering the dye insoluble, using an ink jet printing head. In this method, the dot diameter of the colorless ink is rendered larger than that of the dot diameter of the printing ink; therefore, even when the landing points of the printing inks and colorless ink are displaced from each other, a satisfactory print or image quality can be obtained.

However, this method also suffers from several shortcomings. This method ejects the colorless ink across the entire surface where the images are to be formed; therefore, a large amount of the colorless ink is consumed, and as a result, the running cost increases. Also, since more than the usual amount of ink is ejected onto the print medium, it takes a longer time to dry the ink, and also, the landing points of the inks are displaced from each other because of the cockling of the print medium, which occurs as the ink adhered to the print medium dries. In particular, when a color image is formed, the cockling, which leads to the misalignment of the landing points, greatly deteriorates the image quality. The patent application being discussed here does not disclose any method for optimizing the amount of the colorless ink to be adhered to the print medium, according to the type of the print medium. Further, the colorless ink is ejected even when the high quality is not required, for example, even when the recording is made in a draft mode; therefore, the colorless ink is wastefully consumed. Further, the liquid permeation into the print medium varies depending on environmental factors such as the ambient temperature or humidity; therefore, there are times when the dye insolubilizing colorless ink fails to mix or react ideally with the image producing ink, and as a result, the dye is not made insoluble.

Also, the liquid differently permeates the print medium, depending on the type of the print medium; therefore, there are times when the dye insolubilizing colorless ink fails to mix or react ideally with the image producing ink, and as a result, the dye is not made insoluble.

Therefore, this method suffers from another shortcoming. Namely, when the dye is not made insoluble, the feathering or bleeding occurs and degrades the print image. Here, "feathering" represents a phenomenon where the bleeding ink leaves on the print medium, a pattern of trails that looks like a feather, and "bleeding" is a phenomenon where the color inks mix with each other on the print medium after they are deposited thereon.

There have been disclosed a large number of conventional technologies which are intended to improve the fastness of the print. Japanese Laid Open Patent Application No. 24,486/1978 discloses a technology which improves the resistance of the dyed product against humidity. According to this technology, the dyed product is put through a process in which the dye in the dyed product is turned into lake so that it is firmly fixed.

Japanese Laid-Open Patent Application No. 43,733/1979 discloses a printing method, in which an ink jet printing system is used in conjunction with two or more ink components, which increase their film forming capacities as they make contact with each other under normal or heated condition; wherein those components are allowed to make contact with each other on the print medium so that a film capable of adhering firmly to the print medium is formed.

Japanese Laid-Open Patent Application No. 150,396/1980 also discloses a method in which an agent capable of forming the lake with the water soluble dye in a water based ink is applied after the ink jet printing.

In Japanese Laid-Open Patent Application No. 128,862/1983, an ink jet printing method is disclosed, in which it is anticipated where the image producing ink is deposited, and the image producing ink and the processing ink are deposited thereon in an overlapping manner. According to this method, the processing ink may be deposited before the image producing ink, or may be overlaid on the image producing ink deposited before the processing ink; or the image producing ink may be overlaid on the processing ink deposited before the image producing ink, and thus deposited image producing ink may be covered with the processing ink.

However, the problems that might have occurred through practical applications of these printing methods have not been disclosed in these journals which present these prior technologies.

Further, no method has been disclosed in these patent applications, in which when two or more inks of different color are used, the processing liquid (print quality improver liquid) is made to react with only the ink of a specific color, nor has there been disclosed a method in which a recording mode suitable for a specific purpose can be selected from among a number of available recording modes.

Also, no method has been disclosed, which can minimize the amount of the processing liquid to be applied to the area which basically has no bearing on the printing results.

SUMMARY OF THE INVENTION

The present invention was made in consideration of the aforementioned problems, and its object is to obtain a "reliable print," which displays better water resistance and light resistance, and faster fixation than those of the conventional print, even when plain paper is used as the print medium.

Another object of the present invention is to provide an ink jet printing method and a printing apparatus, which are capable of producing a "high quality printed image" which has high density and highly developed colors, and does not suffer from feathering or color bleeding.

Another object of the present invention is to provide an ink jet printing method and a printing method, which are capable of depositing efficiently the print quality improver liquid on the print medium, without wastefully consuming the print quality improver liquid.

Another object of the present invention is to provide a printing method in which an optimal process is carried out depending on the print medium type, for example, whether the print medium is the OHP transparency or something else, so that a high quality image with the highest water resistance can be obtained.

A further object of the present invention is to provide a printing method in which the amount of the processing liquid to be ejected is minimized to reduce the running cost X, while producing a high quality image having a minimum amount of cockling.

Another object of the present invention is to improve the fastness of the ink fixation to the print medium, the water resistance of the produced image, and the color development of the produced image, and to minimize the color bleeding among two or more color inks, by means of causing the print quality improver liquid to mix or react with the ink, on the print medium.

In other words, the ink jet printing method in accordance with the present invention is such an ink printing method that coloring material containing color ink and colorless or lightly colored liquid (hereinafter, print quality improver liquid, or P liquid) containing components capable of rendering the ink components insoluble or aggregating them are ejected onto the print medium, where the ink mixes and/or reacts with the P liquid to produce a highly reliable image of high quality.

The data to be used for ejecting the P liquid are derived from the data to be used for ejecting the color inks: yellow (Y), magenta (M), cyan (C) and black (Bk) inks.

Further, this printing method provides two or more printing modes, and the amount, type, or the like of the P liquid to be ejected is determined according to the selected mode. In this case, the data for ejecting the P liquid may be differently composed depending on whether the Bk ink or the Y, M and C inks are ejected, and also, the printing timing may set up so as to provide a lag between the P liquid and the Bk, Y, M and C inks.

In the present invention, the terminology, "print quality improvement," includes: the improvement in image properties such as the density, saturation, sharpness of edge, dot diameter, or the like; the improvement in the fixability of the ink; the improvement in the durability related properties of the image, such as the weather resistance, water resistance, light resistance, or the like; and the suppression of bleeding, feathering, and the like. The print quality improver liquid is liquid contributing to the improvement of the print properties, and includes liquid capable of insolubilizing the dye contained in the ink, liquid capable of disturbing the state of pigment dispersion in ink, as well as the like liquids. Here, the terminology, "insolubilize" refers to a phenomenon that anionic radicals in the ink dye and cationic radicals in the cationic substance contained in the print quality improver liquid ionically react with each other, being thereby ionically bonded, and as a result, the dye in the state of being uniformly dissolved in the ink separates from the ink solution. It should be noted here that even when the dye in the ink is not entirely rendered insoluble, the present invention can effectively suppress the bleeding and can improve the color development, the letter quality, the fixability of the ink, and the like. Further, when the coloring material used in the ink is the water soluble dye containing anionic radicals, the terminology, "aggregate," has the same meaning as "insolubilize," but when the coloring material in the ink is pigment, it also means that the pigment dispersant or the pigment surface tonically interacts with the cationic radicals of the cationic substance contained in the print quality improver liquid, and as a result, the state of the pigment dispersion is disturbed, which results in the increase in the pigment diameter. Normally, as the aggregation progresses, ink viscosity increases. It should also be noted that even when the pigment or pigment dispersant in the ink is not entirely aggregated, the present invention can effectively suppress bleeding and improve the color development, the letter quality, the fixability of the ink, and the like.

In the present invention, the P liquid can be optimally used according to the selected printing mode; therefore, the power source capacity of the printing apparatus can be reduced, which makes it possible to reduce the apparatus size as well as its cost.

The present invention relates to an ink jet printing method, which, in order to accomplish the aforementioned objectives, uses the print quality improver liquid, which is mixed or caused to react with the colored inks (Y, M, C and Bk inks) on the print medium, in response to the imaging data. The type and amount of the print quality improver liquid are optimally selected depending on environmental factors such as the ambient temperature and humidity, and/or the type of the print medium; therefore, it is possible to always obtain a "highly reliable" image with "high quality" regardless of the environment and/or the type of the print medium.

In the present invention, the "adjustment" of the amount of the print quality improver liquid includes selecting "non-ejection" of the print quality improver liquid, as well as determining the amount of the P liquid to be ejected Per unit area of the print medium.

According to the present invention, when the print quality improver liquid and the inks are mixed on the print medium, the higher the ambient temperature is, and the lower the humidity is, the less the print quality improver liquid is used.

The reasons why such a control that uses a smaller amount of the print quality improver liquid as the ambient temperature becomes higher, and the humidity becomes lower is effective are as follows:

(1) The higher the temperature, the shorter the time it takes for the print quality improver liquid and the color inks to mix or react with each other, and the more efficiently they do so, while they permeate from the surface of the print medium thereinto; therefore, the necessary amount of the print quality improver liquid to be mixed or caused to react with the inks may be less. (2) The lower the humidity, the more difficult it is for the ink to permeate into the print medium. Therefore, the time necessary for these liquids to permeate into the print medium from the surface thereof becomes longer, affording thereby enough time for the print quality improver liquid to mix or react satisfactorily with the colored inks.

An excessive amount of the print quality improver liquid produces contrary results; it induces feathering of the colored inks. Further, the print quality improver liquid is replenished from the container as it is consumed. Therefore, minimizing the print quality improver liquid usage can also reduce the running cost.

The temperature based control of the Tw of the print quality improver liquid and the humidity based control of the Tw of the print quality improver liquid may be independently executed. Though detection of the humidity alone may be effective in some degree, the best results can be obtained when the control is executed on the basis of both the temperature and humidity.

In the following embodiments of the present invention, a case in which the Tw is controlled in order to control the amount of the print quality improver liquid to be ejected is described, but the present invention is not limited by this case. For example, when the amount of the print quality improver liquid is increased by means of controlling the temperature of the print quality improver liquid head unit, the temperature may be increased in order to increase the amount of the print quality improver liquid. Other means may be employed.

Further, when the print quality improver liquid is selectively used on the basis of the user's objective, and/or the characteristic of the printing ink to be used, it is possible to produce a "highly reliable" printed product with improved water resistance and light resistance, and the like, and a printed image of "high quality" which displays preferable color development and high density while suffering little from feathering and color bleeding.

According to an aspect of the present invention, the print quality improver liquid and inks are caused to mix or react with each other on the print medium, so that the water resistance and color development of the printed image are improved; color bleeding among two or more color inks is minimized; and the fixability of the ink to the print medium is improved.

According to another aspect of the present invention, three modes are available, which are manually or automatically switchable, page-by-page, and/or in the middle of each page. In other words, the printing mode is discriminated with reference to the printing area so that the print quality improver liquid can be properly applied. Therefore, it is possible to minimize the amount of the print quality improver liquid consumed during the printing, without losing the effectiveness of the liquid.

According to another aspect of the present invention, the liquids (including the inks) are ejected in the following order: non-black ink, print quality improver liquid, black ink. Using this order can assure the effects of the print quality improver liquid. This is because of the following reason: when the liquids are ejected in a different order, for example, non-black ink, black ink, print quality improver liquid, the print quality improver liquid is going to be ejected after bleeding occurs between the non-black ink and black ink.

According to another aspect of the present invention, the amount of the image producing ink to be ejected onto the area where it is overlaid on the print quality improver liquid is increased relative to where it is not overlaid. This is because the reaction between the print quality improver liquid and ink stops the permeation of the ink at the location of the reaction, resulting thereby in a smaller dot diameter.

These and other objects, features and advantages of the present invention will become more apparent upon a consideration of the following description of the preferred embodiments of the present invention, taken in conjunction with the accompanying drawings.

BRIEF DESCRIPTION OF THE DRAWINGS

FIG. 15 is a block diagram illustrating the general structure which will be employed when the printing apparatus in accordance with the present invention is applied to an information processing apparatus capable of functioning as a word processor, a personal computer, a facsimile, copying machine, or the like.

FIG. 32(*b*) is a front view, as seen from the direction of the print medium, depicting the arrangement of the ejection outlets in the liquid ejecting portion; and FIG. 32(*c*) is an enlarged sectional view depicting the internal structure of one of the ejection outlets illustrated in FIG. 32(*b*).

DESCRIPTION OF THE PREFERRED EMBODIMENTS

Hereinafter, the embodiments of the present invention will be described with reference to the drawings. First, referring to FIGS. 1–17, the embodiments 1–5, which represent the first form of the present invention, will be described Embodiment 1

Figure 1:
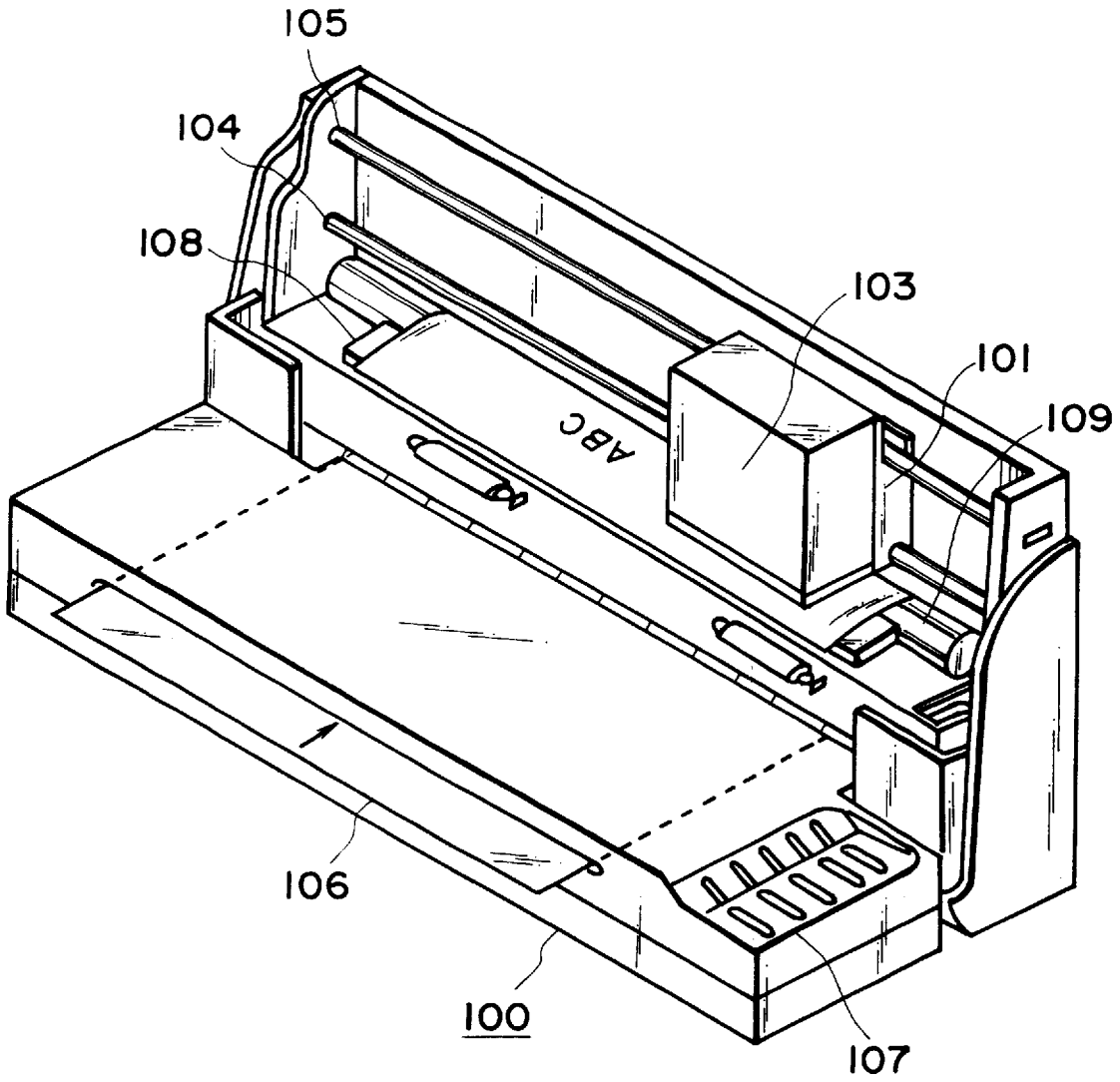
FIG. 1 is a perspective view of an embodiment of the ink jet printing apparatus in accordance with the present invention.

FIG. 1 is a perspective view of an ink jet printing apparatus, to which the present invention is applicable. After being inserted into the feeding point of a printing apparatus 100, a print medium 106 is conveyed by a feeder roller 109 to an area in which a printing head-unit 103 can print images on the print medium 106. The printing head unit 103 is constituted of a Bk ink liquid ejecting portion, a Y ink liquid ejecting portion, an M ink liquid ejecting portion, a C ink liquid ejecting portion, and a P liquid ejecting portion. The liquid ejecting portion in this embodiment may be a part of the printing head unit or may constitute an independent printing head.

There is a metallic platen 108 below the print medium having been conveyed to be disposed within the printing area. A carriage 101 is reciprocally movable in the direction defined by two guide shafts 105 and 106, and as it is moved, it scans the printing area. On the carriage 101, the printing head unit 10 is mounted, which comprises four ink containers for supplying four color inks and four printing heads for ejecting the inks. The four color inks supplied to the ink jet printing apparatus in this embodiment are black (Bk), cyan (C), Magenta (M) and Yellow (Y) inks. A reference numeral 107 designates a panel comprising a group of switches and a group of displays. The panel 107 is used to set various printing modes or display the status of the printing apparatus.

Figure 2:
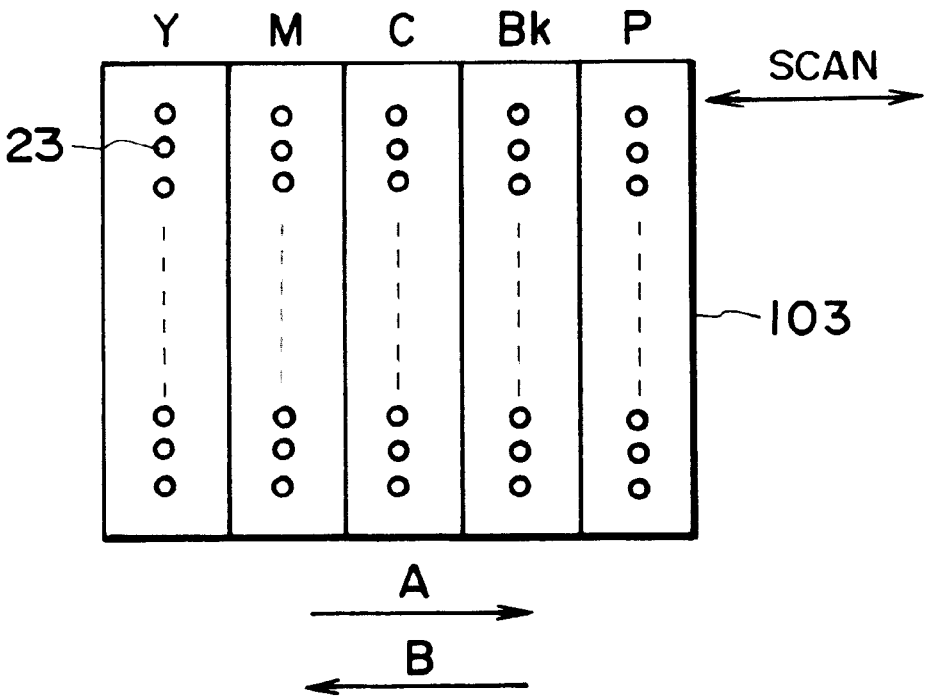
FIG. 2 is a front view of a printing head unit of the printing apparatus illustrated in FIG. 1, wherein the unit comprises a plurality of subunits.

FIG. 2 is a front view of the printing head subunits of the printing head unit 103. There are ejection outlets on the ejection outlet surface of the printing head. The number of the ejection outlets corresponds to the number of liquids: P, Bk, C, M and Y. The number of the ejection outlets assigned to each liquid is 64. The 64 ejection outlets assigned to each liquid are linearly aligned with the intervals of approximately 70 $\mu$m, that is, with a density of 360 dpi. Further, the ejection outlets are arranged in such a manner that an image is printed in the color order of the P, Bk, C, M and Y.

The ink jet printing apparatus of this embodiment employs a printing system, in which an electrothermal transducer is disposed in correspondence with the ejection outlet, wherein a driving signal reflecting printing data is applied to the electrothermal transducer to eject the ink from a nozzle.

Figure 3:
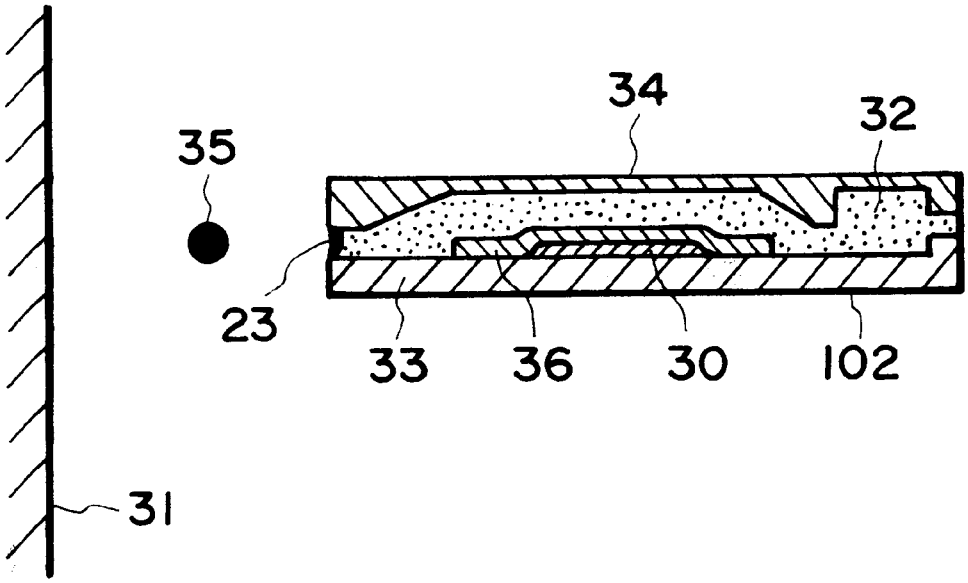
FIG. 3 is an enlarged sectional view of the print head illustrated in FIG. 2.

FIG. 3 is an enlarged sectional view of a printing head, to which the present invention is applicable. A heat generating member 30, which is the electrothermal transducer of the printing head 102, is disposed in correspondence with the ejection outlet 23, one for one, and each of the heat generating members 30 is allowed to generate heat independently. As the heating member 30 generates the heat, the ink adjacent to the heat generating member 30 is suddenly heated, being brought into the state of the film boiling, thereby generating bubbles. The pressure from the development and growth of the bubbles forces an ink droplet 35 to be ejected toward a print medium 31, effecting thereby the printing of a letter or a picture image on the print medium. The volume of the color ink droplet ejected at this time falls within a range of 15–80 ng: for example, approximately 40 ng.

Each of the ejection outlets 23 is connected to an ink liquid passage, and behind the area in which the ink liquid passages are placed, a common liquid chamber 32 is provided, from which the ink is supplied to these ink liquid passages. In each ink liquid passage, which corresponds to one of the ejection outlets, the heat generating member 30, that is, the electrothermal transducer, and electrode wiring for supplying the electric power to the heat generating member 30, are disposed, wherein the former generates the energy to be used for ejecting the ink droplet from the ejection outlet. The heat generating member 30 and electrode wiring are formed on a substrate 33 composed of silicon or the like, using one of the film deposition technologies. On the heat generating member 30, a protective film 36 is formed so as to prevent direct contact between the ink and heat generating member 30. Further, a partitioning wall 34 composed of resin or glass is accumulated on the substrate 33 to form the aforementioned ejection outlets, ink liquid passages, common liquid chamber, and the like.

In the case of the printing method such as the one described above, in which the electrothermal transducer is employed, the bubble formed through the application of thermal energy is used to eject the ink droplet; therefore, it is commonly called "bubble jet printing system."

Figure 4:
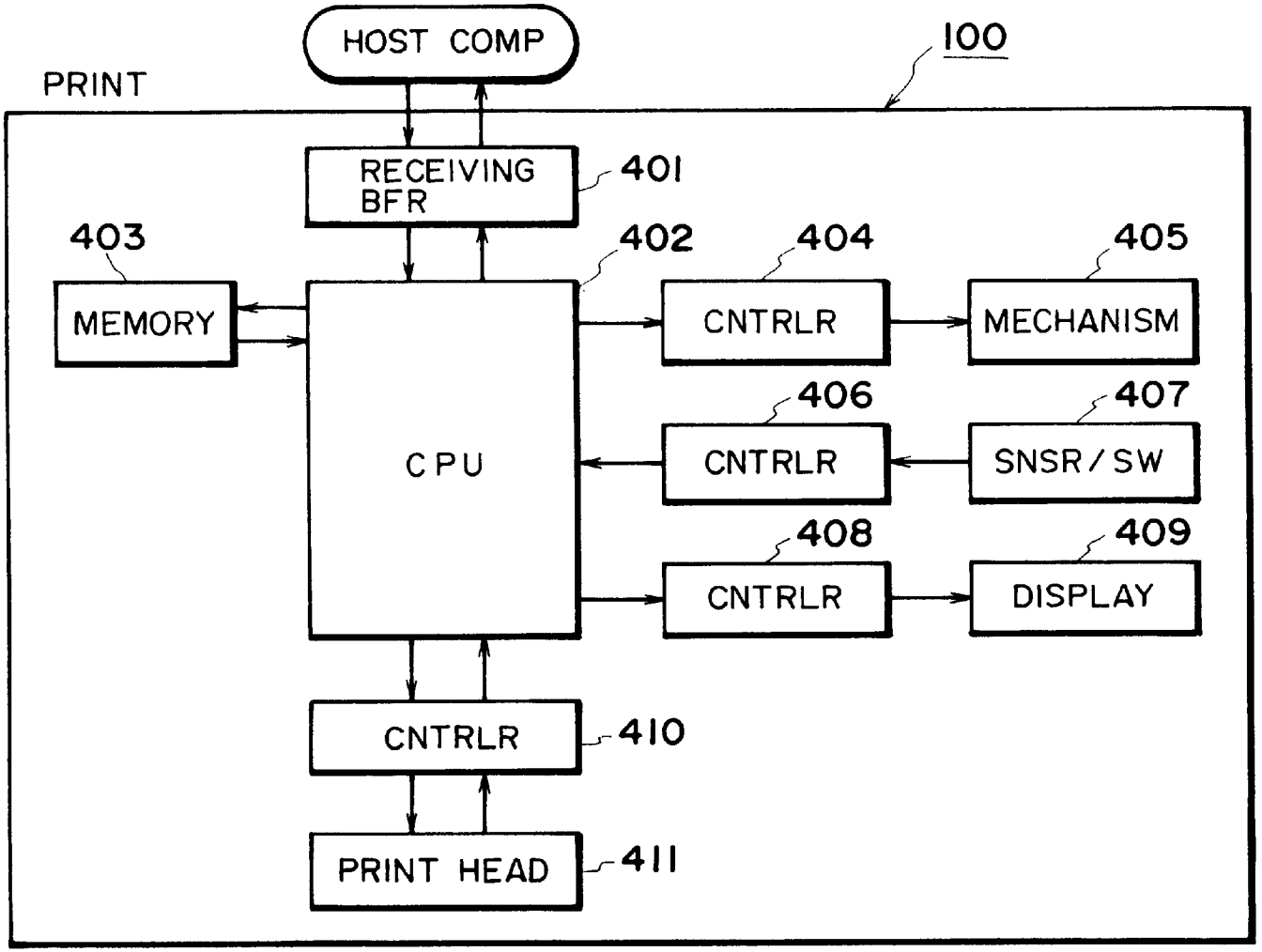
FIG. 4 is a block diagram of the structure of the embodiment of the ink jet printing apparatus in accordance with the present invention.

FIG. 4 is a block diagram of the ink jet printing apparatus to which the present invention is applicable. The data (hereinafter, image data) for the letter and/or image to be printed are inputted from a host computer to the receiving buffer 401 of the printing apparatus. The data for confirming whether or not the image data are correctly transferred and the data for displaying the operational condition of the printing apparatus are returned from the printing apparatus to the host computer. The data from the receiving buffer 401 are transferred, under the control from a CPU 402, to a memory section 403, where it is temporarily stored in a RAM (random access memory). A mechanism controlling section 404 drives a mechanical section 405 comprising a carriage motor, a line feeder motor, or the like, in response to the commands from the CPU 403. A sensor/SW controlling section 406 sends the signal from the sensor/SW section 407 comprising various sensors and SWs (switches) to the CPU 402. A display element controlling section 408 controls a display element section comprising display elements such as an LED or the like in the group of display panels, in response to the command from the CPU. A printing head controlling section 410 controls a printing head 411 also in response to the command from the CPU, and also, it senses the temperature and the like, which indicates the condition of the print head 411, and sends them to the CPU.

Figure 5:
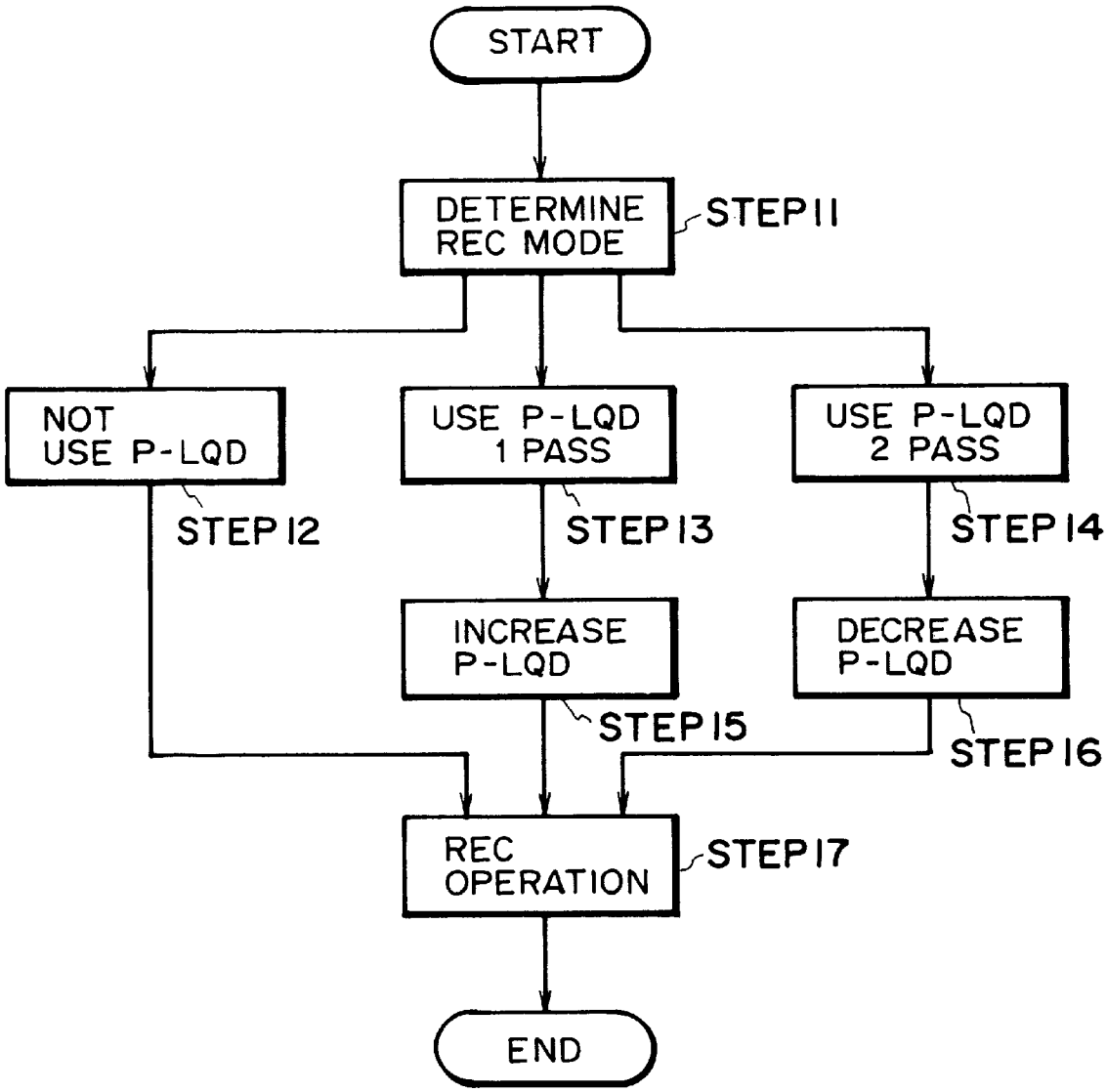
FIG. 5 is a flow chart of the printing operation of the first embodiment of the ink jet printing method in accordance with the present invention.

FIG. 5 is a flow chart of the printing operation in Embodiment 1.

In Step 11, a,printing mode is determined. This determination is dependent on the data from the host computer connected to the printing apparatus or the selection made using a switch or switches among the group of switches. Upon the determination of the printing mode, one of Steps 11, 12 and 13 is performed.

Step 12 initiates a printing mode, in which the P liquid is not used. Even though the use of the P liquid makes up the gist of the present invention, the mode that does not involve the P liquid is provided as one of the printing modes. For example, this mode is used as a mode for trial printing; the P liquid is not used in trial printing so that the running cost is reduced.

Figure 6:
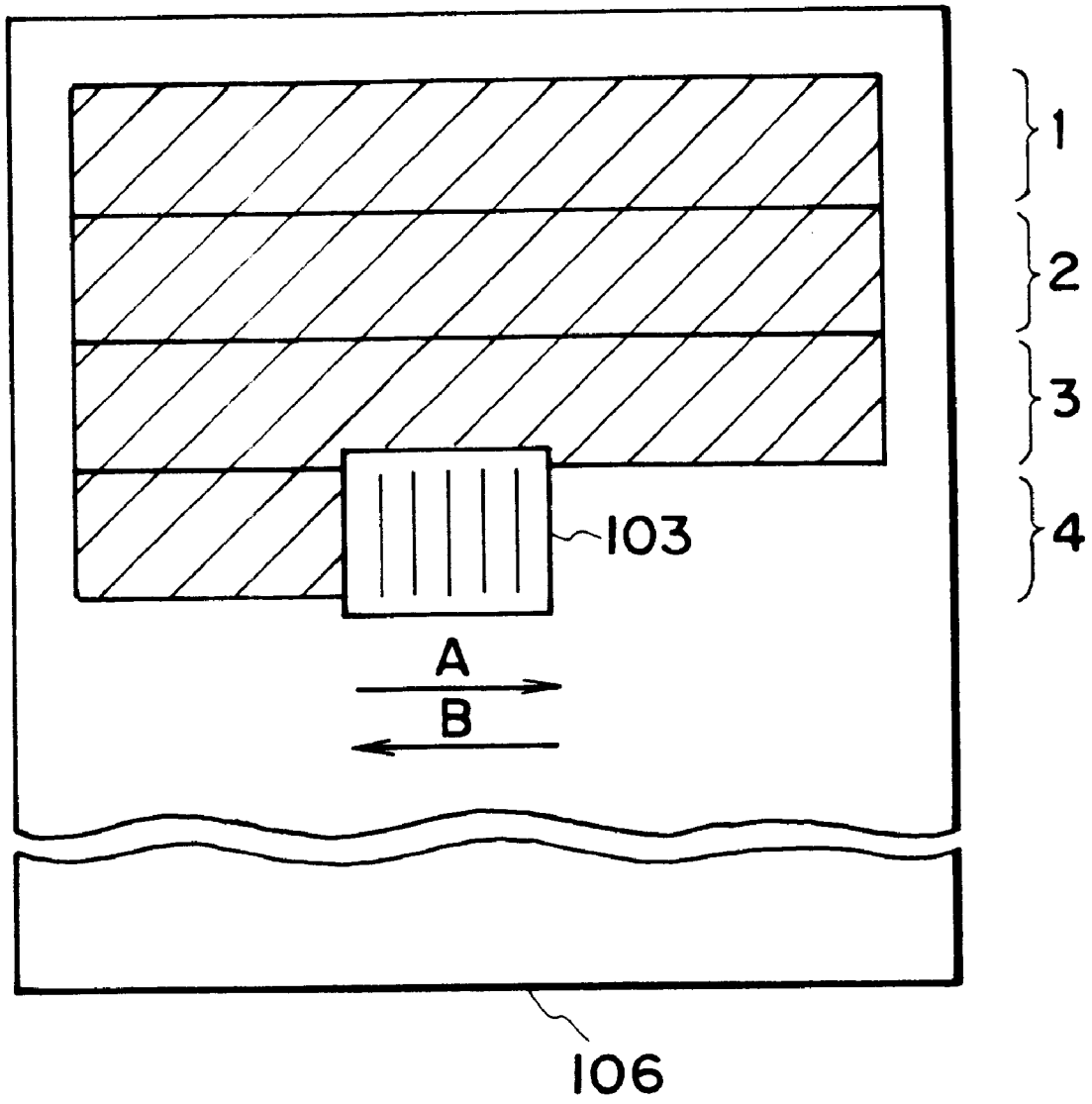
FIG. 6 is a planar drawing illustrating how the printing head unit moves when the single pass printing method is employed while the ink jet printing method in accordance with the present invention is practiced.

Step 13 initiates a printing mode, in which the P liquid operation is used while a monodirectional single pass printing is carried out. FIG. 6 is a drawing for describing the specific movement of the printing head unit during this monodirectional single pass printing operation; it illustrates how the printing head unit 103 moves over the print medium 106, which is an A4 size plain paper. The liquid on the far right side in the printing head unit is the P liquid. Printing is carried out in the direction of an arrow mark A, and the printing head unit 103 is simply returned in the direction of an arrow mark B. The number on the right-hand side of the drawing indicate the number of the scanning passes that the printing head unit 103 has made during the current printing operation. The drawing shows the printing head unit 103 during its fourth scanning pass.

Figure 7:
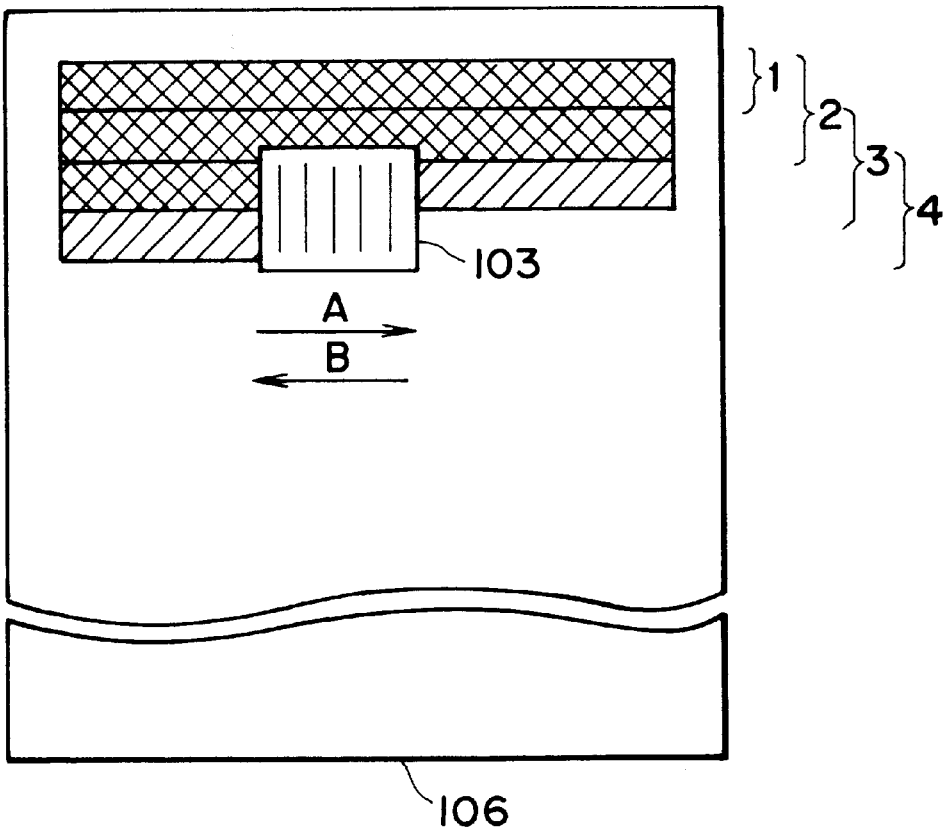
FIG. 7 is a planar drawing illustrating how the printing head moves when the double pass printing method is employed while the ink jet printing method in accordance with the present invention is practiced.

Step 14 initiates a printing mode, in which an image is effected through a monodirectional double pass printing method while using the P liquid. FIG. 7 illustrates the specific movement of the printing head unit 103 during this monodirectional double pass printing operation; it illustrates how the printing head unit 103 moves over the print medium 106, which is an A4 size plain paper. The liquid on the far right side in the printing head unit is the P liquid. Printing is carried out in the direction of an arrow mark A, and the printing head unit 103 is simply returned in the direction of an arrow mark B. The numbers on the right-hand side of the drawing indicate the number of the scanning passes the printing head unit 103 has made during the current printing operation. The drawing shows the printing head unit 103 during its fourth scanning pass.

In Step 15, the P liquid amount suitable for the single pass printing mode initiated in Step 13 is established. In the single pass printing mode, all the colors are printed during a single scanning pass. In this mode, a relatively large amount is set for the P liquid. This is because in the case of the single pass printing operation, a relatively large amount of color inks is ejected per unit time and unit area of the print medium, and therefore, the amount of the P liquid also has to be increased to enhance the reaction between the color inks and P liquid. The printing (ejection) data for the P liquid are derived from the printing data for the Y, M, C and Bk inks. More specifically, the data for the P liquid are the logical sums of the printing data for the Y, M, C and Bk inks. In this embodiment, the amount of the P liquid to be ejected is established to be 30 ng.

In Step 16, the amount suitable for the double pass printing mode initiated in Step 14 is established for the P liquid. In the double pass printing mode, two scanning passes are used to print all the color, and a relatively small amount is set for the P liquid. This is because in the case of the double pass printing operation, a relatively small amount of the color inks is ejected per unit time and unit area of the print medium, and therefore, the color inks react sufficiently with the P liquid even if the amount of the P liquid is reduced. In this embodiment, the amount of the P liquid is set at 20 ng.

It is one of the roles of the printing head controlling section 410 to control the amount of the ink ejected from the same printing head. For example, it controls the energy to be given for ejecting a single ink droplet, which is accomplished by controlling the value of the voltage to be applied or the duration of the voltage application. The more the given energy, the more the liquid is ejected. It is also acceptable to control the temperature of the printing head that ejects the P liquid. In this case, the higher the temperature, the more liquid is ejected. In this embodiment, the latter means was employed, wherein the temperature was approximately 40° C. in Step 15, and approximately 32° C in Step 16. The means for controlling the amount of the ink to be ejected may be different from those described above.

Step 17 is a step in which an image is actually printed; the printing head unit 103 prints letters and images on the print medium while moving as illustrated in FIGS. 6 and 7.

In the case of the four pass printing, the amount of the P liquid to be ejected can be further reduced. In other words, a point of the present invention is that the greater the number of the passes, the further the amount of the P liquid to be ejected can be reduced. Generally speaking, the number of passes is increased when it is necessary to improve print quality even if printing time has to be sacrificed. It should be noted here that reducing the amount of the P liquid to be ejected is also effective for reducing the number of incidents of cockling which occurs on the print medium during printing; therefore, it is possible to produce a print of higher quality. Further, reducing the amount of the P liquid to be ejected means reducing the overall consumption of the P liquid; therefore, it is effective to reduce the running cost.

In this embodiment, an example, in which the greater the number of the passes, the further the amount of the P liquid to be ejected can be reduced, was described. This means in more general terms that the greater the number of the passes, the smaller the amount of the P liquid to be ejected per unit area can be. This may be accomplished by controlling the ejection data for the P liquid without changing the total amount of the P liquid to be ejected. More specifically, the P liquid printing data for the single pass printing operation are the logical sum of the data for the Y, M, C and Bk colors, but in the case of double pass printing, the logical sum of the Y, M, C and Bk data is masked, being reduced to 66% thereof on average. It is also acceptable to control both the amount to be ejected and the ejection data. In either case, the obtainable results are the same.

Figure 14:
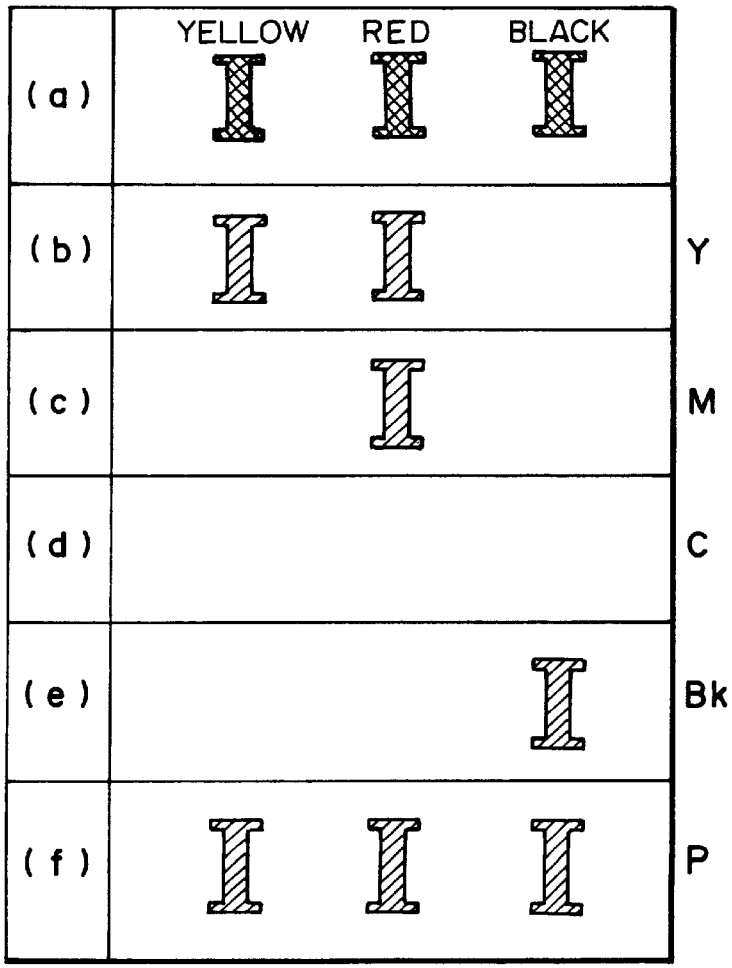
FIG. 14 is a chart presenting the printing data to be used for ejecting the Y, M, C and Bk inks, and the P liquid, in the first embodiment of the ink jet printing method in accordance with the present invention.

FIG. 14 presents the data to be used for ejecting the Y, M, C and Bk inks and the P liquid from the print head unit, wherein (a) designates the input data for printing; (b), the data for the Y ink; (c), the data for the M ink; (d), the data for the C ink; (e), the data for the Bk ink; and (f) designates the data for the P liquid. The print duty for the P liquid is changed in response to the selected printing mode; the greater the number of the passes, the smaller the print duty.

The Y, M, C and Bk inks used in this embodiment had the following composition, wherein the dyes correspond to the Y, M, C and Bk colors:

| | |
|---|---|
| Glycerine | 5.0 wt.% |
| Thioglycol | 5.0 wt.% |
| Urea | 5.0 wt.% |
| Isopropyl alcohol | 4.0 wt % |
| Dye | 3.0 wt. % |
| Water | 78.0 wt. % |

The P liquid had the following composition:

| | |
|---|---|
| Polyallylamine hydrochloride | 1.0 wt. % |
| Benzalkonium chloride | 1.0 wt. % |
| Thioglycol | 10.0 wt. % |
| Acetylenol EH | 0.5 wt. % |
| Water | 87.5 wt. % |

Before or after the Y, M, C and Bk inks were deposited on plain paper, the P liquid having the above composition was deposited thereon, yielding a water resistant print with preferable color development.

Embodiment 2

In the first embodiment, the amount of the P liquid to be used was changed in response to the printing mode, but the control is not limited to those described in the first embodiment. For example, the type of the P liquid may be changed in response to the printing mode; the greater the number of the passes, the smaller the surface tension of the P liquid to be used.

Figure 8:
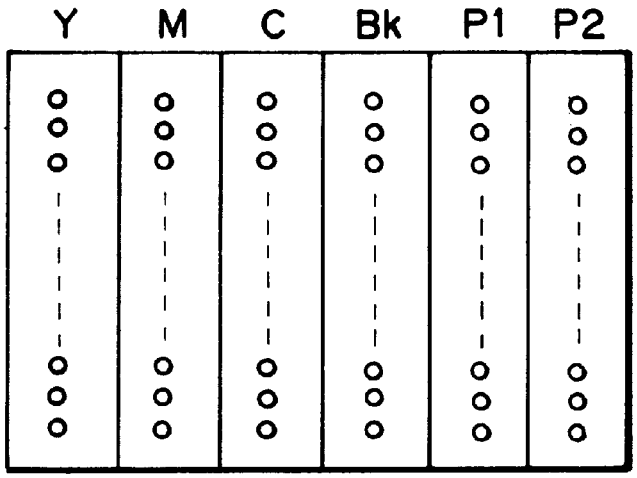
FIG. 8 is an enlarged sectional view of the printing head used in the second embodiment of the ink jet printing method in accordance with the present invention.

FIG. 8 is a front view of the printing head comprising a head unit for ejecting a P1 liquid, and a head unit for ejecting P2 liquid, wherein the P1 and P2 liquids are different in the surface tension, which is accomplished by means of varying the surfactant contents between the P1 and P2 liquids.

The specific compositions for the P1 and P2 liquids are as follows, wherein the compositions of the Y, M, C and Bk inks are the same as the first embodiment:

| | P1 liquid | P2 liquid |
|---|---|---|
| Polyallylamine hydrochloride | 1.0 wt. % | 1.0 wt. % |
| Benzalkonium chloride | 1.0 wt. % | 1.0 wt. % |
| Thioglycol | 10.0 wt. % | 10.0 wt. % |
| Acetylenol EH | 0.5 wt. % | 0.2 wt. % |
| Water | 87.5 wt. % | 87.8 wt. % |

Figure 9:
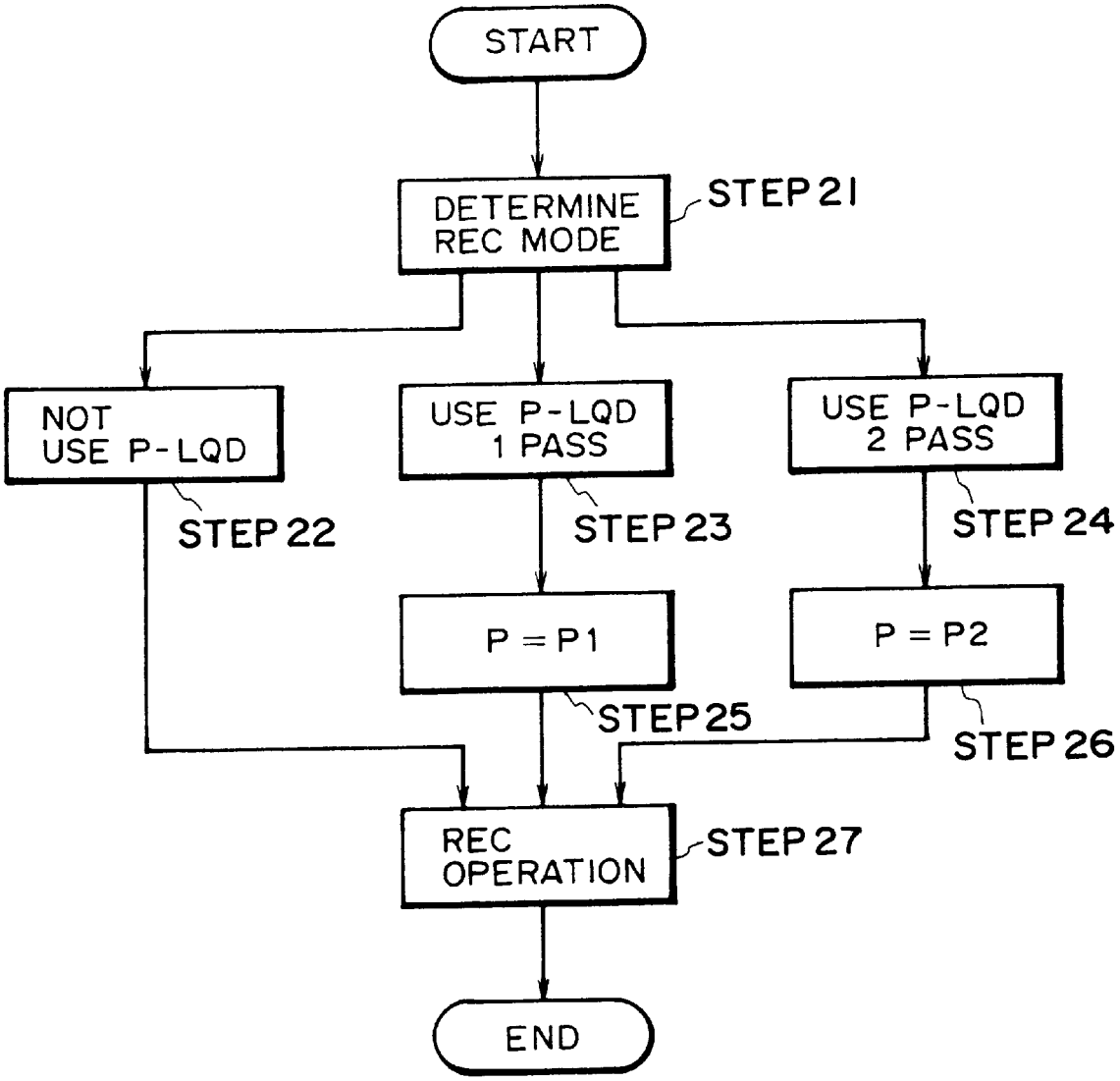
FIG. 9 is a flow chart of the printing operation in the second embodiment of the ink jet printing method in accordance with the present invention.

FIG. 9 is a flow chart for the printing operation in this second embodiment. Steps 21–24 are the same as Steps 11–14 of the preceding Embodiment 1.

In Step 25, which is a part of the single pass printing operation, the P1 liquid, having a relatively large surface tension, is selected as the P liquid.

In Step 26, which is a part of the double pass printing operation, the P2 liquid, having a relatively small surface tension, is selected as the P liquid.

It is because of the following reason why the greater the number of the passes, the smaller the surface tension of the P liquid to be used. When printing, in particular, on plain paper, quick drying properties are desired; therefore, it is desirable for the ink to have a larger surface tension, which gives the ink the properties to quickly permeate the paper. This is also true with the P liquid. Such properties are certainly appreciated in the case of the single pass printing suitable for high speed printing. However, since ink with a larger surface tension quickly permeates the paper, a relatively small amount of the coloring component remains on the surface of the paper, and also, the amount of feathering increases, which is disadvantageous in terms of the print quality. On the other hand, in the case of double pass printing suitable for producing a high quality print, the amount of color inks and P liquid, which are ejected per unit time and per unit area of the paper (print medium), are relatively small; accordingly, the need for the quick drying properties is lessened, allowing subsequently the surface tension to be reduced. As a result, more coloring components remains on the paper surface, and also, feathering can be reduced. Embodiment 3 When a monochromatic (B/W) mode is available among the printing modes, the amount of the P liquid to be ejected per unit area of the print medium was varied between the monochromatic and color modes, which gave preferable results.

In the case of the printing operation of this embodiment, the Bk ink was ejected at 80 pl per picture element, and the Y, M and C inks were ejected at 40 pl per picture element. The reason why more Bk ink was ejected is that in the case of the Bk ink, importance was placed on print density, and therefore, the density had to be increased.

Figure 10:
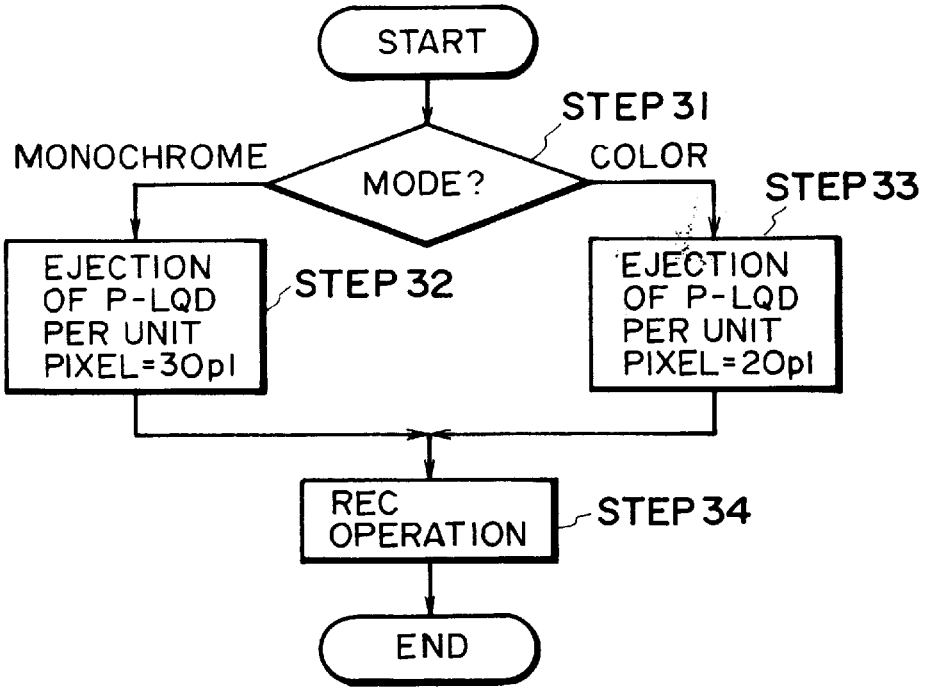
FIG. 10 is a flow chart of the printing operation for the third embodiment of the ink jet printing method in accordance with the present invention.

FIG. 10 is a flow chart for setting the amount of the P liquid when both the monochromatic and color mode are available.

In Step 31, it is determined whether the printing mode is the monochromatic or color mode. This determination is dependent on the data from the host computer connected to the printing apparatus, or the selection made through a group of switches. Then, either Step 32 or 33 is performed in response to the result of the printing mode determination.

Step 31 is the step to be followed when the monochrome mode is selected, and the amount of the P liquid to be ejected per unit area of the print medium is set to be relative larger. As for the means therefor, the amount of the P liquid to be ejected is set at 30 pl per picture element with a resolution of 360 dpi.

Step 32 is the step to be followed when the color mode is selected, and the amount of the P liquid to be ejected per unit area of the print medium is set to be relatively small. As for the means therefor, the amount of the P liquid to be ejected is set at 20 pl per picture element, with the resolution being 360 dpi.

In Step 34, the normal printing operation is carried out in response to the setting selected as described above. More specifically, in the monochrome mode, the P liquid is ejected onto proper points on the basis of the P liquid deposition data derived from the data for the Bk ink to be ejected, and then, the Bk ink is ejected thereon. In the color mode, the P liquid is deposited on proper points on the basis of the P liquid deposition data derived from the data for the Bk, C, M or Y ink to be ejected, and then, the Bk, C, M or Y ink is ejected thereon.

In principle, it is preferable to reduce the P liquid usage as much as possible. The optimum amount of the P liquid to be ejected varies depending on the compositions of the ink and P liquid, but as long as the high reliability and high image quality can be maintained, it is desirable to deposit the minimum amount of the P liquid so that the running cost can be reduced.

In the monochrome mode, the ink to be deposited is always Bk ink, which is ejected in a relatively larger amount, and the emphasis is on printing letters. When printing letters, importance is placed on water resistance, more often than not, which is different when printing picture images, and therefore, it is necessary to increase the amount of the P liquid to be ejected per unit area. On the other hand, in the case of the color mode, which involves the Y, M and C inks, the inks are deposited by a relatively small amount in comparison with the case of the monochrome mode, and also, more often than not, picture images are printed; therefore, it is possible to reduce the amount of the P liquid to be ejected per unit area of the print medium, in comparison with the monochrome mode.

As for the specific means for reducing the amount of the P liquid to be deposited per unit area of the print medium, there are three means: the first one is to reduce the volume of each liquid droplet; the second one is to lower the print duty; and the third one is the combination of the preceding two. This embodiment was described with reference to the method for reducing the volume of each liquid droplet, but the present invention is not limited by this embodiment, and other means may be employed.

Embodiment 4 In this embodiment, the P liquid usage was optimized for the Bk and color (Y, M and C) inks, which produced preferable results. Also in this embodiment, when printing, the Bk ink was ejected at 80 pl per picture element, and the Y, M and C inks were ejected at 40 pl per picture element. This is because in the case of the Bk ink, importance was placed on the print density, and therefore, the amount of the ink to be ejected was increased in order to increase the density. Because of the same reason as the one given in Embodiment 3, it is not desirable to use the same P liquid for the Bk and color inks.

As is evident from the foregoing, even in the case of a printing mode for producing a color print with mixed colors of Bk, Y, M and C inks, it is desirable to vary the amount of the P liquid to be ejected, between the Bk ink and the Y, M and C inks, or between the primary and secondary color, so that the amount becomes optimum for each color.

Figure 11:
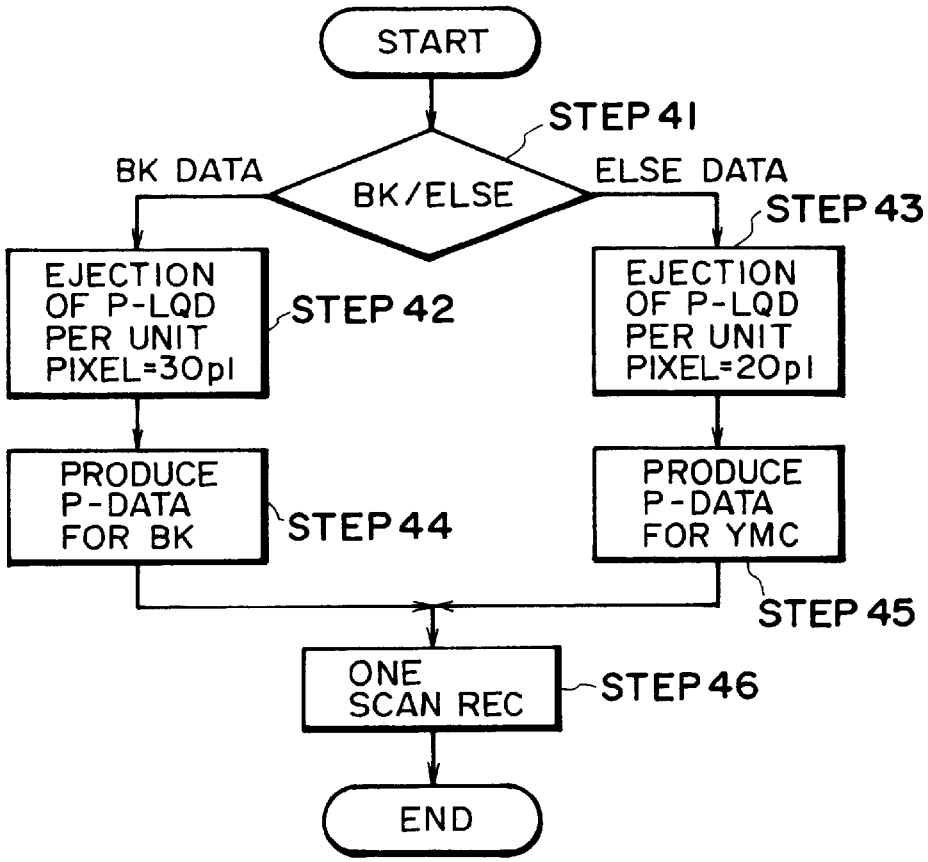
FIG. 11 is a flow chart of the printing operation in the fourth embodiment of the ink jet printing method in accordance with the present invention.

FIG. 11 depicts the flow of a single scan printing operation, in which the amount of the P liquid to be deposited per unit area of the print medium is controlled on the basis of whether the printing data is for the Bk ink or the Y, M and C inks.

Step 41 is a step in which it is determined for each picture element whether the printing data are for the Bk ink or the others (Y, M and C inks). When they are for the Bk ink, Step 42 is performed, and otherwise, the operation moves to Step 43.

Step 42 is the step to be performed when the printing data are for the Bk ink, in which the P liquid data are created in such a manner that the amount of the P liquid to be deposited per unit area of the print medium becomes relatively large. In this embodiment, the deposition data themselves are left unchanged, and instead, the amount of the liquid to be ejected per picture element is set at a higher level, that is, at 30 pl.

Step 43 is the step to be performed when the printing data are for the others, in which the P liquid data are created in such a manner as to reduce the amount of the P liquid to be ejected. In this embodiment, the amount of the liquid to be deposited per picture element is set at a reduced level, that is, at 20 pl.

In Step 44, the data equivalent to a single scanning line are produced, with the amount of the P liquid to be ejected per Bk picture element being set at 30 pl.

In Step 45, the data for a single line of scanning are produced, with the amount of the P liquid to be ejected per picture element of the other inks 5 being set at 20 pl.

In Step 46, a normal printing operation is carried out (the P liquid, and the Y, M and C inks, are deposited) by a single scanning line, using the liquid data produced as described above, for the P liquid, Bk ink, and Y, M and C inks.

In this embodiment, the amount of the P liquid to be ejected per pixel was modulated by means of controlling the energy given to the P liquid head. The control was executed so that it took more energy to eject the P liquid at 30 pl than at 20 pl.

In the case of a color print containing the Y, M and C inks, preferable results could be obtained by means of varying the printing process on the basis of whether the color inks are deposited so as to be independent from each other in order to create the primary colors, or overlaid upon each other to create the secondary colors such as R, G or B color.

Figure 12:
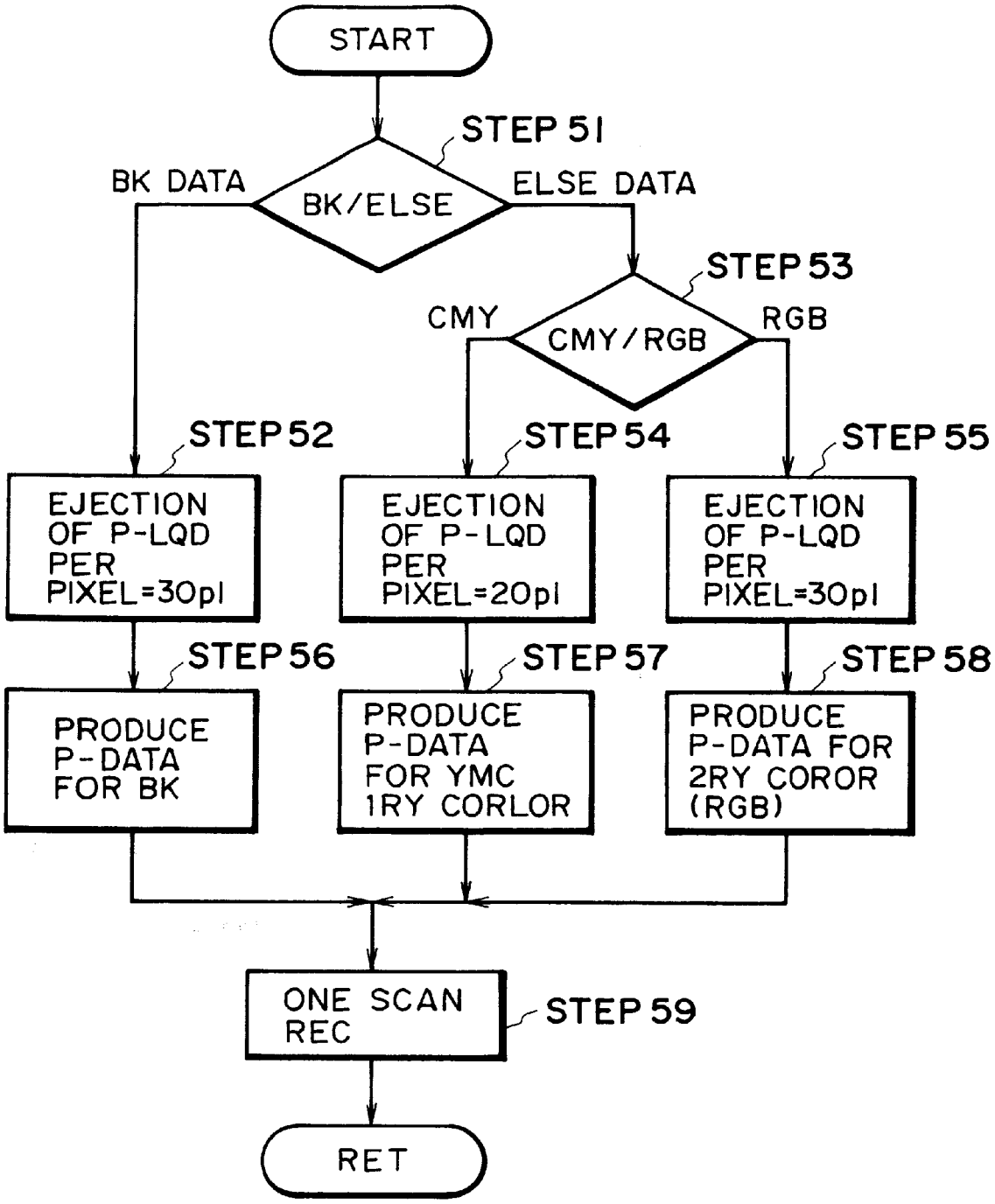
FIG. 12 is another flow chart of the printing operation in the fourth embodiment of the ink jet printing method in accordance with the present invention.

FIG. 12 presents the flow of a single scan printing operation, in which the amount of the P liquid to be ejected per unit area of the print medium is controlled on the basis of whether the printing data are for the primary colors of black, yellow, cyan, and magenta, or the secondary colors such as red, blue, or green.

In Step 51, it is determined for each pixel whether the printing data are for the Bk ink. When they are for the Bk ink, Step 52 is performed, and when they are for the others, Step 53 is performed.

In Step 53, it is determined for each pixel whether the colors are primary or secondary. When they are primary, Step 54 is performed, and when secondary, Step 55 is performed.

Step 52 is the step to be performed when the printing data are for the Bk ink, in which the P liquid data are produced so as to increase the amount of the P liquid to be ejected. In this embodiment, it was set at a relatively large level of 30 pl.

Step 54 is the step to be performed when the printing data are for the primary colors Y, M and C, in which the P liquid data are created so as to reduce the amount of the P liquid to be ejected. In this embodiment, it was set at a relatively low level of 20 pl.

Step 55 is the step to be performed when the printing data are for the secondary colors R, G and B composed of the primary colors Y, M and C, in which the P liquid data are produced so as to increase the amount of the P liquid to be ejected. In this embodiment, it was set at a relatively high level of 30 Pl.

In Step 59, a normal single scan printing operation is carried out under the printing conditions set as described above.

In this embodiment, the amount of the P liquid to be ejected was variably controlled by means of controlling the amount of the energy to be given to the heating member and/or varying the wave-form of the power given thereto to drive it. However, the present invention is not limited by this embodiment, and other means may be employed. For example, two or more heat generating members may be disposed at the ejection outlets, to be selectively activated.

When the amount of the P liquid to be ejected was optimized, as describe above, in response to the printing data, preferable results could be obtained.

Embodiment 5

When all of the printing heads for the Bk, Y, M and C colors and the P liquid ejecting head are driven at the same time, the instantaneous maximum electric power consumed by the printing apparatus increases. In this case, it is effective to employ a method in which in order to lower the instantaneous maximum power consumption, the number of the simultaneously driven heads is reduced.

Referring to FIG. 6, the instantaneous maximum power consumption can be reduced to 4/5, by means of driving the P liquid head when the printing head unit 103 is scanning in the direction of the arrow mark A and driving the Bk, Y, M and C ink heads when the printing head unit 103 is scanning in the direction of the arrow mark B. Such a means offers advantages in that it reduces the cost since the reduction in the maximum power consumption allows the size of the power supply section of the printing apparatus to be reduced. In this case, if the Y, M, C and Bk inks are ejected after a relatively long time, on the order of several seconds, following the ejection of the P liquid, the P liquid may not be so effective. Therefore, it is essential that the Y, M, C and Bk inks be deposited immediately after the P liquid deposition. This can be accomplished in the following manner; namely, immediately after the P liquid is ejected from the printing head which is moving in one of the main scanning directions, the Y, M, C and Bk inks are ejected from the printing head which is moving this time in the reverse direction.

Further, when the printing head unit 103 structured as illustrated in FIG. 2 is employed, the maximum instantaneous power consumption can be reduced to 3/5, since this structure makes it possible to activate the printing heads in such a manner that when the printing head unit 103 is moved in the scanning direction indicated by the arrow mark A, the P liquid and Bk ink head are activated in this order, and next, when moved in the direction indicated by the arrow mark B, the printing heads for the Y, M and C inks are activated.

As is evident from the above descriptions, the separation of the P liquid ejection from the ejection of the other liquids (Y, M and C inks) has the advantage that the maximum instantaneous power consumption of the printing head unit can be reduced.

Figure 13:
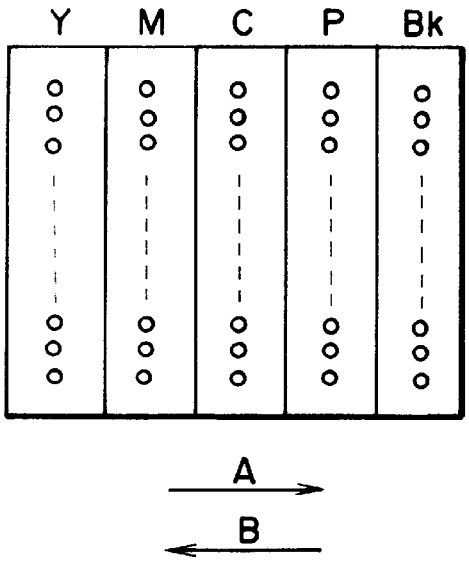
FIG. 13 is a front view of the printing head unit used in the fifth embodiment of the ink jet printing method in accordance with the present invention.

FIG. 13 is a front view of another printing head unit. The unique characteristic of this printing head unit is that the P liquid head is disposed between the Bk ink head and the C ink head.

For example, when the printing head unit scans in the arrow mark B direction, only the P liquid head and the Bk ink head are activated, the former being activated on the basis of the data for the Bk ink; and when the printing head unit scans in the arrow mark A direction, only the P liquid head and the heads for the Y, M and C inks are activated, the former being activated on the basis of the data for the Y, M and C inks.

This is because the above arrangement also has the advantage that the conditions for driving the P liquid head can be relatively easily changed between when the Bk ink is ejected during the scanning movement of the printing head unit in the arrow mark B direction and when the Y, M and C inks are ejected during the scanning movement of the printing head unit in the arrow mark A direction. This is because the conditions for driving the P liquid head can be more easily controlled for each scanning movement than for each pixel.

For example, when scanning in the arrow mark A direction, the voltage for driving the P liquid head is lowered to reduce the amount of the P liquid to be ejected from the P liquid head, and when scanning in the arrow mark B direction, the driving voltage for the P liquid head is raised to increase the P liquid ejection from the P liquid head. This arrangement allows more P liquid to be ejected when followed by the Bk ink, and less P liquid to be ejected when followed by the Y, M and C inks.

The driving voltage is switched when the primary scanning direction is switched between the arrow marks A and B directions. This method also has the advantage that the driving voltage can be more easily switched in comparison with when the driving voltage is switched for each dot.

It should be noted here that in the preceding embodiments, dyes were used as the coloring material, but the present invention is not limited by the embodiments, and pigment may be used as the coloring material. The print quality improver liquid, which renders the ink dye insoluble, can be obtained, for example, in the following manner.

First, the components list below are mixed. After they dissolve, the solution is filtered, with application of pressure, through a membrane filter having a pore size of 0.22 $\mu$m (commercial name: Fluoro Pore Filter; Sumitomo Electric Industries, Ltd.). Then, the pH of the filtered solution is adjusted to 4.8 using NaOH, yielding print quality improver liquid A1.

[A1 components]

| | |
|---|---|
| Cationic compound of low molecular weight | |
| Stearyl trimethylammonium chloride (commercial name: Electro-stopper QE; Kao Corp.) | 2 parts |
| Cationic compound of high molecular weight | |
| Polyaminesulfon (average molecular weight: 5000) (commercial name: PAS-92; Nitto Boseki Co., Ltd.) | 3 parts |
| Thioglycol | 10 parts |
| Water | rest |

As for the preferable inks which are rendered insoluble when mixed with the above print quality improver liquid, the following can be listed:

First, the components listed below are mixed, and then, the solution is filtered, with application of pressure, through a membrane filter (commercial name: Fluoro Pore Filter; Sumitomo Electric Industries, Ltd.) having a pore size of 0.22 $\mu$m, yielding the yellow Yl, magenta Ml, cyan Cl, and black Bkl inks.

| | |
|---|---|
| Y1 | |
| C. I. direct yellow 142 | 2 parts |
| Thioglycol | 10 parts |
| Acetylenol EH (Kawaken Fine Chemical) | 0.05 part |
| Water | rest |
| M1 | |
| Acid red | 2892.50 parts |
| (rest are the same as Y1) | |
| C1 | |
| Acid blue 9 | 2.5 parts |
| (rest are the same as Y1) | |
| Bk1 | |
| Food black 2 | 3 parts |
| (rest are the same as Y1) | |

According to this embodiment, the aforementioned print quality improver liquid (liquid compound) and inks are caused to mix with each other on the surface of the print medium, or in the print medium as they permeate therein. At the initial stage of the reaction, the low molecular weight cationic component or cationic oligomer, which are contained in the print quality improver liquid, ionically react with the water soluble dye, which is used in the ink and contains anionic radicals or anionic compound in the case of pigment ink, and instantly separate from the solution. More specifically, in the case of pigment ink, the pigment dispersion equilibrium is disturbed, thereby yielding pigment aggregates.

In the second stage, the aforementioned associative polymers composed of the dye and cationic substance of low molecular weight, associative polymers composed of the dye and cationic oligomer, or the pigment aggregate is absorbed (adsorbed) by the high polymers contained in the print quality improver solution; therefore, the dye aggregate or pigment aggregate, which are yielded as the results of the associative polymerization, further increase its size, which makes it difficult for the dye aggregate or pigment aggregate to move into the gaps among the print medium fibers. As a result only the solvent portion, from which the solute portion has separated, permeates the print medium, accomplishing both objectives: improvements in the print quality and fixation of the ink. At the same time, the associative polymer that are composed, through the aforementioned mechanism, of the low weight molecules among the cationic molecules and anionic dye, or are composed of the cationic oligomer and anionic dye, or the pigment aggregates, does not move with the solvent due to the increased viscosity. Therefore, even when the adjacent ink dots are composed of inks of different colors as they are in a full-color print the color generating components do not mix with each other to cause bleeding. The aforementioned aggregates are insoluble in water in its basic nature, which makes the formed image perfectly water resistant. There is an additional benefit; the shielding effects of the polymer improves the formed image in its resistance to the light.

As for the insolubilizing or aggregating process described in this specification, it occurs only in the initial stage in one example, and it occurs in both the initial and second stages in another example.

In the practical application of the present invention, it is unnecessary to use the cationic high polymer or polyvalent metallic salt, which has a high molecular weight, as it is used in the case of the conventional technology; or even when it is necessary to use it, all that is needed is to use it in an auxiliary term in order to enhance the effects of the present invention. Therefore, the amount can be minimized. As a result, the deterioration of the color developing performance of the dye, that is, the problematic aspect of the conventional technology, which manifests when an attempt is made to effect water resistance using the cationic high polymer or polyvalent metallic salt, can be prevented.

Also in the practical application of the present invention, there is nothing to limit the print medium choice. Preferable results can be obtained using so-called plain paper, such as conventional copy paper, bonded paper, or the like. Needless to say, preferable results can also be obtained using coated paper produced specifically for ink jet printing, or transparent film to be used with an OHP, as well as commonly used high quality paper or high gloss paper.

As described above, according to the present invention, the amount of the print quality improver liquid to be ejected per unit area of the print medium is controlled on the basis of the number of scanning passes in each printing mode, the color of the ink to be ejected from the head, that is, whether printing is carried out monochromatically or in color, and/or the printing data; and also, the print quality improver liquid most suitable for each printing mode is selected; therefore, it is possible to produce a highly reliable image of high quality.

Further, the printing quality improver liquid is ejected during its own scanning pass different from the one for at least one or all of the Bk, Y, M and C inks; therefore, it is possible to reduce the maximum instantaneous power consumption of the printing apparatus, which is effective to reduce the apparatus size and lower the running cost.

Next, Embodiments 6–8, which represent the second form of the present invention, will be described with reference to FIGS. 18–30.

Embodiment 6

Figure 18:
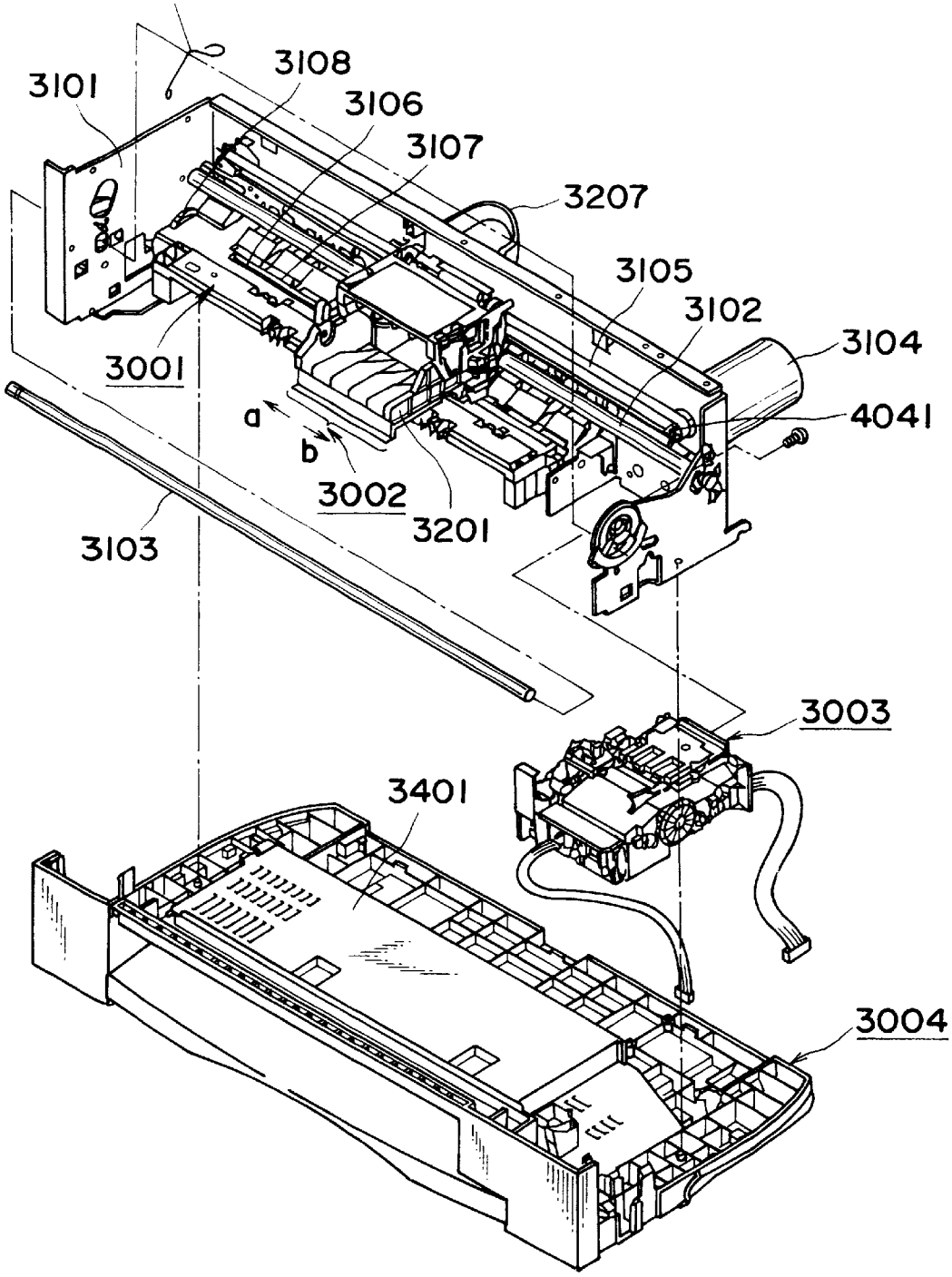
FIG. 18 is a general perspective view of the printing section in an embodiment of the ink jet recording apparatus in accordance with the present invention.
Figure 19:
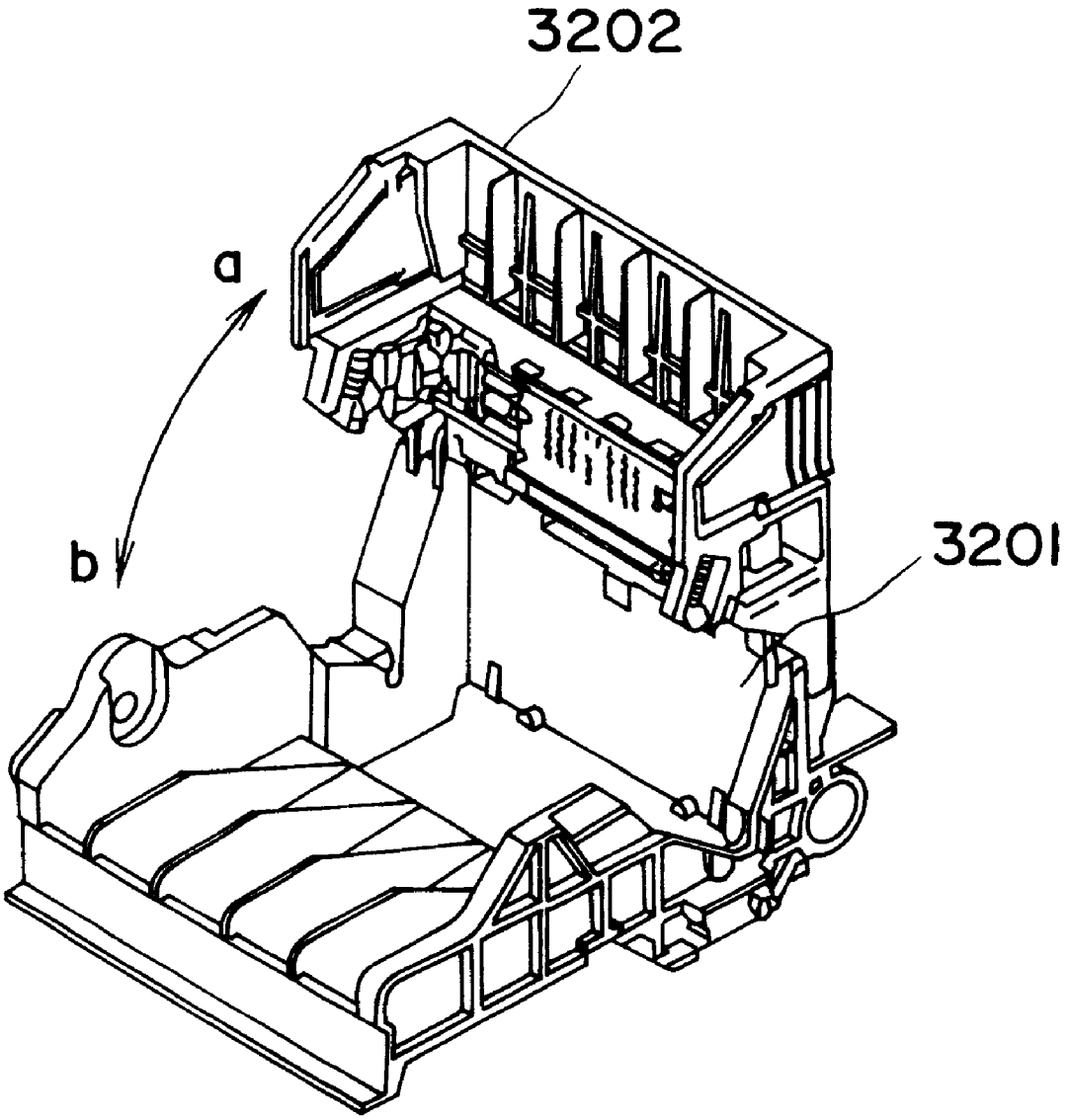
FIG. 19 is a general perspective view of the carriage of the printing section illustrated in FIG. 18.
Figure 20:
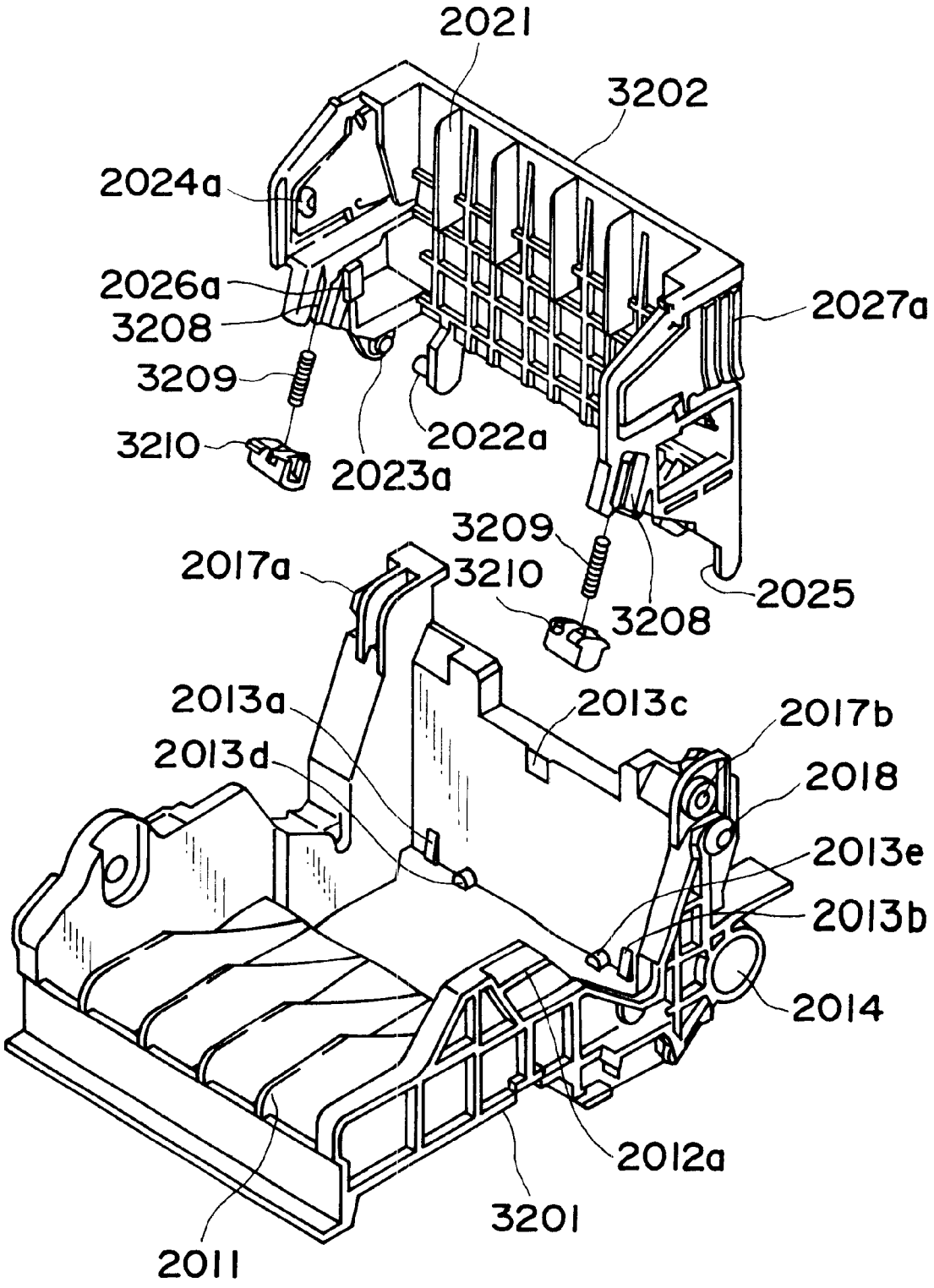
FIG. 20 is an enlarged, exploded perspective view of the carriage illustrated in FIG. 19.
Figure 21:
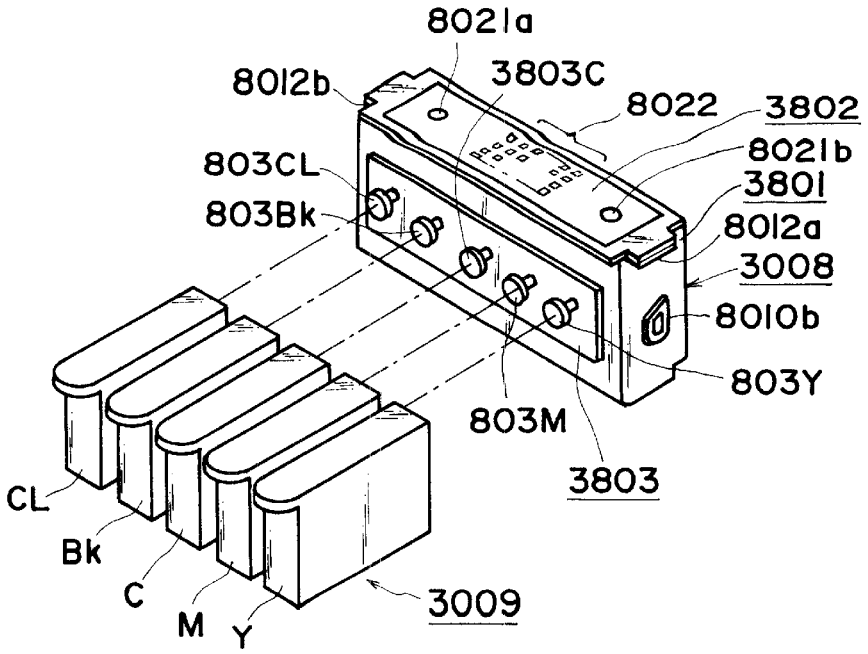
FIG. 21 is a general perspective view of a recording head mountable on the carriage illustrated in FIG. 20, and an ink container mountable replaceably on this recording head.
Figure 22:
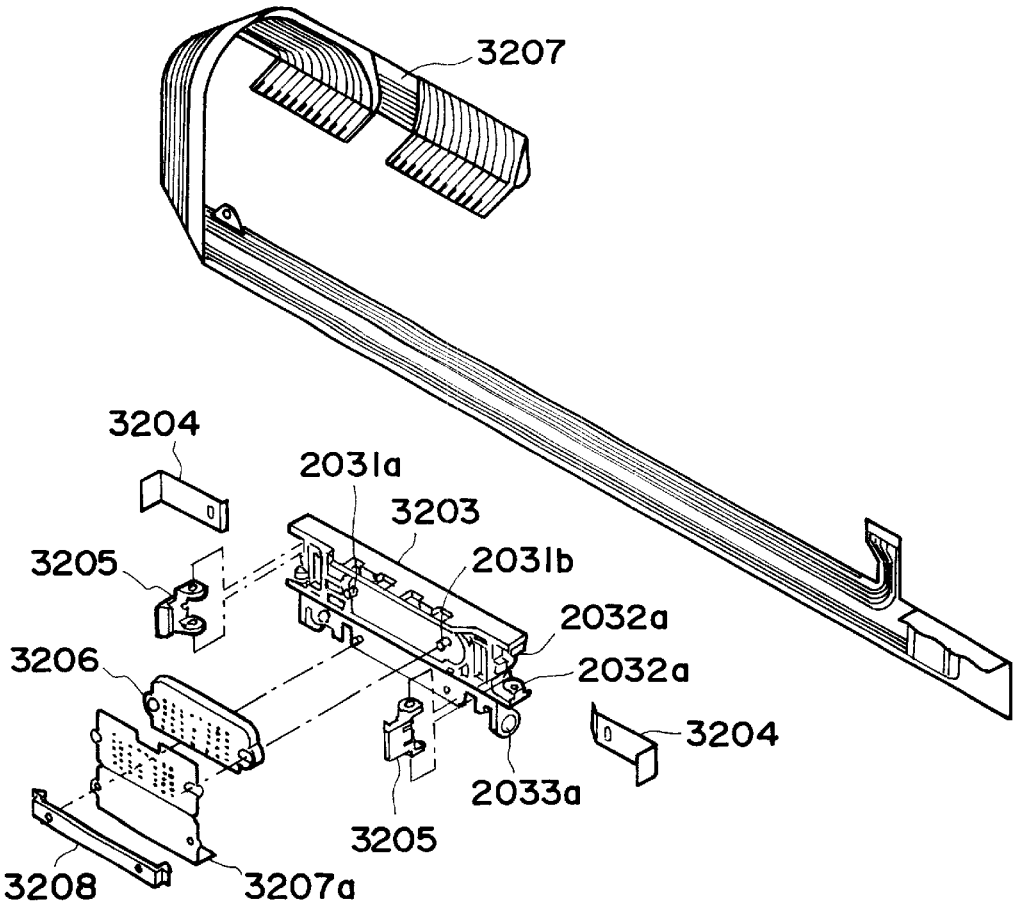
FIG. 22 is an exploded perspective view of a fixing member for connecting electrically the contact portion of the recording head and the main assembly of the printing apparatus.
Figure 23:
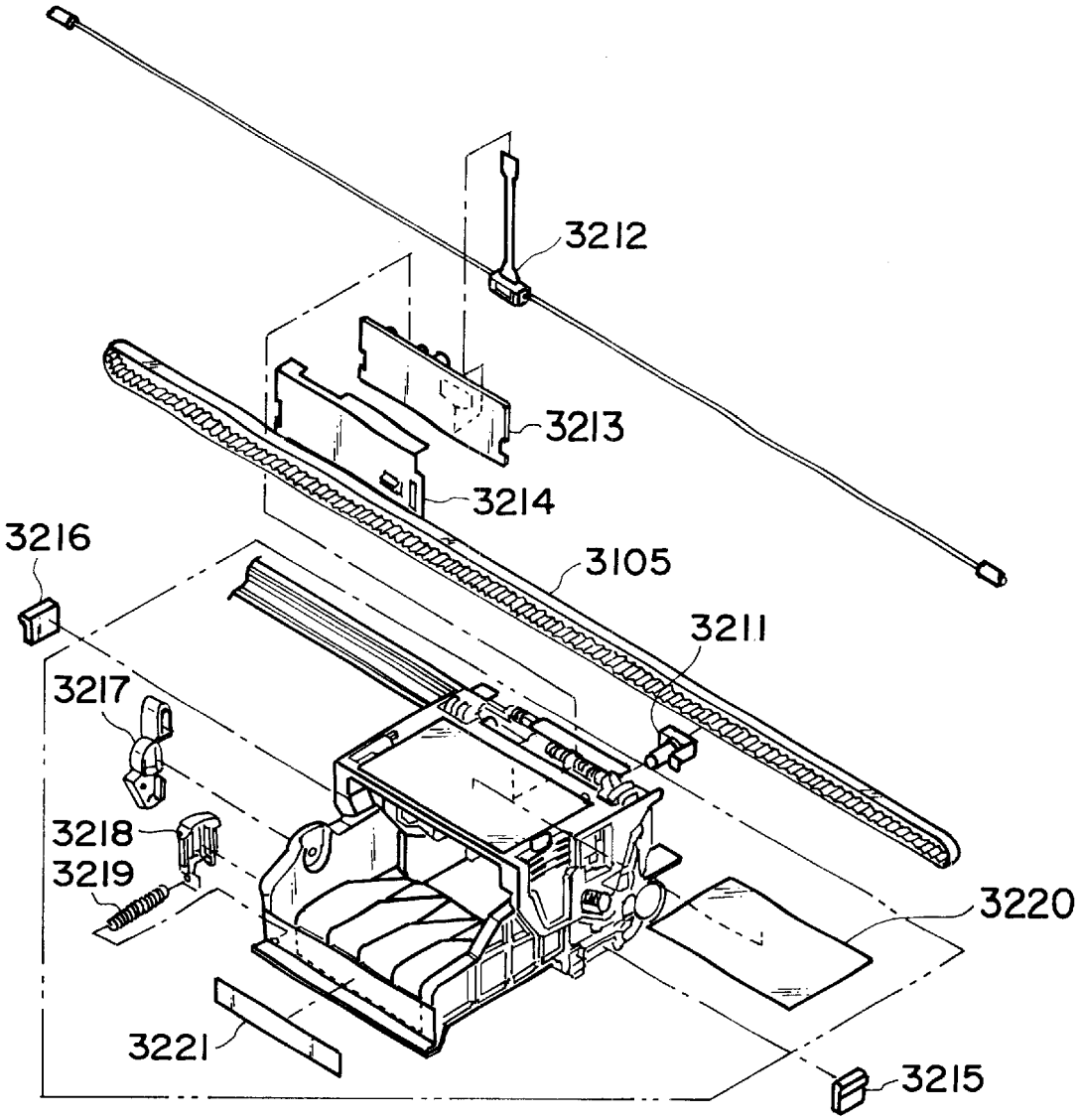
FIG. 23 is an exploded perspective view of the carriage of the printing section, and means for detecting the position thereof.
Figure 24:
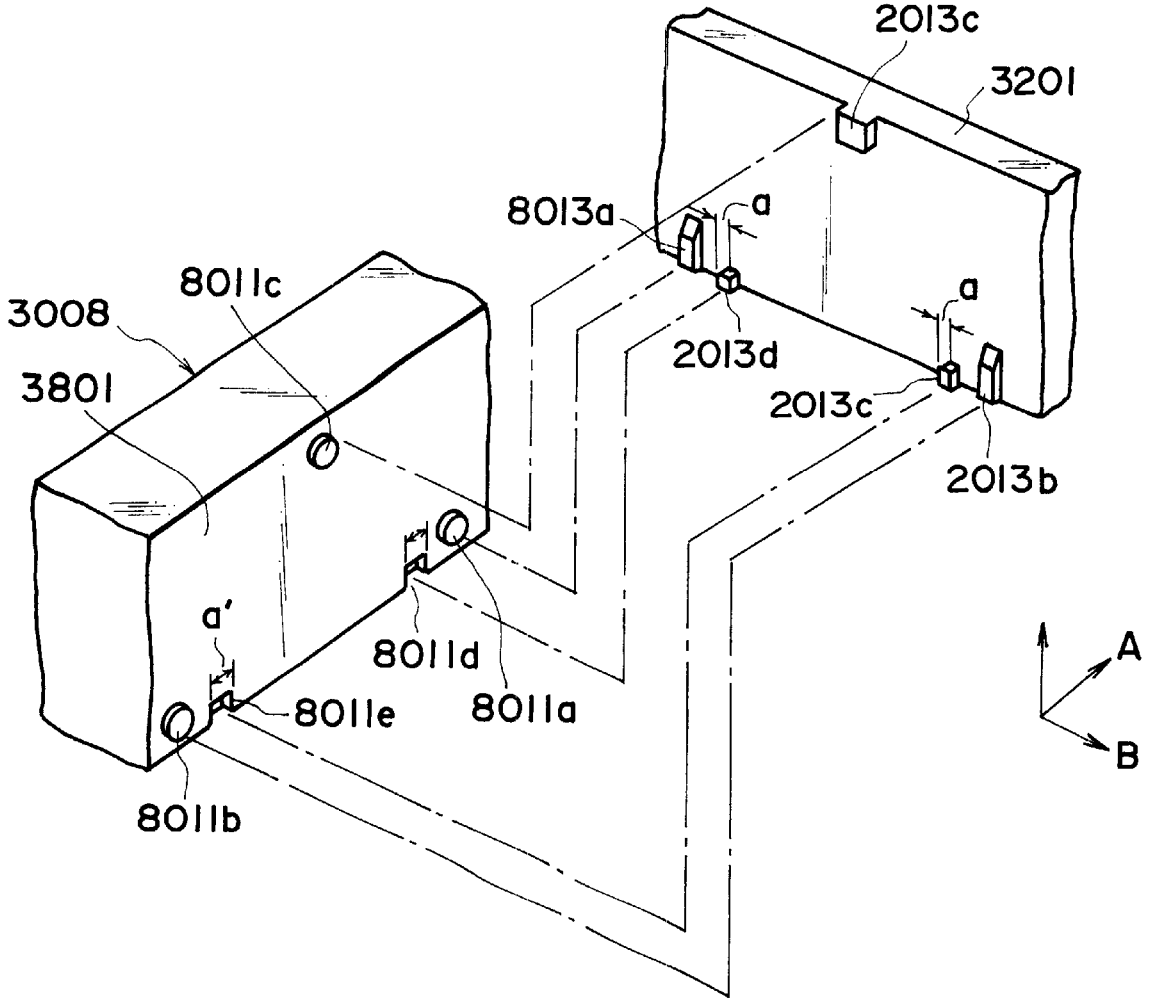
FIG. 24 is a general perspective view of the structure for fixing the positional relationship between the carriage of the printing section and the head base of the recording head portion.
Figure 25:
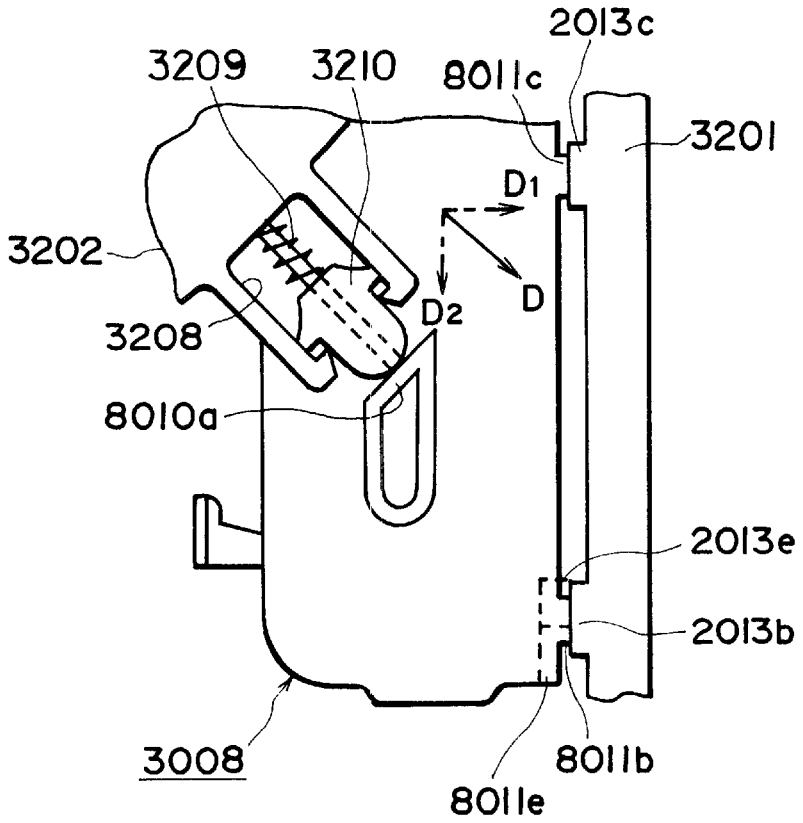
FIG. 25 is a side view of a fixing means for assuring the reliability of the positional relationship fixing structure illustrated in FIG. 24.
Figure 26:
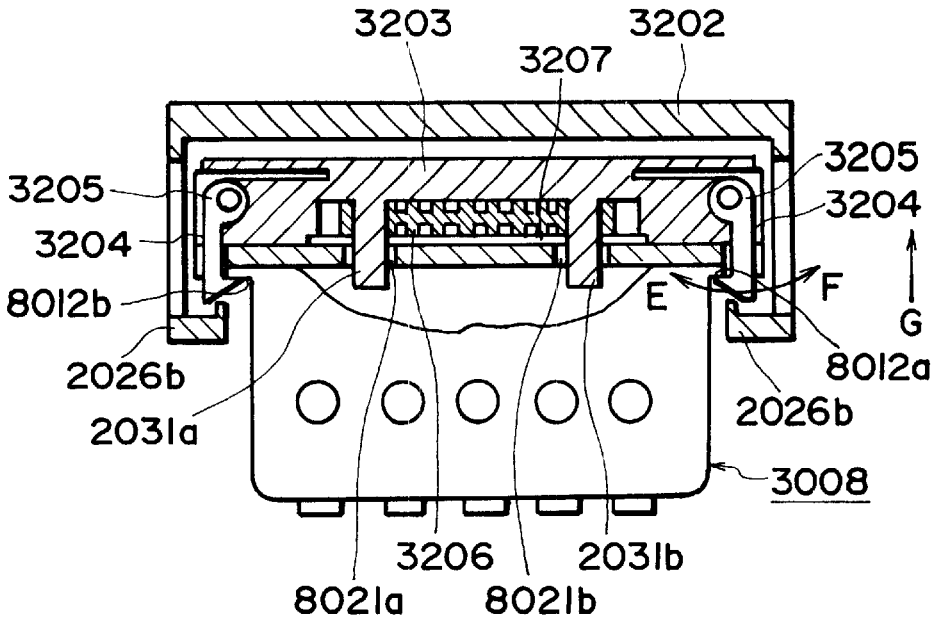
FIG. 26 is a sectional view of the fixing member for connecting electrically the contact portion of the recording head portion and the apparatus main assembly.
Figure 27:
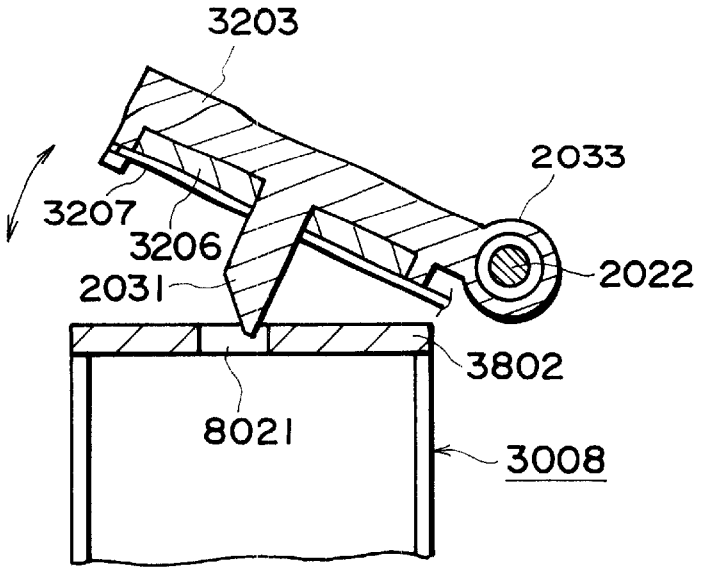
FIG. 27 is a sectional view of an FPC holder and the recording head portion, illustrating how the two are engaged.
Figure 28:
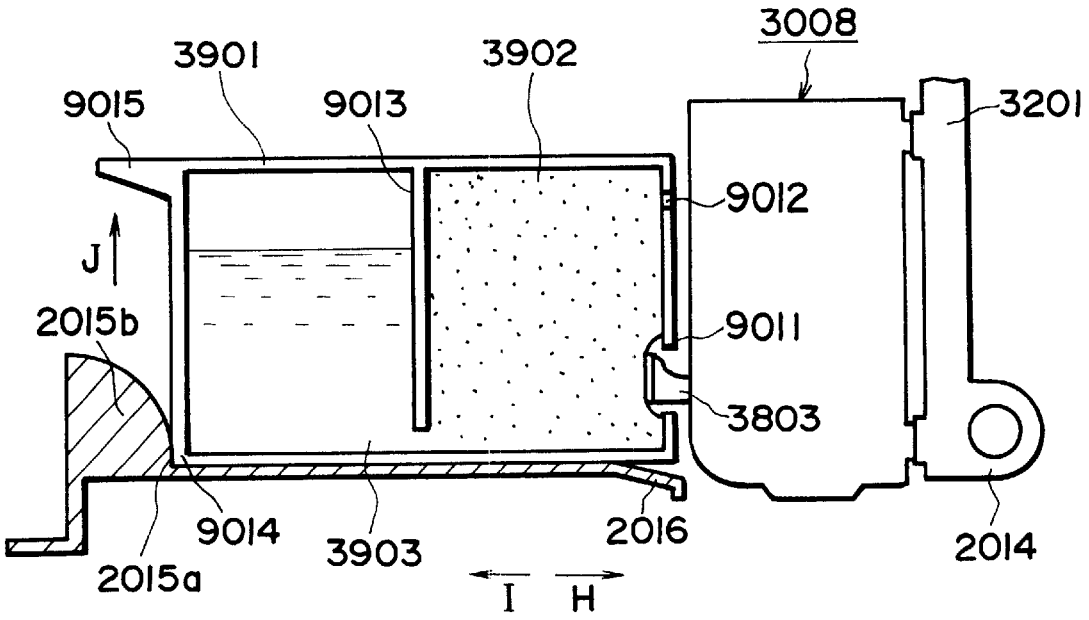
FIG. 28 is a sectional side view of the recording head portion and ink container portion, which are on the carriage portion.
Figure 29:
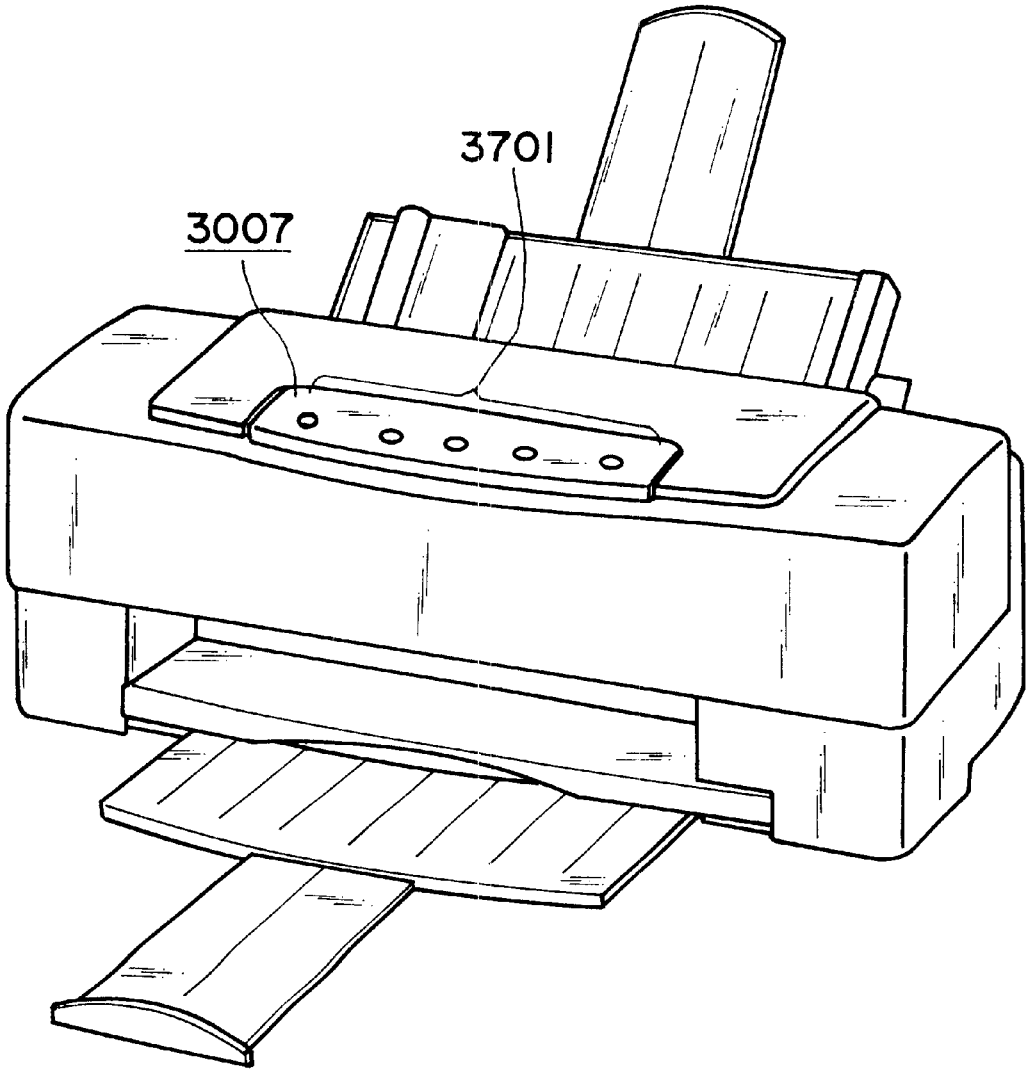
FIG. 29 is a perspective external view of an embodiment of the ink jet recording apparatus in accordance with the present invention.
Figure 30:
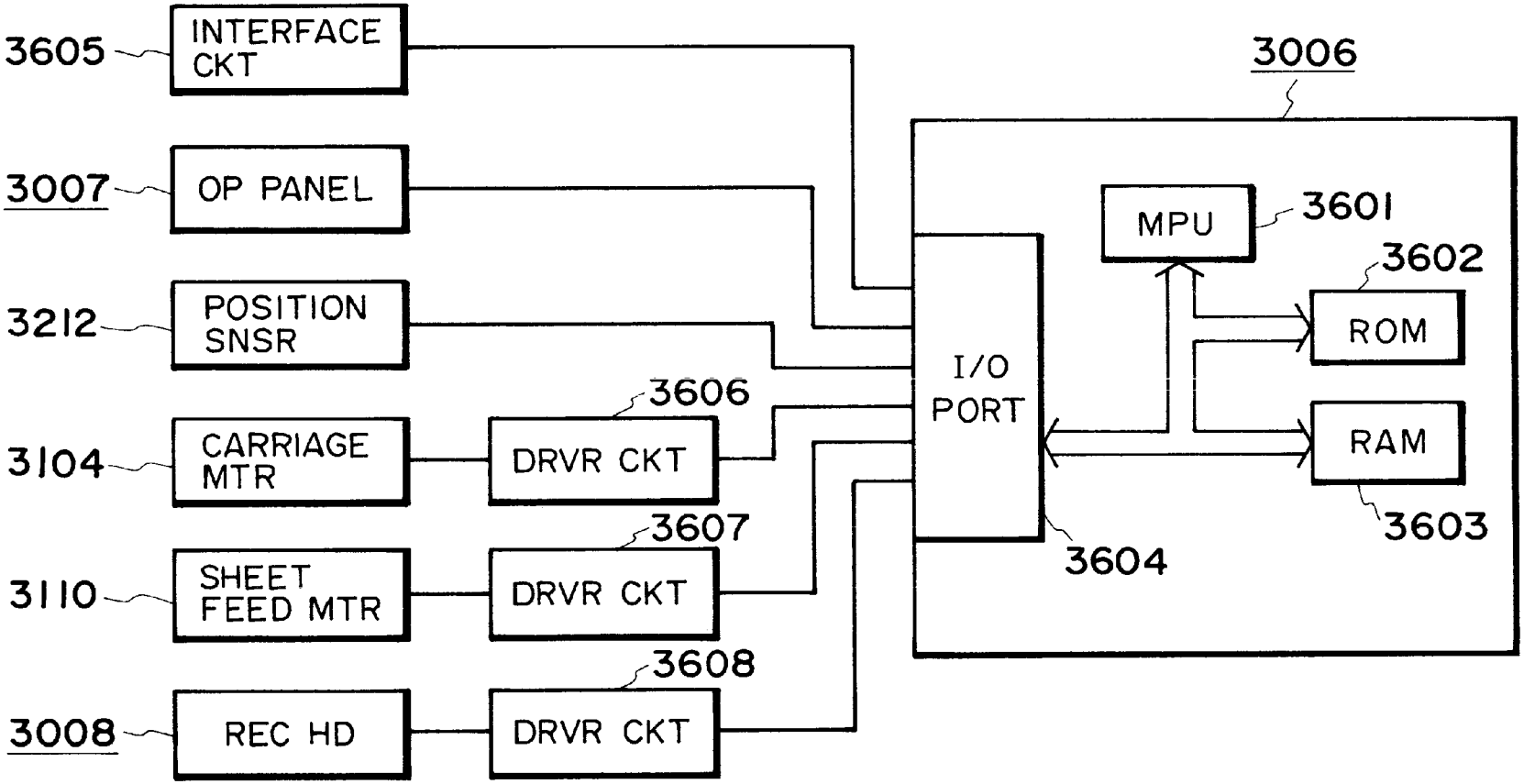
FIG. 30 is an explanatory block diagram of the control system in an embodiment of the ink jet recording apparatus in accordance with the present invention.

FIGS. 18–30 depict an embodiment of an ink jet recording apparatus in accordance with the present invention. FIG. 18 is a schematic perspective view of the printer portion of the ink jet recording apparatus in accordance with the present invention. FIG. 19 is a schematic perspective view of the carriage of the printer section illustrated in FIG. 18. FIG. 20 is an enlarged, exploded perspective view of the carriage illustrated in FIG. 18. FIG. 21 is a perspective view depicting a recording head mountable on the carriage illustrated in FIG. 20, and an ink container mountable replaceably on the recording head. FIG. 22 is an exploded perspective view of a fixing member which connects electrically the contact portion of the recording head and the main assembly of the apparatus. FIG. 23 is an exploded perspective view illustrating the carriage of the printer section, and a means for detecting the carriage position. FIG. 24 is a schematic perspective view illustrating a structure for fixing the positional relationship between the carriage of the printer section and the head base of the recording head. FIG. 25 is a schematic side view of a fixing means for making reliable the positional relation fixing structure illustrated in FIG. 24. FIG. 26 is a schematic sectional view of the fixing member for connecting electrically the contact portion of the recording head and the main assembly of the apparatus. FIG. 27 is a schematic sectional view illustrating how an FPC holder and the recording head are engaged. FIG. 28 is a sectional side view of the recording head and ink container, which are on the carriage. FIG. 29 is a perspective external view of an embodiment of the ink jet recording apparatus in accordance with the present invention. FIG. 30 is a block diagram for describing the control system of the embodiment of the ink jet recording apparatus in accordance with the present invention.

To begin with, the general structure of the ink jet recording apparatus will be described with reference to FIG. 18.

The printer portion illustrated in FIG. 18 generally comprises a sheet feeder portion 2001, a carriage portion 3002, a purge portion 3003, a casing portion 3004, a recording head portion 3003, and an ink container portion 3009.

The sheet feeder portion 3001 generally comprises a platen roller 3106, a pinch roller 3107, which presses the recording medium, having been delivered onto the platen roller 3107, so that the recording medium is prevented from hovering or acting likewise, and is reliably conveyed toward a carriage portion 3002. The platen roller 3106 is connected to the sheet feeder motor (unillustrated) by way of a transmission mechanism comprising a conveyer roller gear 3108 and a conveyer roller idler gear (unillustrated), and rotates as it receives the driving force from the motor.

The carriage portion 3002 generally comprises a carriage base 3201 for mounting the recording head portion 3008, and a head lever 3203 for retaining the recording head portion 2003 mounted on the carriage base 3201. The carriage base 3201 is disposed between the lateral walls of a substantially U-shaped chassis 3102, being supported on a guide shaft 3102 and a support shaft 3103, which are parallel to each other, and is movable in the longitudinal direction (hereinafter, primary scanning direction) of the shafts. The rotation of the carriage base 3201 is regulated since it is supported on both shafts 3102 and 3103. The carriage motor 3104 is fixed to one end of the central rear plate of the chassis 3102, and is connected to the carriage base by way of a pair of pulleys 4041 and a timing belt 3105 stretched between the pulleys 4041. As the carriage motor 3104 rotates forward or backward, the carriage base 3204 is reciprocated by way of the pulleys 4041 and timing belt 3105. The position of the carriage portion 3202 in the primary scanning direction is confirmed by a HP (home position) sensor (unillustrated) fixed to the chassis 3102. For example, it is possible to confirm whether or not the carriage portion 3002 is at the home position, which is a predetermined position outside the recording region, and also, is where the carriage portion 3002 is to be parked during a nonrecording period.

A purging portion 3003 is mounted on a frame portion 3004, below the home position. It is a unit provided with a mechanism for sucking the ink. When the ink ejecting outlets of the recording head portion 3008 are clogged up with a foreign substance or the like, and as a result, ink ejecting performance is deteriorated or the ink cannot be ejected any more, the waste ink is sucked out of the recording head portion 3008 parked at the aforementioned home position, by this purging portion 3003, so that the ink ejecting outlets are unplugged to restore the preferable ink ejecting performance.

The frame portion 3004 is provided with a waste ink container for storing the waste ink sucked out by the purging portion 3003.

Next, the structure of the recording head portion 3008 will be described with reference to FIG. 21.

Since the recording head portion 3008 in this embodiment mainly prints in color, it is of the multi head type, in which five liquid ejecting subheads are integrally disposed so that the black (Bk), cyan (C), magenta (M) and yellow (Y) inks, and a colorless solution (CL) capable of insolubilizing the dye, can be individually ejected. The recording head portion 3008 is replaceably mountable on the carriage portion 3002 illustrated in FIGS. 18–20, and when its service life expires or it becomes unusable due to some reason, it can be exchanged with a fresh ink jet recording head.

The recording head portion 3008 generally comprises a boxy head base 3801, a contact portion 3802 formed on the top surface of the head base 3801 in order to establish electrical connection between the head base 3801 and the wiring portion of the main assembly of the recording apparatus, and an ink supplying portion 3803 formed on one of the lateral walls of the head base 3801 in order to receive the ink supplied from the ink container portion 3009. This ink supplying portion 3803 is disposed so as to face each of the ink jet recording heads.

The ink container portion 3009 supplies each of the liquid ejecting subheads of the recording head portion 3008 with the ink or processing liquid, and is replaceably mounted on the carriage portion 3002.

In this embodiment, the carriage portion 3002, on which the recording head portion 3008 and ink container portion 3009 are mounted, is connected to a part of the timing belt 3105 which transmits the driving force of the carriage motor 3104, and reciprocates in the primary scanning direction, sliding on the parallel guide shaft 3102 and support shaft 3103. The recording is effected in the following manner: as the carriage portion 3002 is driven, the recording head portion 3008 ejects the ink while being shuttled across the entire width of the recording sheet (recording medium) which has been delivered from an unillustrated recording medium feeding apparatus onto the platen roller 3106 which faces the liquid ejecting surface of the recording head portion 3008.

Next, the carriage structure will be described in detail.

Referring to FIGS. 19, 20 and 21, the carriage portion 3002 can accommodate five liquid ejecting subheads, each of which ejects one of five different liquids: black (Bk), cyan (C), magenta (M) and yellow (Y) inks, and the colorless liquid (CL) (hereinafter, processing liquid) capable of making the dye insoluble and five ink container portions 3009, each of which supplies the corresponding liquid ejecting subhead with the ink or processing liquid.

Referring to FIG. 20, a pair of head lever axes 2023*a* (only one of them is illustrated) provided at corresponding bottom end portions of the lateral wall of the substantially U-shaped head lever 3202, and a pair of head lever axes bearing portions 2017*a* and 2017*b* provided at corresponding top end portions of the substantially L-shaped carriage base 3201, are engaged with each other, allowing the head lever 3202 to rotate about the head lever axis 2023*a*. Referring to FIG. 19, as the head lever 3202 is rotated open in the direction of an arrow mark, it becomes easier to mount or demount the recording head portion 3008. The opened head lever 3202 can be held open by engaging a pair of head lever positioning bosses (unillustrated) with a pair of head lever positioning holes 2018.

In a recess 3208 formed on each of the lateral walls of the head lever 3202, a head tension spring 3209 and a head tension 3210 are provided, wherein the head tension 3210 is held by the claw projecting in the recess 3208, against pressure generated by the compressed head tension spring 3209 as shown in FIG. 25. Therefore, as the head lever 3202 is rotated after the recording head portion 3008 is mounted on the carriage base 3201, the head tension 3210 comes in contact with the head tension receiving portion 8010*a* on the corresponding side (there is another one on the other side). Then, as the head lever 3202 is further rotated, the pressure generated by the head tension spring 3209 is applied, through the head tension 3210, to the head tension receiving portion 8010*a* in the direction of an arrow mark D, and also, the head lever fixing boss 2024*a* engages with the head lever fixing portion 2012*a*. As a result, the position of the recording head portion 3008 is fixed by the carriage base 3201 and head lever 3202.

On the contrary, when it is necessary to rotate the head lever 3201 to remove the recording head portion 3008 from the carriage base 3201, a pair of head lever release portions 2027 (only 2027*a* is shown) are pressed to push out the head lever fixing bosses 2024 (only 2024*a* is shown) so that the head lever fixing bosses are disengaged from the head lever fixing portions 2012 (only 2012*a* is shown), which allows the head lever 2020 to be rotated.

Referring to FIG. 20, a plurality of carriage ink guide ribs 2011 are provided on the internal surface of the carriage base 3201. They guide the bottom surface of the ink container portion 3009 when the ink container portion 3009 is mounted, and supports the mounted ink container portion 3009. Further, a plurality of head lever ink container guide ribs 2021 are provided on the internal surface of the head lever 3202. They guide the top surface of the ink container when the ink container is mounted, and hold the top surface thereof.

Referring to FIGS. 18 and 22, a carriage flexible cable 3207 supplies the recording head portion 3008 with image signals and driving signals. The position of the contact portion of the flexible cable 3207 is fixed by a pair of contact position fixing bosses 2031*a* and 2031*b* of an FPC holder 3203, and a rubber pad 3206, being clipped, together with the rubber pad 3206, to the FPC holder 3203 by an FPC holder 3208.

The head hook 3205 is fitted to a pair of axes 2032 (only 2032*a* is shown), which are provided on the corresponding lateral sides of the FPC holder 3203, being thereby rotatable. The head hook 3205 is pressured in the inward direction of the FPC holder 3203 by an FPC spring 3204, and also, the FPC holder 3203 is rotatable since a pair of FPC holder shaft bearing portions 2033 (only 2033*a* is shown) of the FPC holder 3203 is engaged with the FPC holder shafts 2022 (only 2022*a* is shown) of the head lever 3202. The image signal and driving signals supplied through the carriage flexible cable 3201 are delivered to the recording head portion 3008 by way of the contact portion 3802 in order to carry out a printing operation.

Referring to FIG. 23, a portion of the timing belt 3105 is fixed to the belt stopper 3211 fixed to the carriage base 3201. The carriage flexible cable 3207 is fixed to the carriage base 3201 with the use of a carriage PCB 3213 and CR PCB cover 3214. A linear encoder 3212 is a position detecting sensor to be used for controlling the position of the carriage portion 3002, and is fixed to the carriage base 3201.

A head lever label 3220, describing clearly the operation for mounting the recording head portion 3008 and ink container portion 3009 on the carriage portion 3002, may be pasted on the head lever 3202 so that it can be easily accessed by a user, or the contents of the aforementioned label may be stamped on the head lever 3202.

Referring to FIG. 24, five bosses are provided on the carriage base 3201. They fix the position of the recording head portion 3008. The positioning in the direction of an arrow mark A is accomplished by placing cylindrical bosses 8011*a*, 8011*b* and 8011*c* provided on the head base 3801 in contact with the trapezoidal bosses 2013*a*, 2013*b* and 2013*c*, correspondingly, whereas the positioning in the direction of an arrow mark B is accomplished by engaging the bosses 2013*d* and 2013*e* of the carriage base 3201 with the grooves 8011*d* and 8011*e* of the head base 3801. The width a of the boss 2013*d* or boss 2013*e* is determined in consideration of the width a' of the groove 8011*d* or 8011*b*, respectively. The positioning in the direction of an arrow mark C is accomplished by placing the top portions of the curved surface portions of the bosses 2013*d* and 2013*e* of the carriage base 3201 in contact with the top portions of the groove 8011*d* and 8011*e* of the head base 3801, respectively.

FIG. 25 is a simplified drawing to depict how the recording head portion 3008 is fixed to the carriage base 3201 with the head lever 3202. As is evident from FIG. 25, the head tension receiving portion 8010*a* of the recording head portion 3008 is pressured by the head tension 3210, which is under the pressure generated in the direction of an arrow mark D by the head tension spring 3209, attached to each of the lateral walls of the head lever 3202, to fix the position of the recording head portion 3008. As a result, the recording head portion 3008 is fixed at a predetermined position on the carriage base 3201.

FIG. 26 is a schematic drawing of the recording head portion 3008 fixed by the head lever 3202.

Its position is fixed as the contact position fixing bosses 2031*a* and 2031*b* of the FPC holder 3202 engage with the contact position fixing holes 8021*a* and 8021*b* of the recording head portion 3008, respectively. The engagement of the contact position fixing bosses 2031*a* and 2031*b* also fixes the positions of the rubber pad 3206 and carriage flexible cable 3207. The head hooks 3205 engage with the head hook accommodating portions 8012*a* and 8012*b* of the recording head portion 3008, on the corresponding sides. After the engagement, the rubber pad 3206 is in the state of being compressed, generating thereby the pressure to press the carriage flexible cable 3207 so that the electrical connection is established between the carriage flexible cable 3207 and the recording head portion 3008. As the head lever 3203 is rotated, the release claws 2026*a* and 2026*b* of the head lever 3202 rotate the head hooks 3205 in the direction of an arrow mark F, and as a result, the head hooks 3205 are disengaged from the head hook accommodating portions 8012*a* and 8012*b* of the recording head portion 3008, whereby the engagement between the recording head portion 3008 and the head hook 3205 is broken. Further, the power supplied from the main assembly side to the recording head portion 3008 can be interrupted by means of disengaging the carriage flexible cable 3207 from the contact point of the recording head portion 3008.

FIG. 27 is a schematic sectional view of the recording head portion 3008, being engaged with the FPC holder 3203.

The FPC holder 3203 is rotatable about the FPC holder shaft 2022 of the head lever 3202 since the shaft 2022 is fitted in the FPC holder shaft bearing portion 2033 of the FPC holder 3203; wherein they are fitted with some play. The tip of the contact position fixing boss 2031 of the FPC holder 3203 is shaped like a slantingly cut cylinder as shown in FIG. 27, so that the FPC holder 3203 can smoothly fit into the contact position fixing hole 8021 as it rotates about the FPC holder shaft 2022.

In this embodiment, the FPC holder 3203 is not a part of the head lever 3202, and some play is allowed between the two members; therefore, the established electrical connection between the recording head portion 3008 and the main assembly does not interfere with the process for fixing the position of the recording head portion 3008 on the carriage base 3201.

FIG. 28 is a sectional side view of the recording head portion 3008 and ink container portion 3009, which are on the carriage portion 3002.

The ink container portion 3009 is of a so called hybrid type, which contains two chambers, wherein, as seen from the direction of a supply port 9011, a front chamber is filled with an absorbent member 3902, and a rear chamber stores the ink 3903. As the ink container portion 3009 is attached to the recording head portion 3008, the ink supplying portion 3803 of the recording head portion 3008 presses the absorbent member 3902 of the ink container portion 3009, compressing thereby a part of it, whereby the ink container portion 3009 is pressured in the direction of an arrow mark I. However, the ink container portion 3009 is fixed on the carriage base 3201 so that the movement of the ink container portion 3009 in the direction of the arrow mark I is prevented. Therefore, the ink 3903 having been absorbed in the absorbent member 3902 is supplied to the ink jet recording head through the ink supplying portion 3803.

The carriage base 3201 is provided with a guide portion 2015*b* having a quadrantal section, and the ink container portion 3009 is smoothly mated with the recording head portion 3008 as it slides down on the curved surface portion of the guide portion 2015*b*. As for the removal of the ink container portion 3009, it can be easily accomplished by means of pushing up the knob 9015 in the direction of an arrow mark J. The waste ink from the ink supplying portion of the recording head portion 3008 and the ink supply port of the ink container portion 3009 is delivered to the purging portion 3003 or the like disposed below, through the waste ink portion 2016 of the carriage base 3201.

FIG. 29 is a perspective external view of an embodiment of the ink jet recording apparatus in accordance with the present invention.

The ink jet recording apparatus in accordance with the present invention is provided with a control panel portion 3007, which is located on the top surface thereof, and comprises a power source key or the like, as well as keys for selecting the various functions of the ink jet recording apparatus.

FIG. 30 is a block diagram of the control system in an embodiment of the ink jet recording apparatus in accordance with the present invention.

The recording operation of this ink jet recording apparatus is controlled by a control section 3006 comprising: a MPU 3601 which controls the overall operation of the apparatus while exchanging signals with the various sections of the recording apparatus: a ROM 3602 which stores the programs for the recording operations or processes, or the like; a RAM 3603 to be used as a recording data buffer or a work area for the processes carried out by the MPU 3601; and input-output signal port 3604. Namely, the signal from the control section 3006 is delivered to driver circuits 3606, 3607 and 3608 through the input-output signal port 3604, which drives the carriage motor 3104, sheet feeder motor 3100, and the recording head portion 3008, respectively. Also, the control section 3006 receives the recording data from a computer as the host apparatus, through an interface circuit 3605. An operator can control the recording apparatus by means of manipulating the keys and the like provided in the control panel portion 3007. As was described before, the linear encoder 3212 as the position detecting sensor is a means for detecting the position of the carriage portion 3002.

The water resistance can be surely obtained by means of ejecting the dye containing color ink immediately after the ejection of the processing liquid. However, when water resistance is unnecessary: for example, when a transparent sheet such as a sheet of PET (polyethyleneterephthalate) or the like is pasted on the recorded surface after the completion of the printing; when a user test-prints the images in order to confirm the produced printing data (text and/or picture image); or when the images are printed on an OHP sheet or so-called coated paper, that is, the recording medium constituted of a sheet of base material and an ink receptive layer coated thereon, a "no water resistance" key 3701 provided in the control panel portion is to be selected by the user, so that the head provided in the recording head portion 3008 for ejecting the processing liquid is controlled by the MPU 3601 working in conjunction with the ROM 3602, by way of the input-output signal port 3604 of the control section 3006, so as not to eject the processing liquid.

In the case described in the foregoing, the ejection of the processing liquid is directly canceled by the user, but it may be indirectly canceled by means of providing the driver of the computer as the host apparatus, with a means for selecting "no water resistance," which replaces the direct involvement of the user. In the latter case, the head provided in the recording head portion 3008 for ejecting the processing liquid is controlled by the MPU 3601 working in conjunction with the ROM 3602, through the interface circuit 3605 and the input-output signal port 3604 of the control section 3006, so as not to eject the processing liquid.

Embodiment 7

In the preceding Embodiment 6, a user selects the "no water resistance" key 3701 provided in the control panel portion 3007 to cancel the ejection of the processing liquid; whereas in this embodiment, when a trial printing key 3701 provided in the control panel portion 3007 for carrying out, for example, a draft mode printing (speed oriented printing mode such as low density printing mode) is selected, the ejection of the processing liquid is canceled.

Also, in the preceding embodiment, the ejection of the processing liquid is canceled when the user selects the trial printing key 3701 provided in the control panel portion 3007, but it may be canceled by means of providing the driver of the computer as the host apparatus, with a means for selecting the trial printing mode. In this case, the subhead provided in the recording head portion 3008 for ejecting the processing liquid is controlled by the MPU 3601 working in conjunction with the ROM 3602, through the interface circuit 3605 and the input-output signal port 3604 of the control section 3006, so as not to eject the processing liquid.

Embodiment 8

When processing liquid is coated on the OHP sheet, coated sheet, or the like, that is, the recording medium constituted of the base sheet and the ink receptive layer coated thereon, an inferior printed image is produced. In this embodiment, such a problem is eliminated by providing the ink jet recording apparatus with a function for allowing the user to input the recording medium selection, or a function for detecting automatically the type of the recording medium. In the latter case, the ejection of the processing liquid is controlled (whether or not the processing liquid is to be ejected is determined) in response to the recording medium type discriminated by the MPU 3601 as the recording medium discriminating means, and the ROM 3602 storing the printing controlling means; therefore, the time the user spends to make direct selection can be eliminated.

Further, the ink to be used in this embodiment of the present invention is not limited to be the dye ink. The pigment ink in which the pigment is dispersed may be used, and in this case, the processing liquid is of a type which aggregates the pigment. As for an example of the pigment ink in which aggregation occurs when mixed with the aforementioned processing liquid Al, the following ones can be listed: yellow Y2, magenta M2, cyan C2, and black K2 inks, which contain corresponding color pigment and anionic compound.

Black Ink K2 Anionic high polymer P-1 (styrene-methacrylate-ethylacrylate acid; number: 400; weight average molecular weight: 6,000; water solution containing solid content by 20%; neutralizer: potassium hydroxide), which was used as the dispersant, and the following components, were subjected to a dispersing process for three hours in a batch type vertical sand mill (product of Imex), using glass beads (1 mm in diameter) as media, while being cooled with water. After the dispersion, the viscosity and pH were 9 cps and 10.0, respectively. This dispersion was placed in a centrifugal separator to remove coarse particles, producing thereby a solution dispersed with carbon black having a weight average particle diameter of 100 nm.

(Composition of Carbon Black Dispersion)

| | |
|---|---|
| P-1 water solution (20% solid contents) | 40 parts |
| Carbon black Mogul L (product of Cablack) | 24 parts |
| Glycerine | 15 parts |
| Ethylene glycol monobutylether | 0.5 part |
| Isopropyl alcohol | 3 parts |
| Water | 135 parts |

Next, the obtained dispersion was sufficiently diffused to produce the ink jet black ink K2 containing the pigment. The solid contents in the final product was approximately 10 %.

Yellow Ink Y2

Anionic high polymer P-1 (styrene-acrylate methyl-methacrylate; acid number: 280; weight average molecular weight: 11,000; water solution containing 20 % solid content; neutralizer: diethanolamine), which was used as the dispersant, and the following components, were subjected to the same dispersing process as the black ink K2, producing thereby a yellow dispersion containing yellow color pigment having a weight average particle diameter of 100 nm.

(Composition of Yellow Pigment Dispersion)

| | |
|---|---|
| Water solution P-2 (20% solid contents) | 35 parts |
| C.I. pigment yellow 180 (Novapalm Yellow PH-G, available from Hechst) | 24 parts |
| Triethylene glycol | 10 parts |
| Diethylene glycol | 10 parts |
| Ethylene glycol monobutylether | 1 part |
| Isopropyl alcohol | 0.5 part |
| Water | 135 parts |

Next, the obtained dispersion was sufficiently diffused to produce the ink jet yellow Ink Y2 containing the pigment. The solid contents in the final product was approximately 10.0 %.

Cyan Ink C2

The same anionic high polymer P-1 used for producing the black ink K2, which was used as the dispersant, and the following components, were subjected to the same dispersing process as the carbon black dispersion, producing a cyan dispersion containing cyan pigment with a weight average particle diameter of 103 nm.

(Composition of Cyan Pigment Dispersion)

| | |
|---|---|
| Water solution P-1 (20% solid contents) | 30 parts |
| C.I. pigment blue 15:3 (Fastgemble-FGF, available from Dainippon Ink Chemistries) | 24 parts |
| Glycerine | 15 parts |
| Diethyleneglycol monobutylether | 0.5 part |
| Isopropyl alcohol | 3 parts |
| Water | 135 parts |

Next, the obtained cyan pigment dispersion was sufficiently stirred to produce the ink jet cyan ink C2 containing the pigment. The solid contents in the final product was approximately 9.6 %.

Magenta Ink M2

The same anionic high polymer P-1 used for producing the black ink K2, which was used as the dispersant, and the following components, were subjected to the same dispersing process as the carbon black dispersion, producing a magenta dispersion containing magenta pigment with a weight average particle diameter of 115 nm.

(Composition of Magenta Pigment Dispersion)

| | |
|---|---|
| Water solution P-1 (20% solid contents) | 20 parts |
| C.I. pigment red 122 (available from Dainippon Ink Chemistries) | 24 parts |
| Glycerine | 15 parts |
| Isopropyl alcohol | 3 parts |
| Water | 135 parts |

Next, the obtained magenta pigment dispersion was sufficiently diffused to produce the ink jet magenta ink M2 containing the pigment. The solid contents in the final product was approximately 9.2 %.

As described above, according to the present invention relating to an ink jet recording apparatus, which forms images by means of ejecting ink and/or processing liquid onto a recording medium, whether or not the processing liquid is to be used is determined by a user so that the processing liquid is not wasted, and also, the recording apparatus itself can be programmed so that the processing liquid is not ejected when the recording medium requiring no processing liquid is used, or when the test-printing is done. Therefore, the cost of the actual printing operation can be reduced. As a result, an ink jet recording apparatus capable of reducing its overall running cost can be provided.

Hereinafter, Embodiments 9–18 as the third form of the embodiment will be described with reference to FIGS. 31–48.

The print quality improver liquid (hereinafter, P liquid or processing liquid) in the present invention is liquid which is to be applied to print medium to improve the quality of the print produced through the ink jet printing. The print quality improvement includes: improvement in image properties such as density, saturation, sharpness of edge, dot diameter; improvement in ink fixability to the recording medium; and improvement in preservability of the printed image, that is, environmental resistance such as water resistance, light resistance, or the like.

In the following description, "environment" sometimes includes the type of the print medium. Further, according to the present invention, the liquid ejecting portion may be a part of the same head, or a separate head.

Embodiment 9

Figure 31:
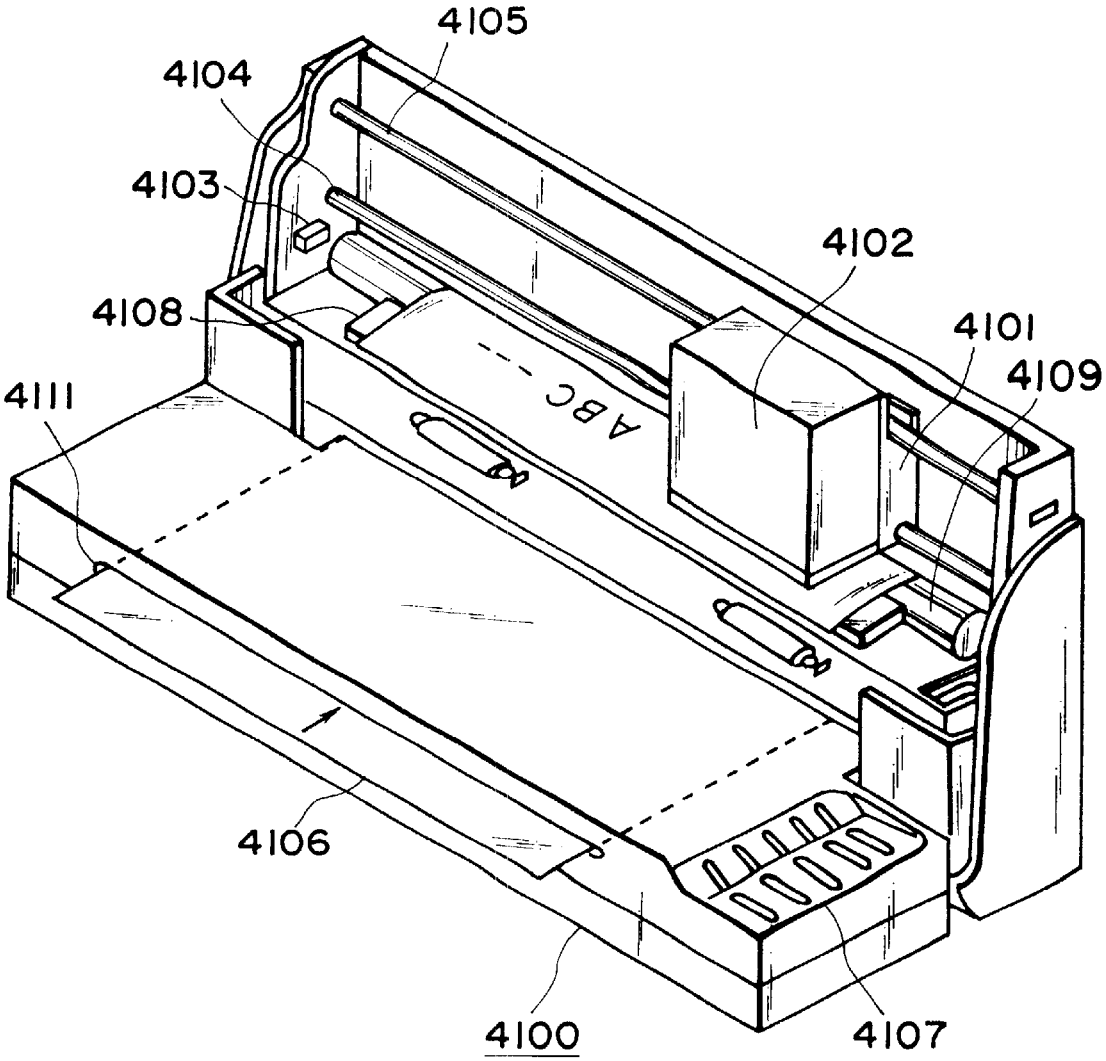
FIG. 31 is a perspective drawing depicting the structure of an embodiment of the ink jet printing apparatus in accordance with the present invention.

FIG. 31 is a perspective view of a printing apparatus to be used to embody the printing method in accordance with the present invention, and illustrates its general structure.

The liquid ejecting portion 4102 of a printing apparatus 4100 is a printing means capable of ejecting each of four color inks: Y, M, C, and Bk inks, and the P liquid, and is capable of reciprocating in the direction parallel to the axial line of a sheet feeder roller 4109 (hereinafter, primary scanning direction). A print medium 4106 is inserted in the direction of an arrow mark through a sheet feeder opening 4111 provided in the front panel of the printing apparatus. As it is fed further, it is turned back and is delivered by a feeder roller 4109 to the printing area provided on a flat platen disposed directly below the liquid ejecting portion 4102. A carriage 4101 is movable in the direction predetermined by a pair of guide shafts 4104 and 4105 arranged in parallel to the feeder roller 4109, and reciprocally scans the printing area, carrying the liquid ejecting portion 4102. As the liquid ejecting portion 4102, being carried by the carriage 4101, reciprocally scans the printing area, letters such as A, B, and C illustrated in FIG. 31 or other images reflecting the image data are printed on the predetermined area of the print medium 4106. A switch group and a display group 4107 are used to select various printing modes or display the status of the printing apparatus. An environment sensor 4103 measures the internal temperature and humidity of the printing apparatus, using well-known means.

Figure 32A:
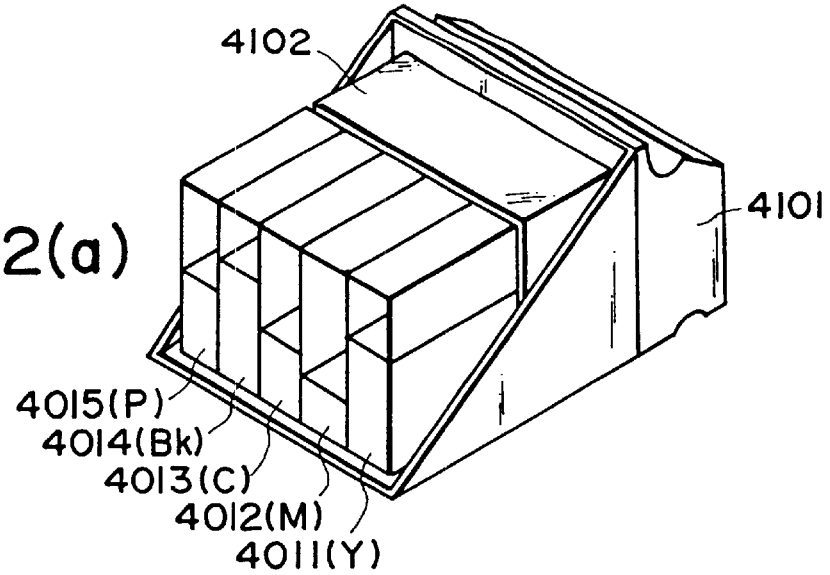
FIGS. 32(*a*)–32(*c*) illustrate the structure of a liquid portion, wherein FIG. 32(*a*) is a perspective view of the head units of the liquid ejecting portion disposed on the carriage.
Figure 32B:
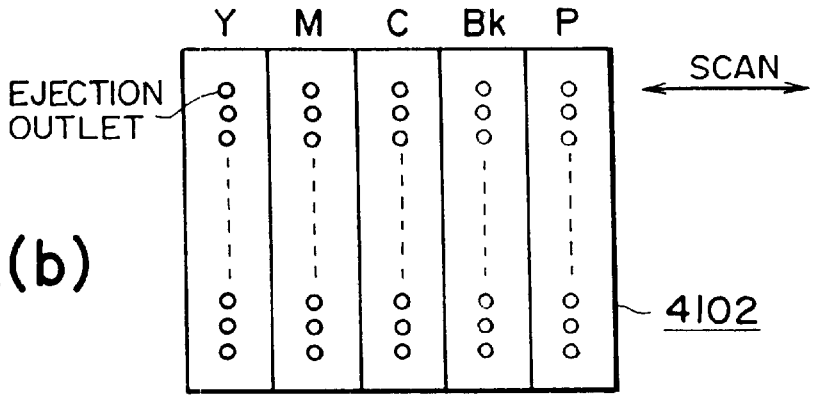
Figure 32C:
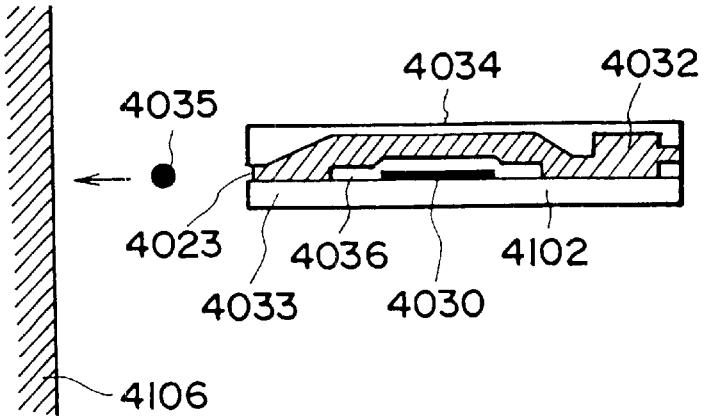

FIGS. 32(*a*)–32(*c*) depict the structure of the liquid ejecting portion 4102, wherein FIG. 32(*a*) is a perspective view of a plurality of subhead units in the liquid ejecting portion 4102 mounted on the carriage 4101; FIG. 32(*b*) is a front view of the ejection portion as seen from the direction of the print medium, depicting the ejection outlet arrangement; and FIG. 32(*c*) is an enlarged sectional view of the liquid ejecting portion, depicting the internal structure of one of the ejection outlets illustrated in FIG. 32(*b*). Referring to FIGS. 32(*a*) and 32(*b*), the liquid ejecting portion 4102 comprises four subhead units which eject yellow ink Y, magenta ink M, cyan ink C, or black ink Bk, and another subhead unit which ejects the P liquid. Each subhead unit in this embodiment generally comprises a head comprising the ejection outlet portion, which will be described later, and a container portion for storing the ink. Referring to FIG. 32(*a*), the containers 4011-14 4015 of the subhead units are composed of transparent material; therefore, the levels of the remaining ink and P liquid can be easily observed from outside. Though the ink containers in this embodiment are replacable independently from each other, and also, from the head, it is acceptable to integrate the containers, for example, in a combination of the P liquid container and Bk ink container, a combination of Y, M and C containers, or all of them.

Referring to FIG. 32(*b*), the number of ejection outlets in each subhead unit in this embodiment is 128. They are aligned in a direction substantially perpendicular to the primary scanning direction, wherein the outlet pitch of each line is approximately 70 $\mu$m. The outlet interval between the adjacent subhead units is 1/2 inch. This ejection portion 4102 can print with a resolution of 360 dpi by a single scanning pass.

Next, referring to FIG. 32(*c*), the ejection outlet 4023 is connected to a common liquid chamber 4032 by way of an ink liquid path through which the ink is supplied. Within the ink liquid path, a heat generating member 4030 and electrode wiring (unillustrated) are provided, wherein the former is an electrothermal transducer that generates thermal energy to be used for ejecting the ink supplied from the common liquid chamber 4032, and the latter supplies electrical power to the former. The heat generating member 4030 and electrical wiring are formed on a piece of substrate composed of silicon or the like, with the use of a film forming technology. On the heat generating member 4030, a protective film 4036 is formed so that the ink and heat generating member do not make direct contact. On the substrate 4033, resin or glass material is accumulated to form partitioning walls 4034 so as to create the aforementioned ejection outlets, ink path, common liquid chamber, and the like. In the liquid ejecting portion 4102 of this embodiment, the heat generating member 4030 is disposed so as to correspond with the ink ejecting outlet 4023, and is capable of ejecting the ink from the liquid ejecting outlet 4023, upon reception of the driving signal reflecting various printing data. Each heat generating member 4030 can independently generate the heat. When the ink within the nozzle is heated by the heat generating member 4030, it quickly reaches a state of film boiling, whereby bubbles are formed therein. As the bubbles develop, the pressure is generated in the ink. As a result, the ink is ejected as an ink droplet toward the print medium 4106, forming thereon the letters or picture images as it lands.

From the Y, M, C and Bk ink ejecting outlets provided in the liquid ejecting portion 4102, an approximately 40 ng of the ink is ejected, and from the P liquid ejecting outlet, 30–40 ng of special ink is ejected.

In this embodiment, an electrothermal transducer element was used as the heat generating member in the liquid ejecting portion, but the present invention is not limited by this embodiment. For example, a piezo-electric element, which is an electromechanical transducer element, may be employed, or any ink ejecting means may be employed as long as it enables the ink jet printing apparatus to perform its function. The head structure illustrated in FIG. 32(*c*) is of an edge shooter type, but, a side shooter type structure may be employed, which jets the ink or the like in the direction perpendicular to the surface of the heat generating member.

Figure 33:
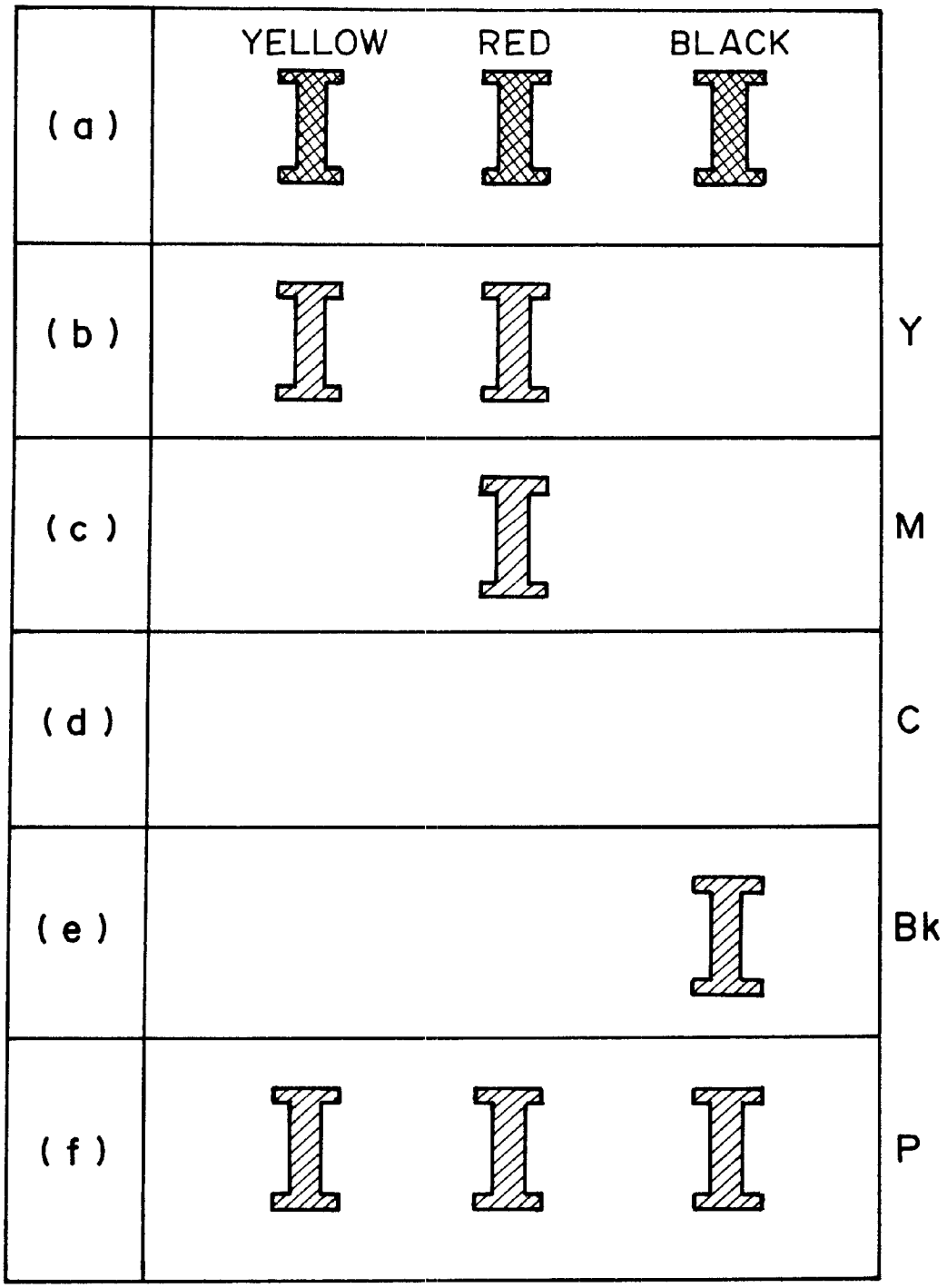
FIG. 33 is a data table showing the data to be used for ejecting the print quality improver liquid using the ink liquid ejecting portion illustrated in FIG. 32.

FIG. 33 is a table presenting a schematic of the data D1, which was derived from the image data, to be used for ejecting the print quality improver liquid. FIG. 33(*a*) is a schematic of the data for the image to be printed. In this case, a yellow, red, and black "I"s reflect the printing data. This letter "I" is formed by eight horizontal dots and 14 vertical dots. The image data are separated into sub-data for Y, M, C and Bk ink image, (b) presenting the data for yellow Y; (c), magenta M; (d), cyan C; and (e) presenting the data for black Bk. An alphabetic reference C stands for the data for not printing; therefore, there is no datum for C. FIG. 33(*f*) presents the data Dl for printing the P liquid. The data D1 is a logical sum of the printing data for Y, M, C and Bk inks.

Figure 34:
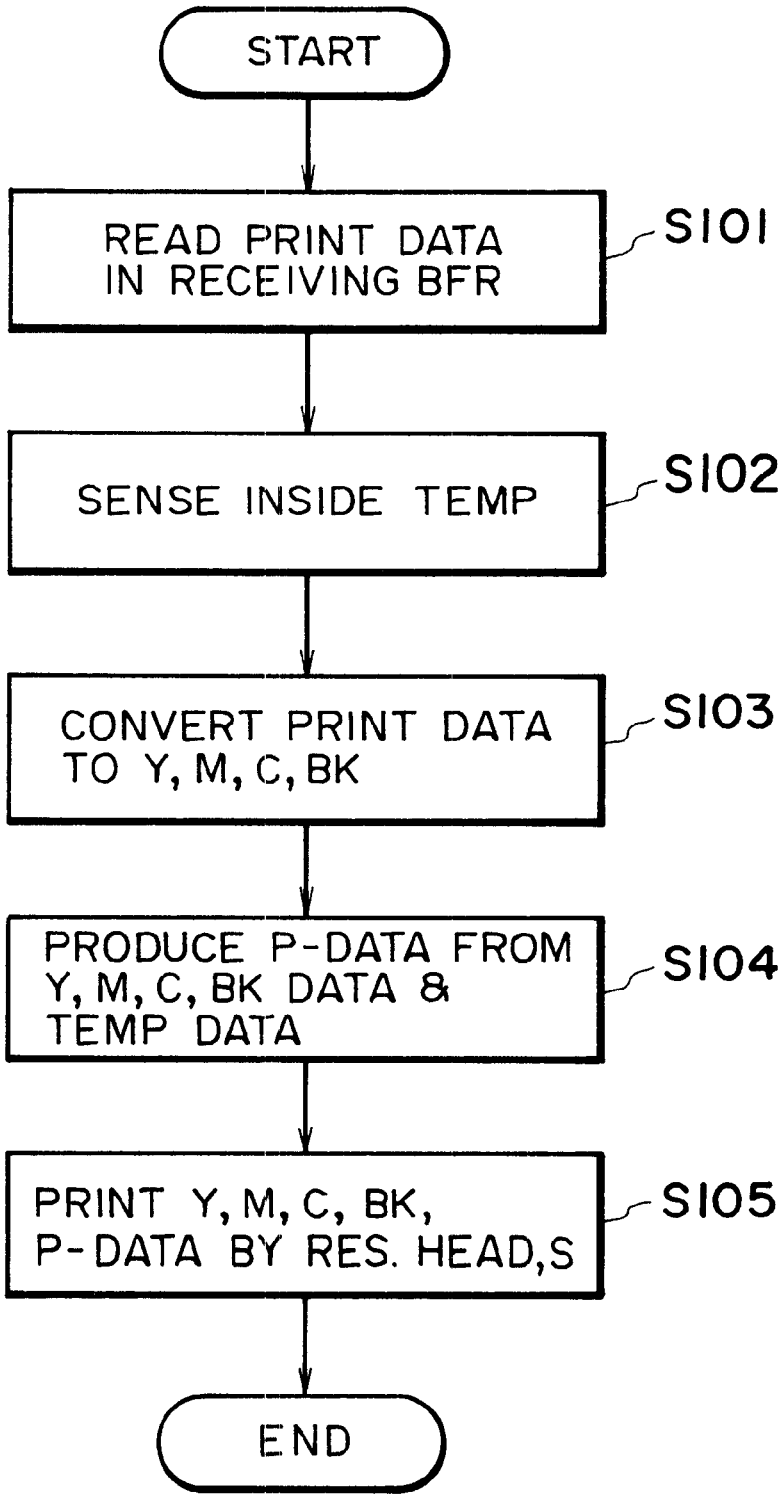
FIG. 34 is a flow chart of an embodiment of the ink jet printing method in accordance with the present invention.

FIG. 34 is a flow chart for an embodiment of the ink jet printing method in accordance with the present invention. This embodiment is characterized in that the amount of the print quality improver liquid is controlled in response to the internal temperature of the printing apparatus, wherein an alphabetic reference S in the flow chart stands for "step."

As the printing data are sent from the host computer to the printing apparatus, they are read into a receiving buffer within the printing apparatus (S1O1). Then, the internal temperature of the printing apparatus 4100 is measured by the environment sensor 4103 (S102). When the measured internal temperature is higher than a predetermined one, a control is executed to reduce the amount of the print quality improver liquid to be deposited per unit area of the print medium. On the contrary, when it is lower than the predetermined one, a control is executed to increase the amount of the print quality improver liquid to be deposited per unit area of the print medium.

More specifically, when the temperature is high, a control is executed to reduce the energy to be given to the liquid ejecting heater (heat generating member) disposed adjacent to the liquid ejecting outlet of the head unit disposed in the liquid ejecting portion.

Figure 35:
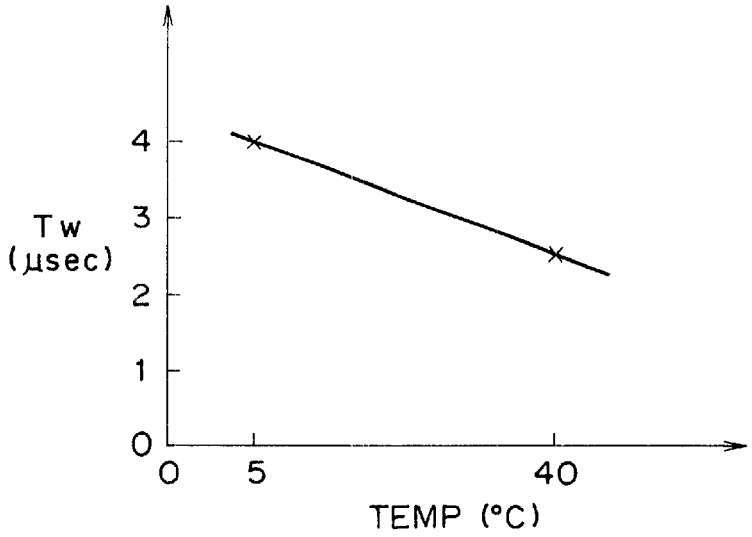
FIG. 35 is a graph to show the relationship between the internal temperature of the ink jet printing apparatus and the Tw.

FIG. 35 is a graph depicting the relationship between the internal temperature of the printing apparatus 4100 and Tw. As is evident from FIG. 35, a rectangular pulse wave is applied to the liquid ejecting heater, which is an electrothermal transducer element constituted of resistive material, for a duration of Tw (=approximately 3 $\mu$sec). When the temperature is 40C., the Tw is set at 2.5 $\mu$sec. On the contrary, when it is 5° C., which is rather low, the Tw is set at 4.0 $\mu$sec. When it falls between the two temperatures, the Tw is linearly varied in response to the temperature.

Referring back to FIG. 34, the printing data are converted into the data for Y, M, C and Bk inks (Sl03), and then, the P data are derived from the Y, M, C and Bk data (S104). Next, the Y, M, C and Bk inks and P liquid are ejected from the corresponding subhead units in response to the Y, M, C, Bk, and P data (S1O5).

Embodiment 10

Figure 36:
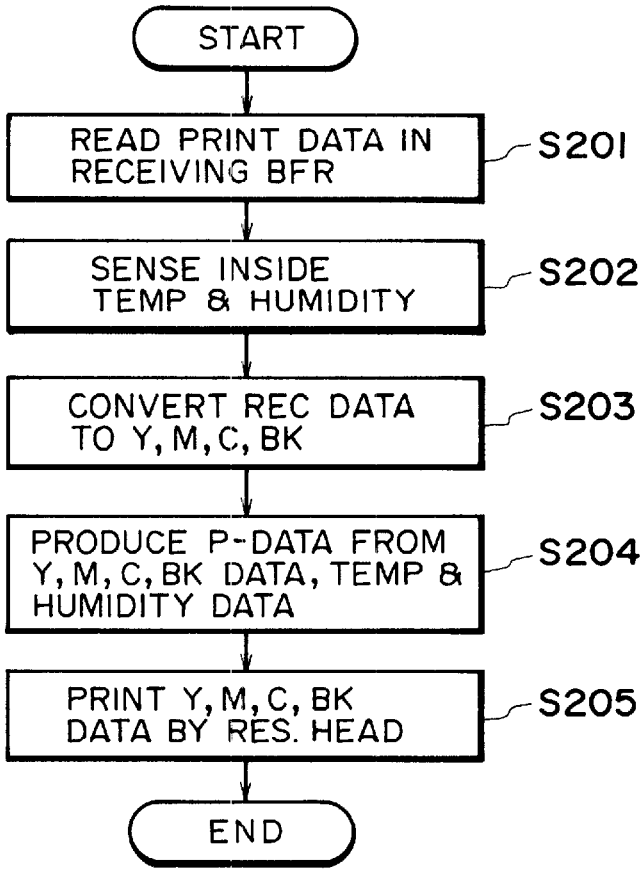
FIG. 36 is a flow chart of another embodiment of the ink jet printing method in accordance with the present invention.

FIG. 36 is a flow chart for another embodiment of the ink jet printing method in accordance with the present invention. This embodiment is characterized in that the amount of the P liquid to be ejected is controlled in response to the internal temperature and humidity of the printing apparatus. The compositions of the color inks and P liquid used in this embodiment are the same as those used in the preceding Embodiment 9.

Figure 37:
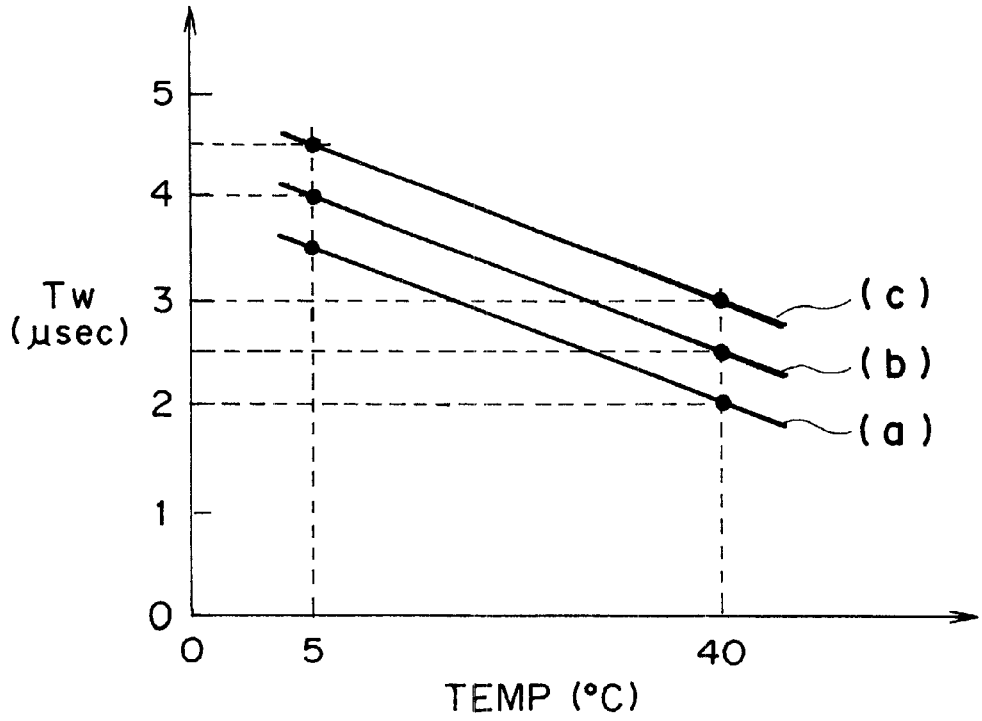
FIG. 37 is a graph to show the relationship between the temperature and Tw.

As the printing data are sent from the host computer to the printing apparatus, they are read into a receiving buffer within the printing apparatus (S201). Then, the internal temperature of the printing apparatus 4100 is measured by the environment sensor 4103 (S202). When the measured internal temperature is higher than a predetermined one, a control is executed to reduce the amount of the print quality improver liquid to be deposited per unit area of the print medium. On the contrary, when it is lower than the predetermined one, a control is executed to increase the amount of the print quality improver liquid to be deposited per unit area of the print medium. Further, when the relative humidity HU is no more than 40% RH, the Tw is determined with reference to the graphic relationship (a) of FIG. 37; when HU falls between 40% RH–70% RH, it is determined with reference to the graphic relationship (b) of FIG. 37; and when HU is no less than 70% RH, it is determined with reference to the graphic relationship (c) of FIG. 37, wherein FIG. 37 is a graph showing the relationship between the internal temperature of the printing apparatus 4100 and the Tw.

Referring back to FIG. 36, the printing data are converted into the data for Y, M, C and Bk inks (S203), and then, the P data are derived from the Y, M, C and Bk data (S204). Next, the Y, M, C and Bk inks and P liquid are ejected from the corresponding subhead units in response to the Y, M, C, Bk, and P data (S205).

At this time, the compositions of the inks used in Embodiments 9 and 10 will be given below.

Y (yellow)

| | |
|---|---|
| C.I. direct yellow 142 (dye) | 2 parts |
| Thiodiglycol | 10 parts |
| Acetylenol EH (Kawaken Fine Chemical) | 0.05 parts |
| Water | Rest |

M (magenta) The same as the Y ink, except that the dye is replaced with acid red 289 (2.50 parts)

C (cyan) The same as the Y ink, except that the dye is replaced with C.I. acid blue 9 (2.50 parts).

Bk (black) The same as the Y ink, except that the dye is replaced with C.I food black 2 (3.00 parts).

The composition of the P liquid is as follows:

| | |
|---|---|
| Cationic compound of low molecular weight | |
| Stearyl trimethylammonium chloride (commercial name: Electro-stopper QE; Kao Corp.) | 2.0 parts |
| Cationic compound of high molecular weight | |
| Polyaminesulfon (average molecular weight: 5000) (commercial name: PAP-92; Nitto Boseki Co., Ltd.) | 3.0 parts |
| Thioglycol | 10 parts |
| Water | rest |

When the P liquid with the above composition and the color inks were caused to mix or react with each other on the print medium, the following preferable results were obtained.

Within the normal environment, it was possible to produce a "highly reliable" printed product, which displayed superior water and light resistances, and remained stable regardless of the temperature and humidity changes. Also, it was possible to produce an image of "high quality," in which no feathering occurred; density was high; and no color bleeding occurred when printed in color.

Embodiment 11

In the examples described in the preceding Embodiments 9 and 10, before the four color inks were ejected, the P liquid was deposited over the entire area where the color inks were to be deposited, and then, the color inks were ejected. This embodiment is characterized in that the P liquid is ejected onto only the area where the Bk ink is to be deposited.

Figure 38:
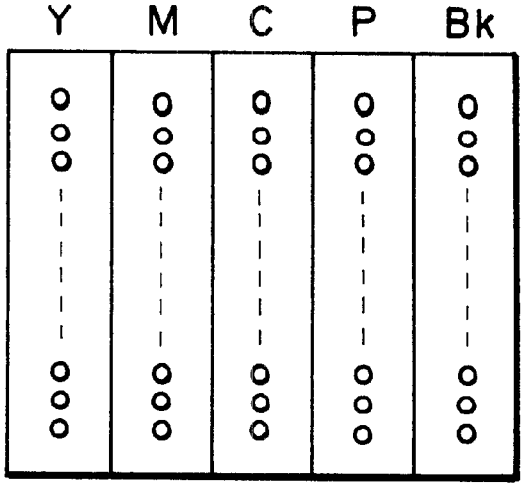
FIG. 38 is a front view of an example of the liquid ejecting portion employed in an embodiment of the ink jet printing method in accordance with the present invention.

FIG. 38 is a simplified front view of an example of the ink ejecting portion employed in this embodiment of the ink jet printing method in accordance with the present invention. Printing is done using the liquid ejecting portion illustrated in FIG. 38. As for the ejecting order, first, only the Y, M and C inks are ejected, being followed by the P liquid which is ejected onto the area where the Bk ink is going to be ejected, and then, the Bk ink is ejected thereon. According to such a method, the print quality can be improved at least in terms of the Bk ink: the reliability such as the water resistance or the like can be improved; feathering can be prevented; and the density can be increased.

The printing method of this embodiment cannot improve the reliability and print quality associated with the Y, M and C inks, but it can be effectively used when a user intends to produce a print product in which importance is placed on the Bk color as it is in the case of a print document spotted with few color images.

Embodiment 12

Figure 39:
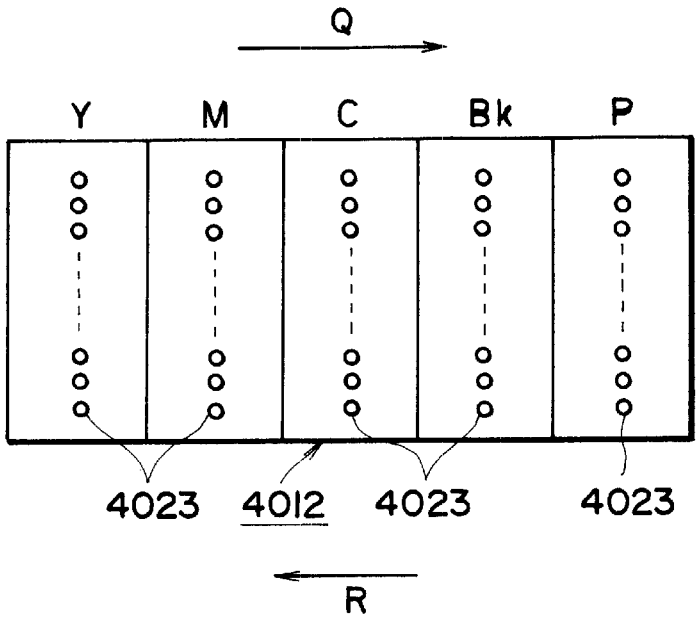
FIG. 39 is a front view of an example of the liquid ejecting portion employed in another embodiment of the ink jet printing method in accordance with the present invention.

This embodiment is characterized in that printing is done using an ejecting portion, in which the subhead units are arranged as illustrated in FIG. 39, whereas in the preceding Embodiment 11, the liquid ejecting portion, in which the subhead units were arranged as illustrated in FIG. 38, was used. Referring to FIG. 39, the subhead units are arranged in the order of Y, M, C, B and P relative to the direction of an arrow mark Q in the primary scanning direction.

Figure 40:
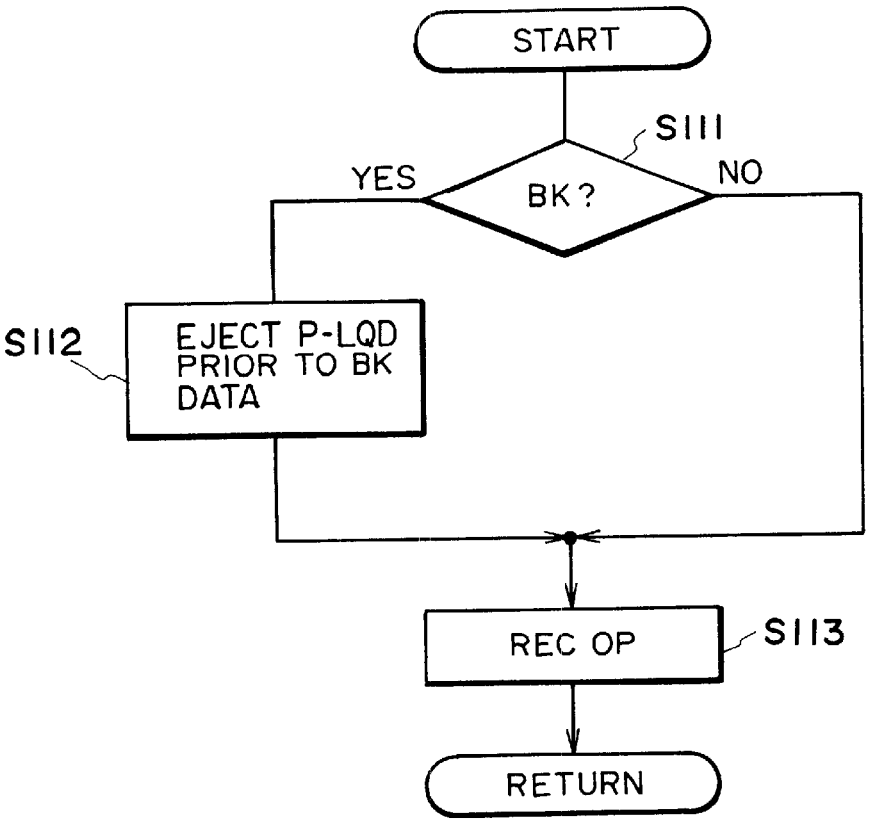
FIG. 40 is a flow chart of an operation for applying the print quality improver liquid to the Bk ink only.

FIG. 40 is a flow chart of an operation in which the P liquid is applied to only the area onto which the Bk ink is to be ejected.

In a step S111, it is determined whether or not the printing data are for the Bk ink. When they are for the Bk ink, that is, when the answer is Yes, a step S112 is performed, and when NO, a step S113 is performed.

In the step S112, the P liquid is ejected before the Bk ink. At this time, the P liquid head is driven so that the P liquid position and Bk ink position coincide on the print medium. It should be noted here that the high reliability and high quality can be obtained even when the P liquid is not ejected onto the entire locations onto which the Bk ink is ejected, that is, when the P liquid is ejected onto 25% of the locations onto which the Bk ink is ejected. Therefore, the data are thinned out in real time in step S112, and then, a step S113 is performed.

In the step S113, the normal single scanning pass printing operation is carried out. Namely, the head structure illustrated in FIG. 39 is employed and the printing is done in the direction of an arrow mark R, in the order of Bk, C, M and Y.

The compositions of the inks and processing liquid used in this embodiment are as follows:

| | |
|---|---|
| Y (yellow) ink | |
| Glycerine | 5.0 wt. % |
| Thioglycol | 5.0 wt. % |
| Urea | 5.0 wt. % |
| Isopropyl alcohol | 4.0 wt. % |
| Acetylenol EH (Kawaken Chemical) | 1.0 wt. % |
| Dye C.I. direct yellow 142 | 2.0 wt. % |
| Water | 78.0 wt. % |
| M (magenta) ink | |
| Glycerine | 5.0 wt. % |
| Thioglycol | 5.0 wt. % |
| Urea | 5.0 wt. % |
| Isopropyl alcohol | 4.0 wt. % |
| Acetylenol EH (Kawaken Chemical) | 1.0 wt. % |
| Dye C.I. acid red 289 | 2.5 wt. % |
| Water | 77.5 wt. % |
| C (cyan) ink | |
| Glycerine | 5.0 wt. % |
| Thioglycol | 5.0 wt. % |
| Urea | 5.0 wt. % |
| Isopropyl alcohol | 4.0 wt. % |
| Acetylenol EH (Kawaken Chemical) | 1.0 wt. % |
| Dye C.I. direct yellow 199 | 2.5 wt. % |
| Water | 77.5 wt. % |
| Bk (black) ink | |
| Glycerine | 5.0 wt. % |
| Thioglycol | 5.0 wt. % |
| Urea | 5.0 wt. % |
| Isopropyl alcohol | 4.0 wt. % |
| Dye C.I. food black 2 | 23.0 wt. % |
| Water | 78.0 wt. % |

-continued

| P liquid | |
|---|---|
| Polyallylamine hydrochloride | 5.0 wt. % |
| Benzalkonium chloride | 1.0 wt. % |
| Diethylene glycol | 10.0 wt. % |
| Acetylenol EH (Kawaken Chemical) | 0.5 wt. % |
| Water | 83.5 wt. % |

As is evident from the above compositions, acetylenol EH, a surface activating agent, is added to the Y, M, and C inks by 1.0% to improve the permeability, whereas it is not added to the Bk ink. Therefore, the Y, M and C inks are superior in the fixability to the Bk ink. On the other hand, the Bk ink is slightly inferior in the permeability to the Y, M and C inks, but it provides a higher density and a sharper edge; therefore, it is suitable for printing the letters or line drawings. Also, the acetylenol is added to the P liquid by 0.5% to improve slightly the permeability.

In this embodiment, the dye was used as the coloring materials for the Y, M, C and Bk inks, but the present invention is not limited by this embodiment. Namely, the coloring material may be pigment alone, a mixture of the dye and pigment, or the like, and as long as the proper P liquid, that is, a P liquid most suitable for aggregating any of the components in the ink composed of the coloring material and solvent, is used, the same effects can be obtained.

In this embodiment, an electrothermal transducer element was used as the heat generating member in the liquid ejecting portion, but the present invention is not limited by this embodiment. For example, a piezo-electric element, which is an electromechanical transducer element, may be employed, and also, there is no restriction concerning the structure of the liquid ejecting portion.

Figure 41:
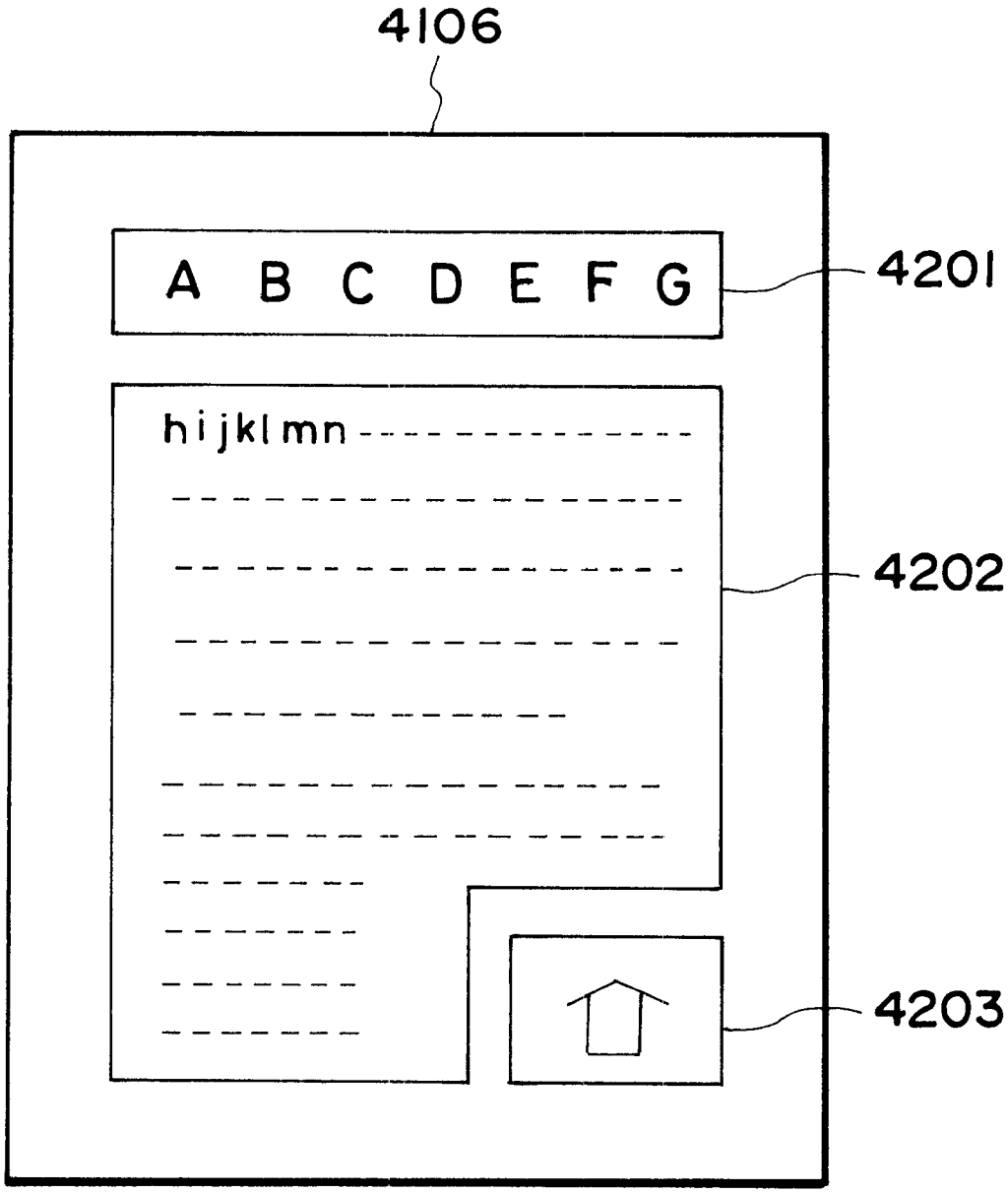
FIG. 41 is a planar drawing of a printed product obtained through the application of another embodiment of the ink jet printing method in accordance with the present invention.

FIG. 41 is a plan view of a print produced using the printing method of this embodiment, that is, a result of the printing operation in this embodiment. In this case, a title portion 4201, a main text portion 4202, and a picture image portion 4203 have been printed on a print medium 4106.

In this example of printed medium, the letters in the title portion 4201 are printed in R (red); the letters in the main text portion 4202 are printed in Bk (black); and the picture image in the picture image portion 4203 is printed in R. In terms of the overall layout of the print, the main text 4202 of the Bk occupies almost the entire page, and the rest of the page is spotted with the title and picture image portions in R.

The P liquid to be ejected ahead of the inks is ejected onto only the area corresponding to the main text portion which is to be printed in Bk; no P liquid is ejected onto the other areas. This is because it is in terms of only the Bk that a "highly reliable" print of "high quality" is wanted, in which the water resistance, light resistance, and the like are improved; feathering and color bleeding are reduced; the color development is superior; and the print density is high.

For instance, if the entire surface of this print is splashed with water, the title and picture image portions are going to be washed out with the water, whereas the Bk portion is going to remain the same as before due to the effects of the P liquid, allowing thereby the contents to be read. In other words, in the case of a print composed mainly of the Bk, the objects of the print can be mostly fulfilled as long as the reliability and high quality are realized in the Bk portion.

The aforementioned process, in which the P liquid and ink are caused to mix and react with each other, has its own merits in that high reliability and high quality are realized. On the other hand, the process also has demerits. That is, when the P liquid is ejected onto the entire surface of the print medium, or all the areas onto which the color inks are to be deposited, the P liquid is going to be wasted, which is one of the causes of an increased running cost. Further, this process deposits an extra amount of liquid, that is, the P liquid, on the area where the color inks are to be deposited; in other words, the fiber of the print medium is given an additional amount of liquid. As a result, the print medium is cockled or wrinkled, which compromises the print quality. Even though the cockling may disappear after the print dries, the cockling occurring during the printing operation changes the predetermined microscopic distance between the print medium and liquid ejecting portion, changing thereby the landing point of the ink droplet, which results in the deterioration of the print quality.

Only the P liquid is applied in correspondence with only the Bk, provided that the wanted print is going to be printed primarily with the Bk.

Embodiment 13

In Embodiment 12, the P liquid is sparingly applied depending on whether or not printing is done with the Bk. However, the present invention is not limited by this embodiment. For example, the P liquid may be spared depending on whether an image to be printed is letters or a picture.

Figure 42:
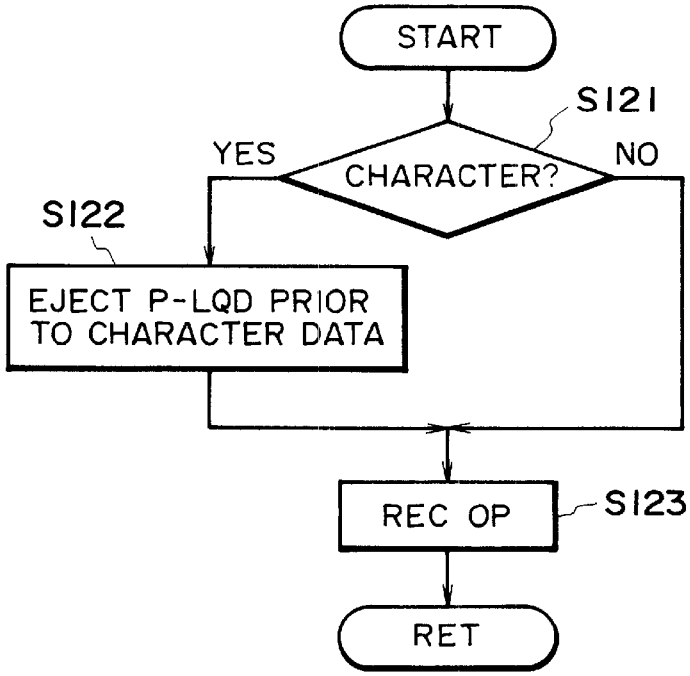
FIG. 42 is a flow chart of an operation for applying the print quality improver liquid to the letters only.

FIG. 42 is a flow chart of a single scanning pass printing operation, in which the P liquid is ejected in correspondence with only a letter.

In a step S121, it is determined whether or not the printing data is for a letter. When they are for a letter, that is, when the answer is Yes, a step S122 is performed, and when it is No, a step S123 is performed. As for the means for determining whether or not the printing data is for a letter, it may be a known means.

In a step S122, the P liquid is ejected before the printing is done in response to the letter printing data. At this time, the P head is driven in such a manner that the P liquid lands on the print medium, on the same spot on which a letter is printed. It should be noted here that it is not necessary to eject the P liquid onto the entire spots onto which the letter producing ink is ejected; high reliability and high quality can be obtained as long as the P liquid is ejected onto 25%–50% of the spots onto which the letter producing ink is ejected. For example, when the color to be printed is a primary color Bk, Y, M or C, a ratio of 25% may selected, and when it is a secondary color R (red), G (green), or B (blue), another ratio of 50% may be selected. The process for thinning out the data for this operation is carried out in real time in a step S122, and then, a step S123 is followed.

In a step S123, a single pass printing operation is carried out in the normal primary scanning direction.

Embodiment 14

In Embodiment 12, the P liquid was sparingly used depending on whether or not printing is done with the Bk. However, the present invention is not limited by this embodiment. For example, the P liquid may be spared depending on whether an image to be printed is Bk letters or not.

Figure 43:
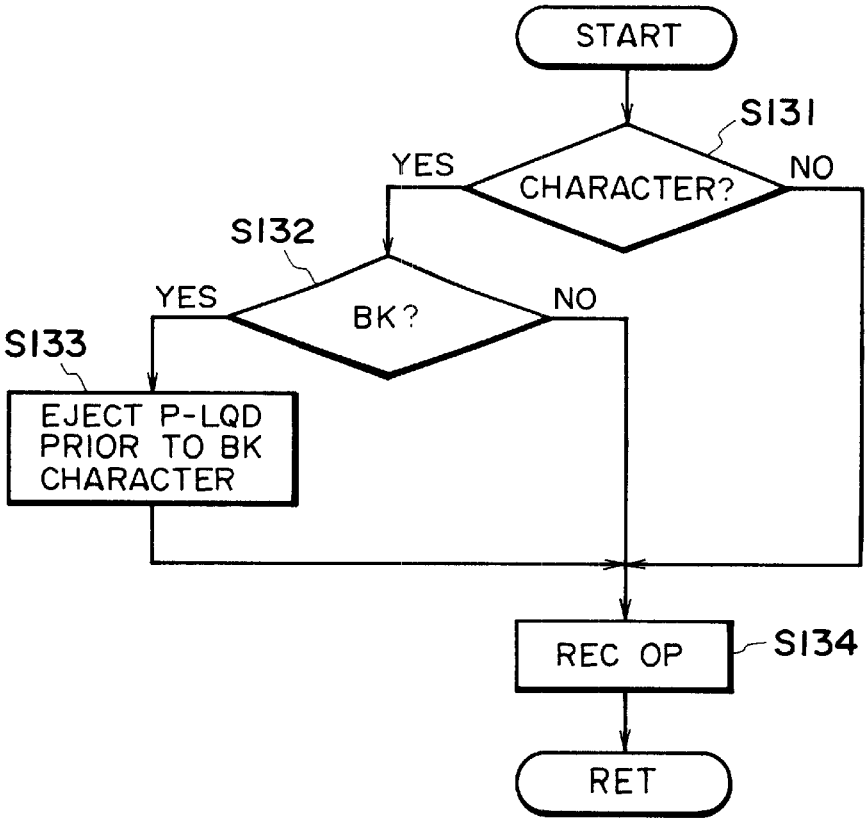
FIG. 43 is a flow chart of an operation for applying the print quality improver liquid to the Bk ink letters only.

FIG. 43 is a flow chart of a single scanning pass printing operation, in which the P liquid is ejected in correspondence with only a letter.

In a step S131, it is determined whether or not the printing data is for a letter. When they are for a letter, that is, when the answer is Yes, a step S132 is performed, and when it is No, a step S134 is performed. As for the means for determining whether or not the printing data is for a letter, it may be a known means.

In the step S132, it is determined whether or not the printing data is for the Bk. When they are for the Bk, that is, when the answer is Yes, a step 133 is performed, and when it is No, a step S134 is performed.

In a step S133, the P liquid is ejected before the Bk letter is printed in response to the Bk letter printing data. At this time, the P head is driven in such a manner that the P liquid lands on the print medium, on the same spot on which a letter is printed. It should be noted here that it is not necessary to eject the P liquid onto all the spots onto which the letter producing ink is ejected; high reliability and high quality can be obtained as long as the P liquid is ejected onto 25%–50% of the spots onto which the letter producing ink is ejected. The processing of thinning out the data for this operation is carried out in real time in a step S133, and then, step S134 follows.

In the step S134, a single-pass printing operation is carried out in the normal primary scanning direction.

Embodiment 15

In Embodiment 12, the P liquid is sparingly applied depending on whether or not printing is done with the Bk. However, the present invention is not limited by this embodiment.

When an inherently water resistant Bk ink replaces the aforementioned Bk ink, it may be used in combination with the Y, M and C inks, which normally do not have the water resistance, while ejecting the P liquid in correspondence with only the Y, M and C inks. This method can waterproof all the colors.

Figure 44:
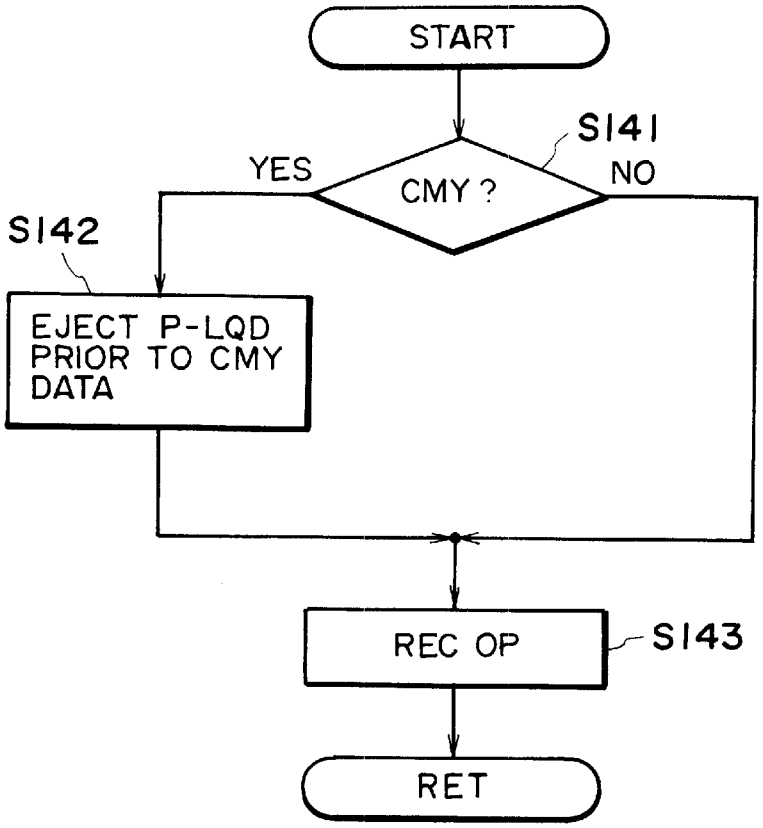
FIG. 44 is a flow chart of an operation for applying the print quality improver liquid to the C, M and Y inks only.
Figure 45:
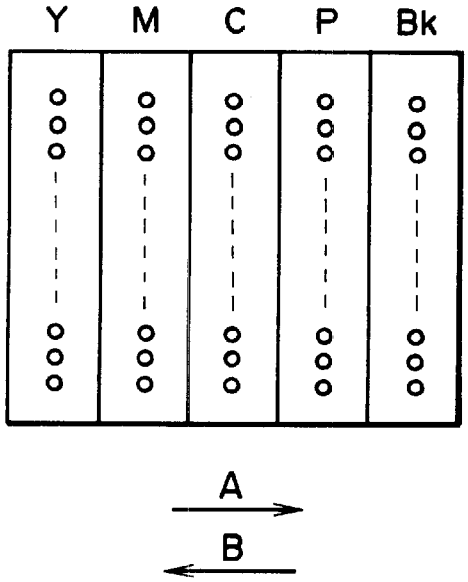
FIG. 45 is a front view of another example of the ink liquid ejecting portion employed in an embodiment of the ink jet printing method in accordance with the present invention.
Figure 46:
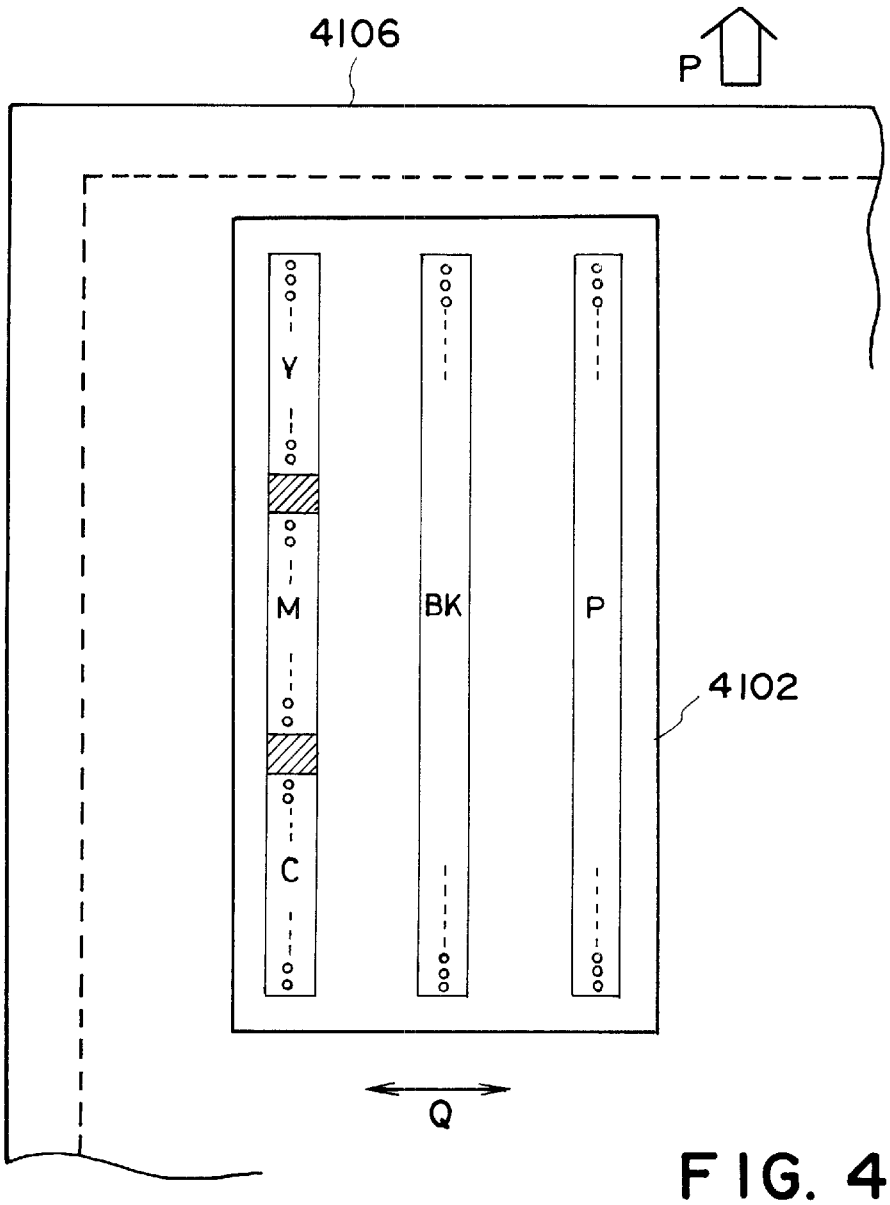
FIG. 46 is a front view of another example of the ink liquid ejecting portion employed in an embodiment of the ink jet printing method in accordance with the present invention.

FIG. 44 is a flow chart of a single pass printing operation, in which the P liquid is ejected in correspondence with only the C, M or Y inks.

In a step S141, it is determined whether or not the printing data is for the C, M or Y ink. When they are for the C, M or Y ink, that is, when the answer is Yes, a step S142 is performed, and when it is No, a step S143 is performed.

In the step S142, the P liquid is ejected before the C, M or Y ink is ejected in response to the corresponding printing data. At this time, the P head is driven in such a manner that the P liquid lands on the print medium, on the same spot onto which the C, M or Y ink is ejected. It should be noted here that it is not necessary to eject the P liquid onto the entire spots onto which the C, M or Y ink is ejected; high reliability and high quality can be obtained as long as the P liquid is ejected onto 25%–50% of the spots onto which the C, M or Y ink is ejected. For example, when the color to be printed is a primary color Bk, Y, M or C, a ratio of 25% may selected, and when it is a secondary color R (red), G (green), or B (blue), another ratio of 50% may be selected. The process for thinning out the data for this operation is carried out in real time in the step S142, and then, a step S143 follows.

In the step S143, a single pass printing operation is carried out in the normal primary scanning direction.

The Bk ink used in this embodiment is an ink produced through the following steps, and the water resistance is effected by this Bk ink. Step 1: production of pigment dispersant

| | |
|---|---|
| Copolymer of styrene, acrylic acid, and ethyl acrylate (acid number: 140; weight average molecular weight: 5000) | 1.5 wt. % |
| Monoethanolamine | 1.0 wt. % |
| Diethyleneglycol | 5.0 wt. % |
| Deionized water | 82.5 wt. % |

The above components are mixed, and heated to 70° C. in a hot water bath to dissolve completely the resin components. Next, carbon black (MCF88, Mitsubishi Chemical) is added to this solution by 10 wt. %, and after 30 minutes of pre-mixing, the solution is subjected to the following dispersing process.

Dispersing apparatus:

Sand Grinder (Igarashi Machinery)

Grinding media:

zirconium beads (1 mm in diameter)

Grinding media filling ratio:

50 % (volumetric ratio)

Grinding time:

three hours

Thereafter, coarse particles are removed through a step of centrifugal separation (12,000 rpm, 20 minutes), yielding the desired dispersion.

Step 2: production of ink

The dispersion obtained through the above steps is mixed with the following components, at a mixing ratio given below, yielding thereby the pigment containing Bk ink.

| | |
|---|---|
| Pigment dispersed solution | 30.0 wt. % |
| Glycerine | 10.0 wt. % |
| Ethyleneglycol | 5.0 wt. % |
| N-methylpyrolidon | 5.0 wt. % |
| Methyl alcohol | 2.0 wt. % |
| Deionized water | 48.0 wt. % |

Embodiment 16

When the color inks are preferably water resistant, the P liquid does not need to be applied to the color ink locations. For example, when the Y ink is water resistant, it is unnecessary to apply the P liquid to the Y ink location. Further, the P liquid may be sparingly applied depending on the ink properties.

When the Bk and Y inks are water resistant; the M ink is fairly water resistant, though not completely: the C ink is an ordinary ink with no water resistance; and the print needs to be completely waterproofed in terms of all the colors, then, it is unnecessary to apply the P liquid to the Bk and Y ink locations, but it is necessary to apply the P liquid to the C and M ink locations, although the amount for the M ink location is smaller than the amount for the C ink location. In this manner, the print can be waterproofed for all the colors while using a minimum amount of the P liquid. The "smaller amount" relates to a smaller print duty or a smaller amount of the liquid to be ejected.

As described above, when the P liquid ejection is minimized in response to the properties of the ink to be used, it is possible to produce a "highly reliable" print of "high quality."

As for the structure of the liquid ejecting portion, it is not limited to the one illustrated in FIG. 39. For example, the one illustrated in FIG. 45 may be employed, in which the P head is disposed between the Bk head and the rest of the heads. Further, it may be a liquid ejecting portion having the structure illustrated in FIG. 46, in which the liquid ejecting portion comprises three chips: a P liquid chip, a Bk chip, and an integral Y-M-C chip.

As for the effects of the P liquid, there are others besides the water resistance improvement. They are light resistance improvement, feathering prevention, color bleeding prevention, color development improvement, print density improvement, and the like. Therefore, the P liquid may be selectively used to take advantage of these effects.

For example, when a Y ink to be used is excellent in water resistance, but falls short in feathering resistance, the feathering related characteristic of the print can be improved by means of selecting a printing method in which the P liquid is applied to the area onto which the Y ink is ejected.

When the P liquid is selectively used, as described above, depending on the objective of the print, it is possible to produce a highly reliable print of high quality.

Further, when the printing apparatus is provided with such a structure that a user can select whether or not the P liquid is to be applied, depending on the user's objective, a most preferable print can be produced as the user wishes. In this case, the user's selection may be indirectly inputted as the data of the host computer which transfers the data to the ink jet printing apparatus, or may be directly inputted through the sensor/SW portion thereof.

Embodiment 17

In the preceding Embodiments 9–16, only one kind of P liquid was used. In this embodiment, however, two or more P liquids of different type are used, which characterizes this embodiment.

Figure 47:
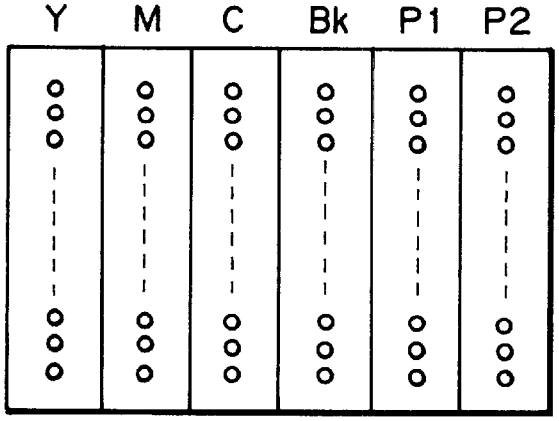
FIG. 47 is a front view of an example of the ink liquid ejecting portion, which is employed in an embodiment of the ink jet printing method in accordance with the present invention, and is capable of ejecting two types of print quality improver liquid.

FIG. 47 is a simplified front view of a liquid ejecting portion capable of ejecting two or more print quality improver liquids of different type, which is used in conjunction with the ink jet printing method in accordance with the present invention. As shown in FIG. 47, the liquid ejecting portion of this embodiment is provided with P liquid ejecting subhead units P1 and P2. In this embodiment, when the temperature is high, the P1 liquid is ejected using the liquid ejecting outlet P1, and otherwise, the P2 liquid is ejected using the subhead unit P2.

(P1 liquid)

| | |
|---|---|
| Polyallylamine hydrochloride | 1.0 wt. % |
| Tributylamine chloride | 1.0 wt. % |
| Thioglycol | 10.0 wt. % |
| Acetylenol EH | 0.3 wt. % |
| Water | 87.7 wt. % |

(P2 liquid)

| | |
|---|---|
| Polyallylamine hydrochloride | 1.0 wt. % |
| Tributylamine chloride | 1.0 wt. % |
| Thioglycol | 10.0 wt. % |
| Acetylenol EH | 0.7 wt. % |
| Water | 87.3 wt. % |

When the temperature and/or humidity is detected, and the detected results are used to switch between the differently composed P1 and P2 liquids, or to eject both liquids while controlling the amount of the P1 or P2 liquid to be ejected, preferable effects can be produced.

Embodiment 18

In the preceding Embodiments 9–16, the P liquid control executed in a situation, in which all the sheets of print medium were of the same type, was described. In this embodiment, the amount of the P liquid to be ejected is optimally adjusted according to the type of the print medium, that is, according to whether the print medium is plain paper, transparency for the OHP, or something else, so that the most reliable image of the highest quality can be produced in terms of the print medium.

More specifically, whether the print medium is plain paper, transparency for the OHP, or something else is automatically determined using a known means, for example, a combination of mechanical and optical sensors, or the like. When the print medium is the latter, the amount of the P liquid to be ejected per unit area of the print medium is reduced in comparison with when it is the former. This is because the printing surface of the transparency for the ink jet printing is generally provided with an ink receptive layer, which allows less ink to permeate into the print medium than using plain paper, and therefore, the P liquid and color ink more stably mix or react with each other than when the plain paper is used.

Further, different types of P liquid may be used depending on whether the print medium is plain paper or transparency for the OHP. More specifically, the P1 and P1 liquids used in Embodiment 17 are used as the print quality improver liquid for the transparency sheet, and plain paper, respectively.

Further, when more than two types of print medium are used, a corresponding number of different P liquids may be selectively used. In this case, however, when the number of the available different P liquids is less than the number of the different print mediums, the effects may be optimized by means of controlling the amount of the pertaining P liquid to be ejected.

When the amount and/or type of the P liquid is optimally selected according to the type of print medium, as described above, the most reliable image of the highest quality can be produced in terms of the print medium.

In addition, when the amount and/or the type of the P liquid to be used is optimally selected according to the type of print medium and environmental factors, such as the internal temperature or humidity of the printing apparatus, ideal results can be expected.

Figure 48:
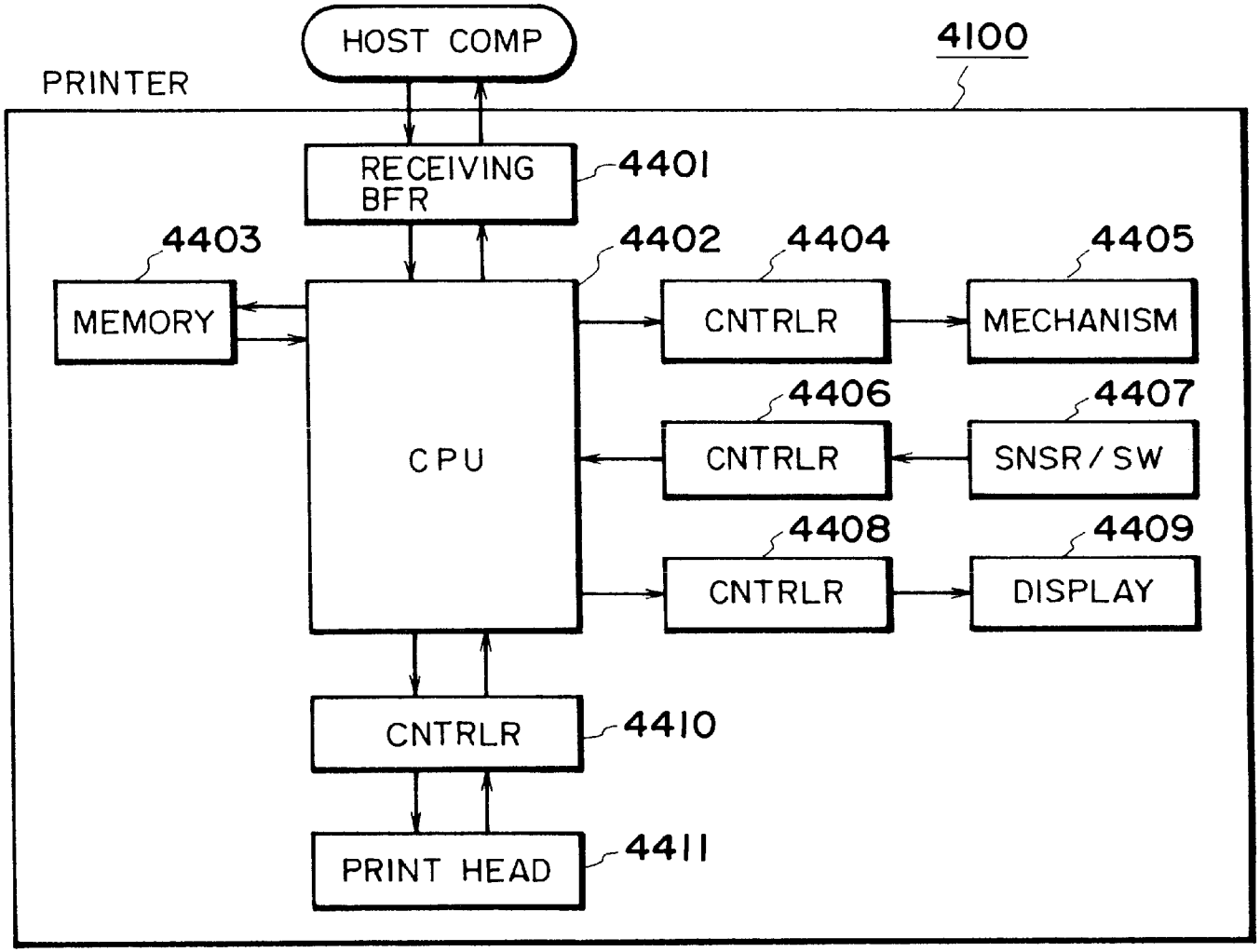
FIG. 48 is a block diagram of an ink jet printing apparatus to which the present invention is applicable.

FIG. 48 is a block diagram of an ink jet printing apparatus in which the printing methods described in the preceding embodiments can be practiced. The data for the letters and picture images to be printed (hereinafter, image data) are inputted from a host computer to the receiving buffer 4401 of the printing apparatus, whereas the data for confirming whether or not the image data are correctly transferred and the data for notifying the operational state of the printing apparatus are sent from the printing apparatus to the host computer. The data in the receiving buffer 4401 are transferred, under the control of a CPU 4402, to a memory portion 4403, where they are temporarily stored in a RAM (random access memory). A mechanism controlling section 4404 drives mechanism 4402, such as a carriage motor, a line feeder motor, or the like, in response to the commands from the CPU 4402. A sensor/SW controlling section 4406 sends to the CPU 4402 the signals generated in the sensor/SW section comprising various sensors and SWs (switches). A display element controlling section 4408 controls a display element section 4411 comprising LEDs, liquid crystal display elements, and the like in a group of display panels, in response to the commands from the CPU 4402. A liquid ejecting section controlling section 4410 controls the liquid ejecting section 4411 in response to the commands from the CPU 4402. It also collects the temperature data and the like, which reflects the condition of the liquid ejecting section 4411, and sends them to the CPU 4402.

The P liquid in accordance with the present invention includes colorless liquid capable of insolubilizing the ink dye, as well as liquid capable of aggregating the ink pigment by means of disturbing the pigment dispersion equilibrium. Here, insolubilization means such a phenomenon that the anionic radicals contained in the dye in the ink and the cationic radicals of the cationic components contained in the print quality improver liquid react with each other, being ionically combined, and as a result, the dye having been uniformly dissolved in the ink separates from the ink solution. It should be noted here that according to the present invention, such effects as color bleeding prevention, improvement in color development, improvement in letter quality, or improvement in fixability of the ink can be realized even when not all the dye in the ink is insolubilized. Further, in the description of the present invention, a terminology, "aggregation," is used as a word having the same meaning as "insolubilization". When the coloring material used in the ink is pigment, the term insolubilization also refers to a phenomenon that the pigment dispersant or pigment surface, and the cationic radicals of the cationic substance contained in the print quality improver liquid, ionically react with each other, disturbing the dispersive equilibrium, and as a result, the diameter of the pigment particle increases. Normally, the ink viscosity increases as the aggregation progresses. It should be noted here that according to the present invention, even when not all of the pigment or pigment dispersant in the ink is insolubilized, the effects such as the color bleeding prevention and improvements in color development, letter quality, and fixability of the ink, which have been described in this specification can be realized.

As is evident from the above description, according to the present invention, the reliability of the print product, such as the water resistance or the like, can be improved by means of causing the print quality improver liquid and color ink to mix and react with each other on the print medium. Also, the same means can improve the color development, and prevent feathering, color bleeding, and the like; therefore, the print quality can be improved. Further, according to the present invention, a reliable print of high quality can be stably produced under all the environmental conditions, except for extreme cases, in terms of the normal usage of the printing apparatus.

Further, the print medium is optimally treated according to the print medium type, that is, according to whether it is a transparency sheet for the OHP, or something else; therefore, a print with the highest degree of reliability and quality can be obtained in terms of the print medium.

Further, the P liquid is selectively used depending on the objective of the print product to be obtained; therefore, a highly reliable print of high quality can be obtained with a minimum consumption of the print quality improver liquid. In addition, the minimum consumption of the print quality improver liquid reduces the running cost, and minimizes the cockling of the print medium, improving further the print quality.

Hereinafter, Embodiment19, which is in the fourth form of the present invention, will be described with reference to FIGS. 49–55.

The following descriptions include cases in which the liquid ejecting portion is a part of a single printing head unit, and in which it constitutes a separate subhead unit, being independent from the rest.

Embodiment 19

Figure 49:
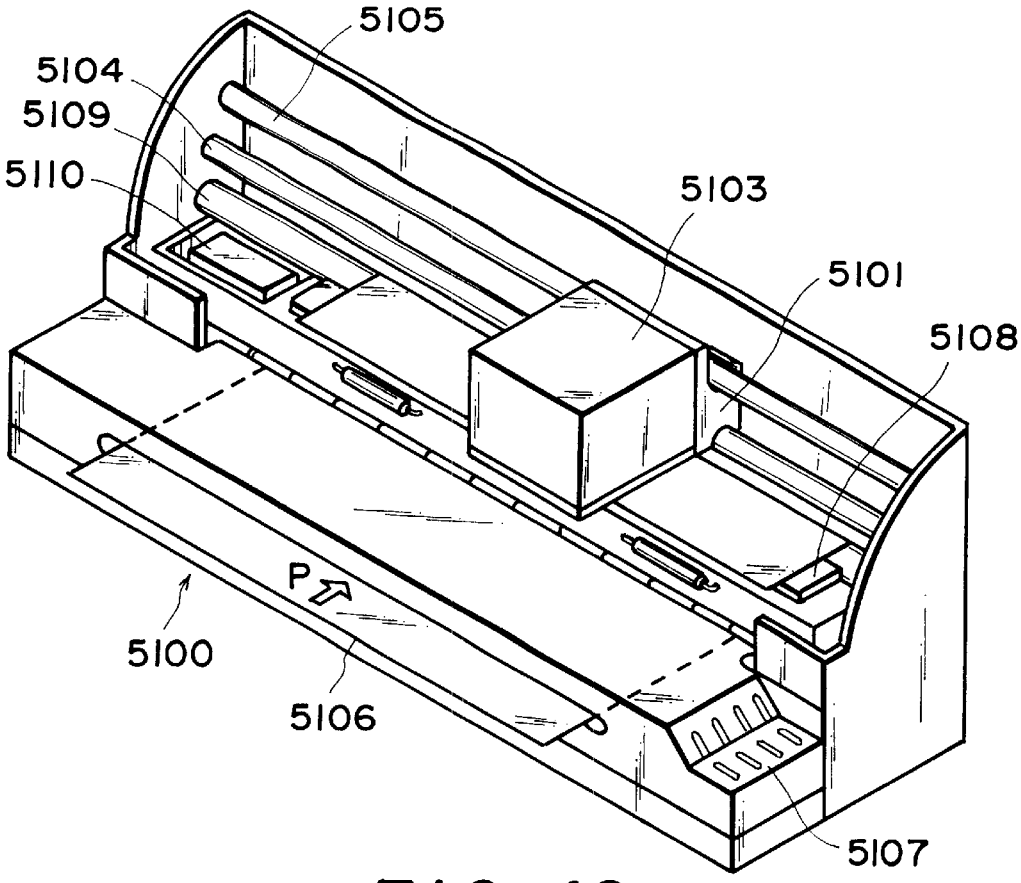
FIG. 49 is a perspective view of a recording apparatus to which the present invention is applicable.

FIG. 49 is a perspective view of an ink jet recording apparatus to which the present invention is applicable. After being inserted into the feeding point of a recording apparatus 5100, a recording medium 5106 is advanced by a feeding roller 5109, in the direction of an arrow mark P, to an area in which a recording head unit 5103 can record images on the recording medium 5106. There is a platen 5108 under the recording medium in the recording area. The carriage 5101 is supported on two guide shafts 5104 and 5105, being allowed to move in a predetermined direction, and shuttles across the recording area, scanning the recording medium. Mounted on the carriage 5101 are a recording head for ejecting a plurality of color inks and processing liquids (print quality improver liquid), and a recording head unit 5103 containing the ink containers which supply the ink or processing liquid to the recording head. The number of the inks used in this ink jet recording apparatus is four, and their colors are Bk (black), C (cyan), M (magenta), and Y (yellow).

There is a recovery system unit 5110 next to, and below, the left edge of the moving area of the carriage 5101. It performs the recovery operation when the ejection of the ink and recording quality improver liquid (processing liquid S) becomes erratic, and caps the liquid ejecting outlet portion of the recording head during a non-recording period. This left end position is called the home position of the recording head.

A reference numeral 5107 designates both of a switch portion and a display element portion. The switch portion is used to turn on or off the power supply of the recording apparatus, and also, to set various recording modes. The display element portion plays a role of displaying the operational state of the recording apparatus.

Figure 50:
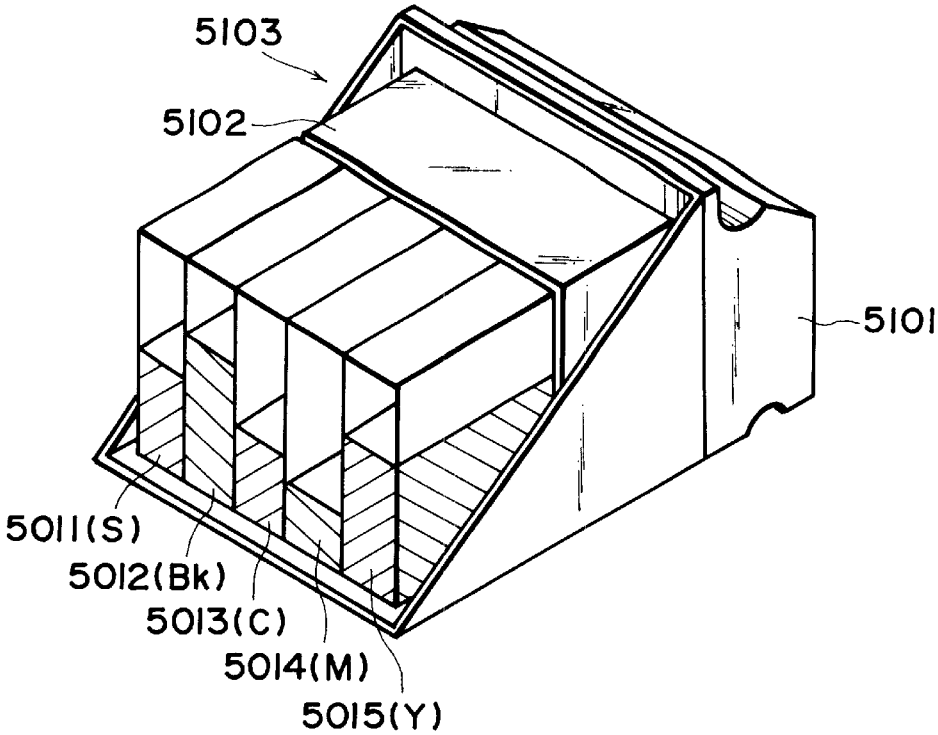
FIG. 50 is a perspective view of a recording head unit.

FIG. 50 is a perspective view of a recording head unit 5103. In this embodiment, the Bk, C, M and Y ink containers for supplying the recording head 5102 with the inks, and the recording quality improver liquid S container, are all replaceable, independently from each other.

On the carriage 5101, the recording head 5102 which ejects Bk, C, M and Y inks and S liquid, a Bk ink container 5012, a C ink container 5013, an M ink container 5014, a Y ink container 5015, and an S liquid container 5011, are mounted. Each container is connected to the recording head by way of a connecting portion, and supplies the recording head with the ink or processing liquid. The ink containers are composed of transparent material so that the levels of the liquid remaining therein can be seen.

Further, the recording quality improver liquid container and Bk ink container may be integrated into a single unit, and the C, M and Y ink containers may be integrated into a single unit. Also, all the containers may be integrated into a single unit.

Figure 51:
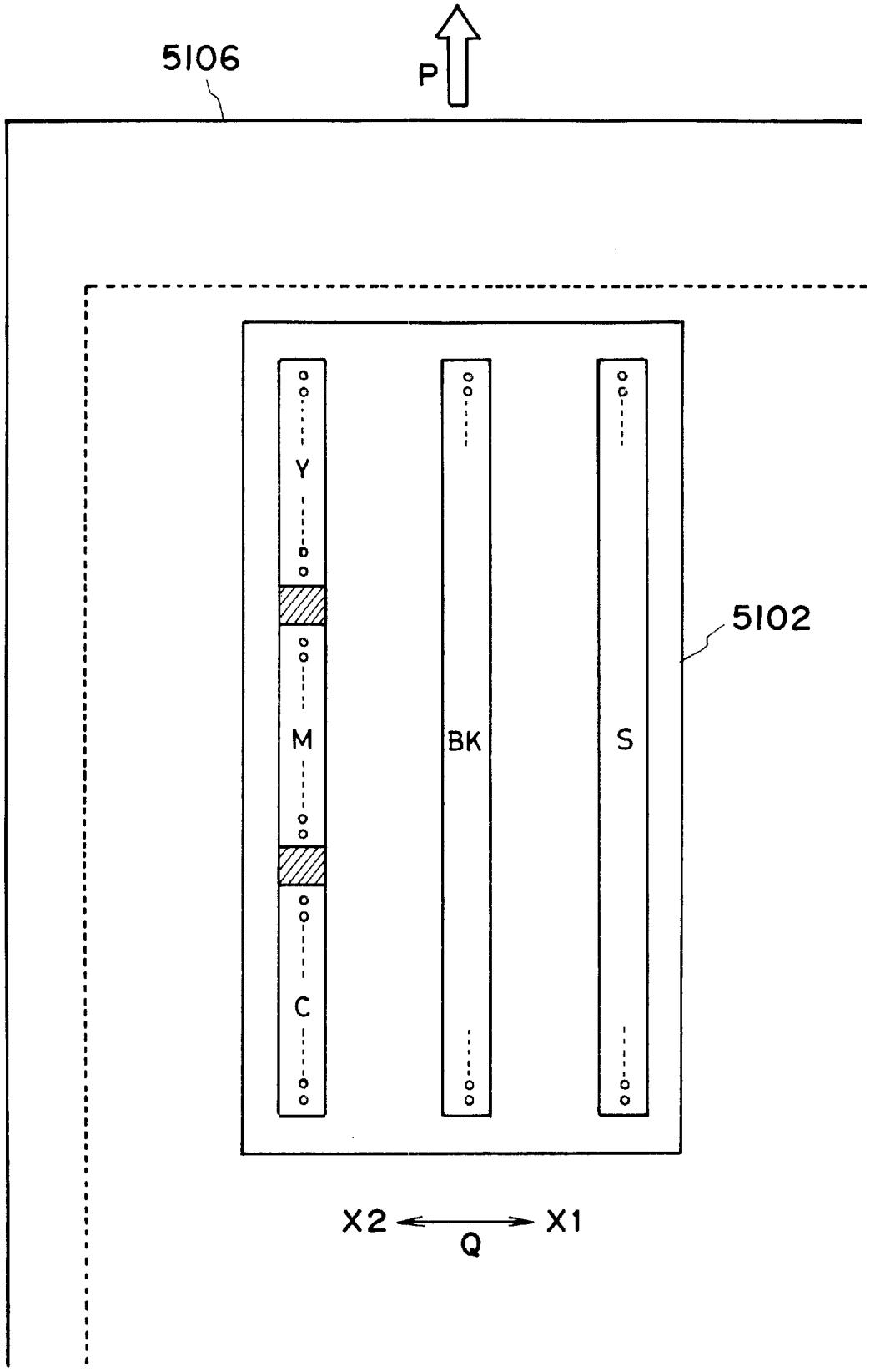
FIG. 51 is an explanatory drawing of the recording head structure.

FIG. 51 is a schematic drawing to show the arrangement of the liquid ejecting outlets of the recording head 5102, as seen from above, through the recording medium 5106. The recording head 5102 moves in the direction of an arrow mark Q, relative to the recording medium 5106; the recording medium 5106 moves in the direction of an arrow mark P, relative to the recording head. The numbers of the liquid ejecting outlets of the S head and Bk head are 128 for both. The number of the ink ejecting outlets of the Y, M or C portion of the integrated Y-M-C head, is 48 for each portion. The lengths of the separating zones between Y and M, and between M and C, are equivalent to eight ejection outlets.

The pitch of the ejection outlet is approximately 70 $\mu$Am for the S, Bk, and C-M-Y portions. The distance between the S and Bk portions, or between the Bk and Y-M-C portions, is equivalent to 180 ejection outlets. The liquid ejecting outlets of each of the liquid ejecting subhead portions are arranged in a single straight line substantially perpendicular to the primary scanning direction. The bottom ends of the S, Bk, and Y-M-C subhead portions are aligned in the primary scanning direction of the recording head 5102.

A block diagram of the essential structure of the printer in this embodiment is the same as the one given in FIG. 48.

Figure 52:
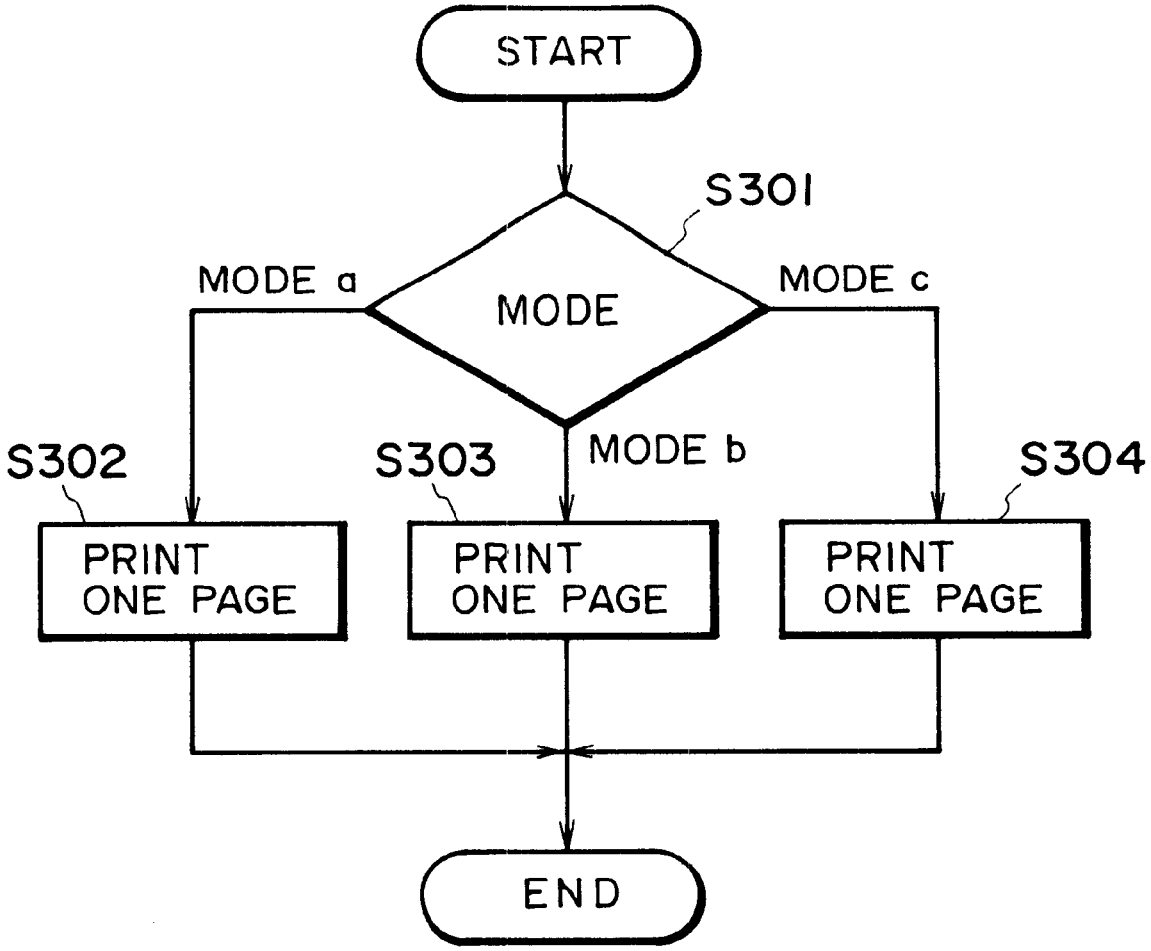
FIG. 52 is a flow chart of a recording operation in accordance with the present invention.

FIG. 52 is a flow chart for the recording operation in this embodiment.

A step S301 is a recording mode determining step, where a recording mode is set using recording mode determining means. In this embodiment, one of three recording modes a, b and c is selected. As for the method for setting the mode, there are two. One is to set it automatically according to the data sent from the host computer, and the other is to input using the SW portion of the recording apparatus. In this embodiment, the former was employed, but either method is acceptable.

A step S302 is a step to be performed when the recording mode a is selected, and in this step, a recording operation equivalent to a single page is carried out. This recording mode a is a mode in which the recording quality improver liquid S is ejected in correspondence with the entire image to be recorded, wherein the S liquid and the inks are caused to mix and react to each other on the recording medium, improving the water resistance and color development of the recorded image, minimizing the color bleeding, and improving the fixability of the ink to the recording medium. In other words, this mode a is such a recording mode that consumes a maximum amount of the recording quality improver liquid S and maximizes its effects.

In comparison to the recording mode c, the recording mode a increases the amount of the Y, M, C, or Bk ink ejected per unit area of the recording medium. More specifically, the wave-form of the head driving power is controlled so as to increase the ink droplet size to approximately 1.05 times the ink droplet size in the recording mode c. This controlling method is a known method of modulating the pulse width, but the ink droplet size may be increased by means of increasing the head temperature. In other words, it does not matter what means is used. As for the ratio of the increase, it is designed so that an optimum value is selected according to the ink, recording quality improver liquid, recording medium, and the like. This means is provided in the recording head controlling section.

When this process is not carried out, deterioration of the recorded image occurs in the area where the recording quality improver liquid S and ink mix and react with each other. For example, the image looks grainy, and the color of the recording medium (normally, white) becomes obtrusive.

The reason why the amount of the ink to be ejected per unit area is increased is because the increase slightly reduces the ink dot diameter as the recording quality improver liquid S and ink mix and react with each other on the recording medium.

This process can be further improved when it is modified so that only the volume of the ink droplet that is ejected onto exactly the same spot as the recording image improver liquid S is increased, whereas the volume of the ink droplet that is not ejected onto the same spot as the recording quality improver liquid is not increased.

This process is also effective in the second recording mode b because of the same reason.

A step S303 is a step to be performed when the recording mode b is selected, in which a recording operation equivalent to a single page is carried out.

This is a recording mode in which the recording quality improver liquid S is ejected onto the borders among the different colors of the recorded image, in particular, the borders between the black and the other colors Y, M and C. In other words, it is a recording mode for obtaining a picture image in which the color bleeding is prevented, in particular, the color bleeding between the black color and the other colors Y, M and C. This process has its own merits in the minimization of the recording quality improver liquid S to be ejected onto the recording medium. The borders between the Bk and the others Y, M and C are detected using a known means.

In this embodiment, the process in which the recording quality improver liquid S is ejected onto the borders between the Bk and others Y, M or C was employed, but another process in which it is ejected onto all the borders between each of Bk, Y, M, and C may be employed.

A step S304 is a step to be performed when the recording mode c is selected, in which a recording operation equivalent to a single page is carried out. This is a recording mode in which the recording quality improver liquid S is not ejected, that is, a mode in which recording is made in the same manner as the conventional one. This mode also has its own merits in that since the recording quality improver liquid S is not used so as to realize recording quality of only the conventional level, the running cost does not increase.

As described above, the recording mode is selected for each page as needed.

In the recording mode b, the recording quality improver liquid S is ejected from the nozzles allocated so as to move ahead of the nozzles allocated for ejecting the Bk ink during each of the forward and backward scanning movements; therefore, bidirectional recording is possible.

According to this recording structure, the liquid ejecting portions are arranged in the order of S, Bk, and Y-M-C, relative to the primary scanning direction X1. During a normal recording operation, the borders between the Bk and the others Y, M and C are detected on the recording area, and the S is ejected ahead of the Bk. Immediately, the Bk and S react with each other, and as a result, the state of the Bk changes so that it is difficult for the Bk to bleed into the Y, M or C from the borders between the Bk and the others Y, M or C. Thereafter, Y, M and C are ejected. Therefore, the color bleeding between the Bk and other Y, M or C is unlikely to occur.

On the contrary the order in the X2 direction is Y-M-C, Bk, and S. In this direction X2, the Y, M and C are first ejected, being followed by the Bk, and lastly, the S is ejected. Since the S is ejected after the Y, M, C and Bk bleed on the recording medium, this structure is not effective to prevent the bleeding, when scanning in the X2 direction. As a countermeasure, it is conceivable to use a unidirectional recording in the X1 direction, but such a recording method reduces the recording speed.

Therefore, in this mode b, in order to prevent the bleeding using the single pass bidirectional printing method, the use is made with the nozzles so as to allow the recording quality improver liquid S to be ejected ahead of the Bk in the recording area, in either direction.

Figure 53:
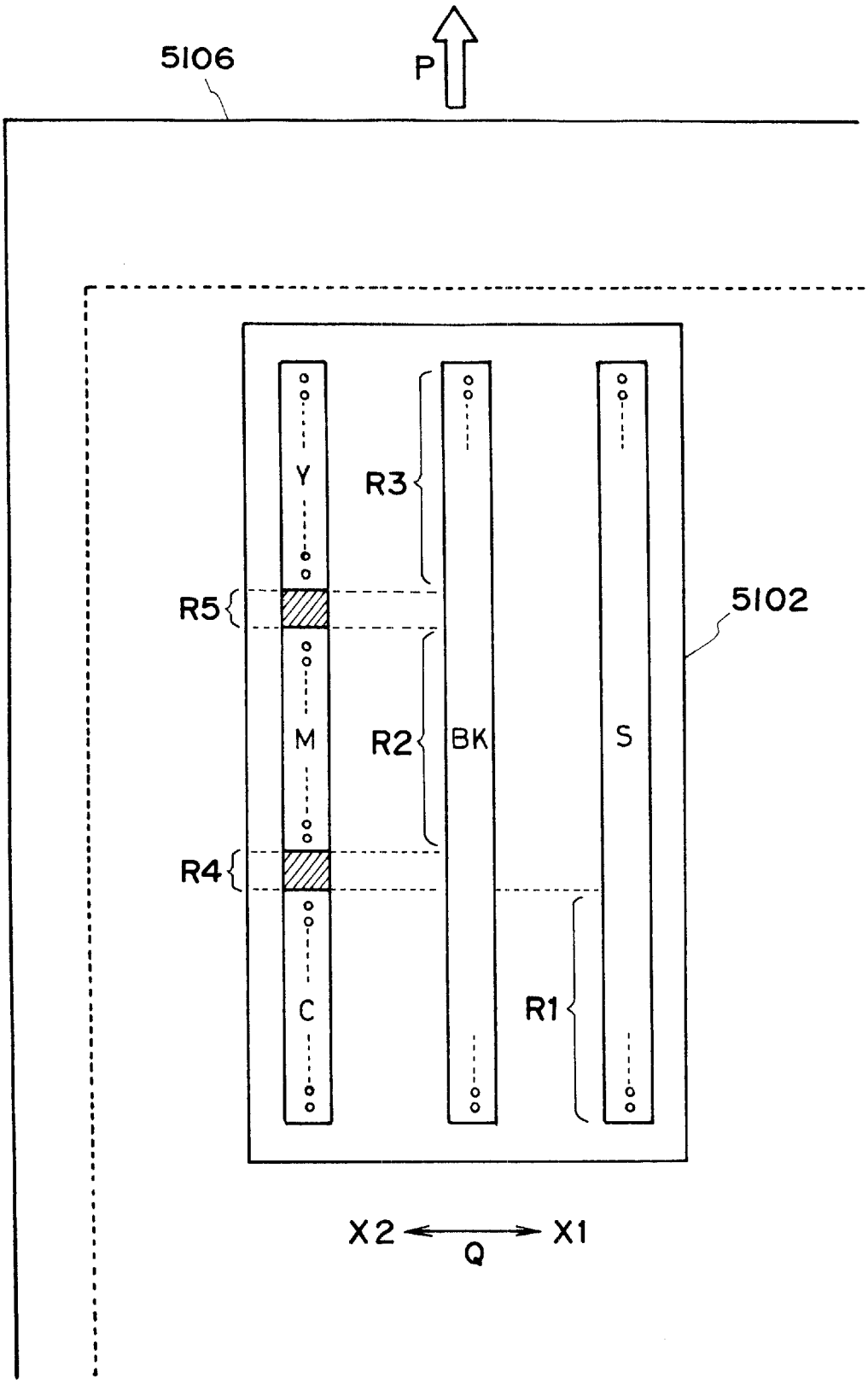
FIG. 53 is an explanatory drawing of the various subheads in the heads to be used in the mode b.

FIG. 53 illustrates the outlet allocation for each ink and S liquid employed in the recording mode b. In the Y-M-C portion, all the outlets are activated. In the S liquid portion, 48 outlets in the R1 section, which correspond to the C portion in the primary scanning direction, are activated, and in the Bk portion, 48 outlets in the R2 section, which correspond to the M portion in the primary scanning direction, are activated.

In the X1 direction, recording is made in the order of S, C, Bk, M and Y; in the X2 direction in the order of C, S, M, Bk and Y. In the case of the bidirectional recording, the recording is made in the order of S, C, M, Bk and Y. More specifically, there are R4 and R5 sections with no outlets; therefore, the order remains as such that the Bk is ejected after S and C are ejected. In other words, it is assured that the Bk is ejected after the S is ejected. Therefore, bleeding of the Bk into the other colors is minimized due to the effects of the S liquid, while allowing the single pass high speed bidirectional printing.

As for the compositions of the inks and processing liquid used in this embodiment, they are the same as those used in Embodiment 12.

Figure 54:
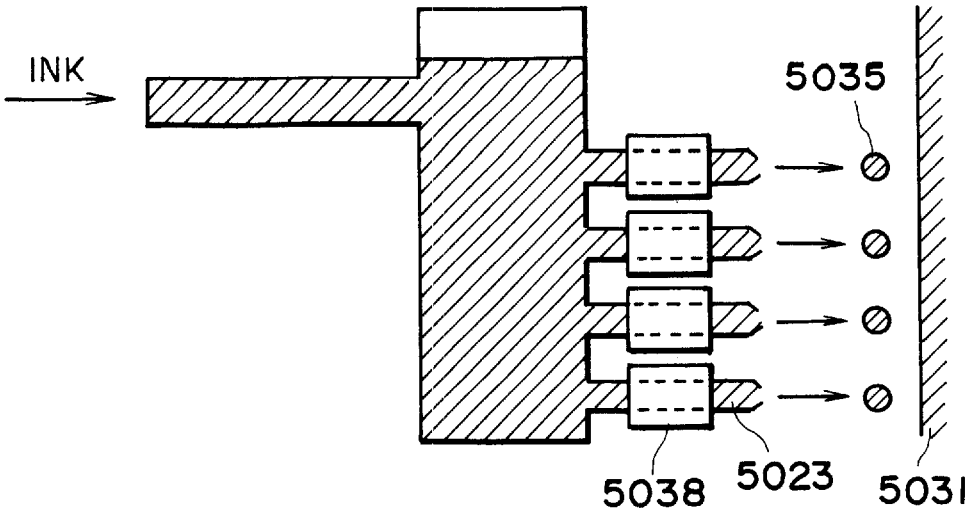
FIG. 54 is an enlarged sectional view of a different recording head.

FIG. 54 illustrates an example of a liquid ejecting portion employing electromechanical transducer elements, wherein a reference numeral 5038 designates a piezo-electric element, which is the electro-mechanical transducer element.

The other portions of the structure are not essential to the following description.

In the preceding embodiments, the recording mode was switched page by page, but the present invention is not limited by those embodiments.

For example, when switching is made among the recording modes a, b and c within the same page, the following effects can be realized, provided that the recording modes a, b and c are the same as those of the preceding embodiment.

As for the print to be made, let it be that the major portion (part 1) of the print is occupied with black letters; a small portion (part 2) is occupied with a picture image, that is, a landscape in color; and another small portion (part 3) is filled with a color graph.

In this case, preferable effects can be obtained by means of printing part 1 in the recording mode c; part 2, in the recording mode a; and part 3, in the recording mode b.

Since part 1 is occupied with only the black letters, there is no contact between the Bk and others Y, M and C on the recording medium, eliminating thereby the bleeding between the Bk and others Y, M and C. Therefore, the S is not used; the S is saved.

The image which is going to occupy part 2 is a landscape. Therefore, the S is applied to all the locations onto which the inks are ejected, in order to maximize the color development.

Part 3 is going to be occupied with a graph, in which each of the colored portions is desired to be clearly edged. Therefore, the S is applied to only the edge portions among the colors, so that the color bleeding can be minimized while saving the S by not applying it to the entire recording area.

As described above, when the S is applied in response to the automatic determination of the recording mode having been set so as to match individual recording areas, the consumption of the S can be minimized while maximizing its effects in order to print a preferable image.

Figure 55:
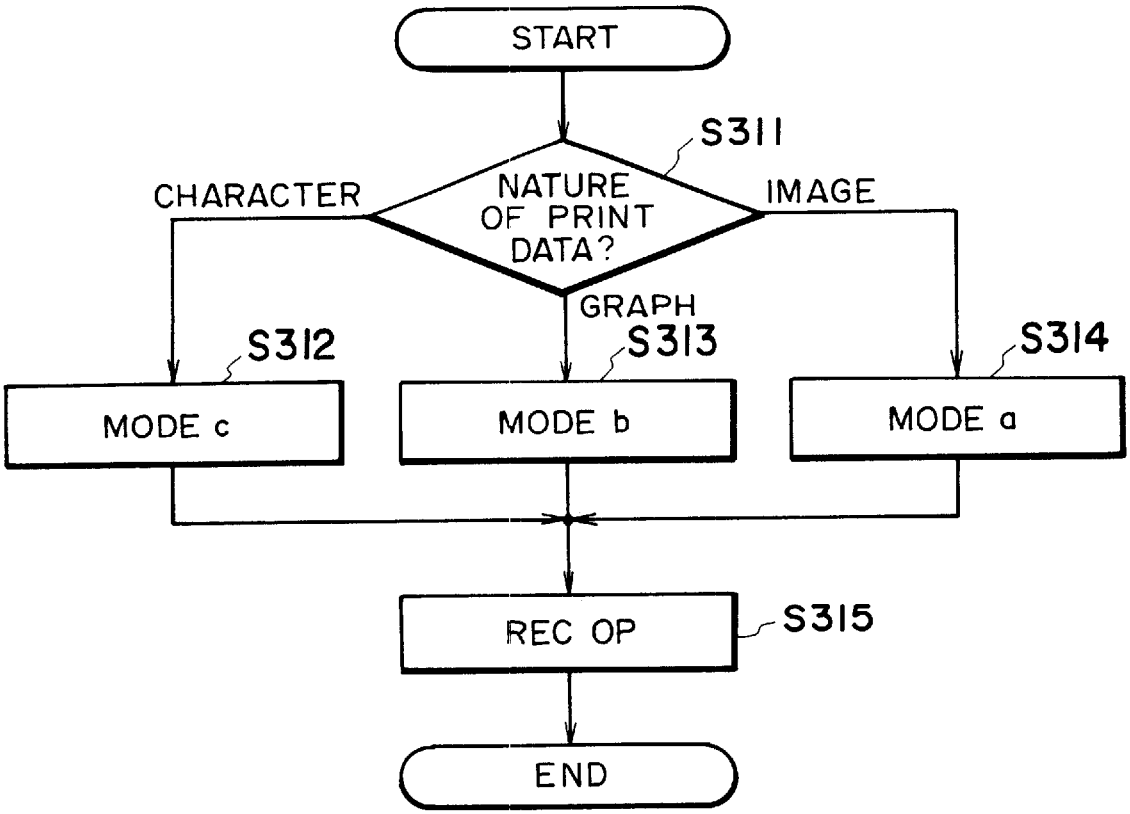
FIG. 55 is a flow chart of another recording operation in accordance with the present invention.

FIG. 55 is a flow chart for recording a single page, in which the different recording modes are automatically determined within the same page.

A step S311 is a step in which the characteristic of the image to be recorded is determined, at the level of picture element. In this case, it is determined whether the image to be printed is a text, a graph or a picture image. It is determined using a known means, and a certain degree of determination error must be tolerated depending on the selected means. In the case of text, a step S312 is performed; in the case of a graph, a step S313; and in the case of a picture image, a step S314 is performed.

The step S312 is a step to be performed in the case of text, in which a process equivalent to the mode c is carried out. Namely, the normal printing operation, in which the S is not used, is carried out.

The step S313 is a step for a graph, in which a process equivalent to the mode b is carried out. Namely, data for ejecting the S to only the border portions among the Y, M, C and Bk colors are produced.

The step S314 is a step to be performed when the image is going to be a graph, in which a process equivalent to the mode a is carried out. Namely, the S data for applying the S over the entire recording area are produced.

A step S315 is a step in which an actual recording operation is carried out, ejecting sequentially the Y, M, C, Bk and S in correspondence with the recording data.

In this embodiment, it was determined whether the image to be recorded was a letter, a graph, or a picture image, but the image characteristics may be optimally classified into an optional number of categories as needed. For example, the recording mode c may be used for only a letter while using the recording mode a for a graph or picture image.

The following means was not described in detail in the preceding embodiments of the present invention, but may be considered as a modification of the present invention. Namely, when the recording quality improver liquid is of a special type that does not cause the pigment aggregation, or does not insolubilize the dye in the inks of a predetermined type, but does so in the inks of different type, it may be mixed in the inks of the aforementioned predetermined type. Needless to say, this recording quality improver liquid is ejected and coated together with the ink. The only requirement for the recording quality improver liquid of this type is to contain components capable of improving at least the recording quality, and needless to say, it may contain, in addition to such mandatory components, different components capable of improving the other properties.

In the case of the structures in accordance with the present invention, the ink is introduced into an ink container through an ink introduction path established by means of connecting an ink supplying pipe or the like to the ink container. As for the location of the connection, the ink supplying pipe or the like may be connected to the ink supplying port through which the ink is supplied to an ink jet recording head; an air vent; or a hole drilled adjacent to the wall surface of the ink container.

According to the present invention, the recording quality improver liquid is stored in a part of the container portion; therefore, when an apparatus user replaces an ink depleted ink container due to the depletion of a coloring material containing ink, the recording quality improver liquid may be replenished at the same time. Therefore, it is preferable that when the ink is injected into an ink container as described above, the recording quality improver liquid is also injected at the same time. It is needless to say that the recording quality improver liquid can be injected using the same means and procedure as the inks.

As has been described above, according to the present invention, it is possible to use selectively two or more of the following recording modes for each page as needed.

Recording mode a: the S and the inks are caused to mix and react with each other to improve the water resistance and color development of a recorded image, to minimize the color bleeding among two or more colors, and also, to improve the fixability of the ink to the recording medium;

Recording mode b: the S is ejected onto the locations which are going to constitute the borders among the colored areas of the recorded image, in particular, the borders between the Bk and others Y, M and C, to prevent color bleeding while saving the S; and Recording mode c: S is not ejected; printing is made in the conventional manner.

Further, it is possible to increase the volume of the ink droplet to be ejected onto the same location onto which the S is ejected to mix with the ink; therefore, recording can be made with no change in dot diameter no matter which recording mode is used, a, b, or c.

The present invention brings forth preferable results when used in conjunction with the ink jet printing system, in particular, when used with such an ink jet printing head, or a printing apparatus, that comprises a means (for example, an electrothermal transducer, a laser, or the like) for generating thermal energy to be used for changing the phase of the ink so as to eject the ink. This is because such a system can produce a highly precise image of high density.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals.

By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing a pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head or plural recording heads combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

Regarding the variation of the recording head, it may be a single head corresponding to a single color ink, or may be plural heads corresponding to the plurality of ink materials having different recording colors or densities. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within a temperature not lower than 30° C. and not higher than 70° C. to stabilize the viscosity of the ink and to provide stabilized ejection in a usual recording apparatus of this type, the ink may be such that it is liquid within the temperature range when the recording signal is applied. Further, the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of these cases, upon the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as a computer or the like, as a copying apparatus combined with an image reader or the like, or as a facsimile machine having information sending and receiving functions.

Figure 15:
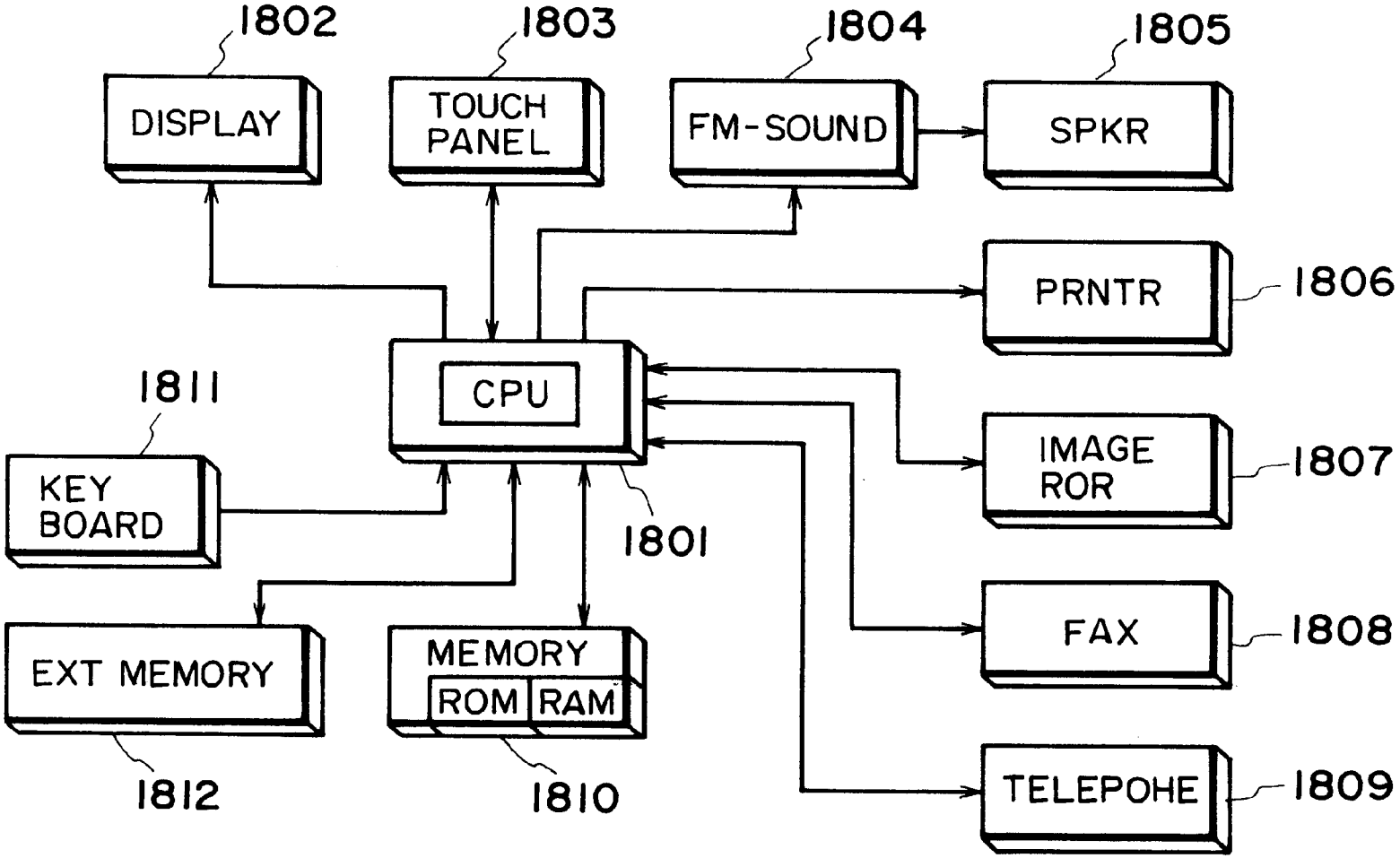

FIG. 15 is a block diagram of the general structure of an information processing apparatus, such as a word processor, a personal computer, a facsimile, or a copying machine, which comprises a printing apparatus in accordance with the present invention.

In the drawing, reference numeral 1801 designates a control section, which comprises a CPU such as a microprocessor and various I/O ports, and controls the entire apparatus, outputting or receiving control signals, data signals and the like to or from various sections of the apparatus. Reference numeral 1802 designates a display section, which displays various menus, text information, image data read in through an image reader, and the like on its display screen. Reference numeral 1803 designates a transparent, pressure sensitive touch panel located on the display panel section 1802, the surface of which can be touched with a finger or the like to select the items displayed in the display section 1802. The touch panel may be of a coordinate based type.

Reference numeral 1804 designates an FM (Frequency Modulation) sound source section, which stores musical data produced by a music editor or the like in a memory section 1810 or an external memory device 1812 and reads them out of the memory or the like, modulating them in frequency. The electrical signal from the FM sound source section is converted into an audible sound through a speaker section 1805. A printer section 1806 is the output terminal of a word processor, a personal computer, a facsimile, or a copying machine, in which a printing apparatus in accordance with the present invention is employed.

Reference numeral 1807 designates an image reader section which photoelectronically reads in the data of an original, and is disposed at a location in an original circulating path. It reads various originals such as a facsimile original or a copy original. Reference numeral 1808 designates a transmission-reception section of a facsimile (FAX), which transmits the original data read in through the image reader section, or receives the arriving facsimile signal and decodes it; in other words, it has a function to interface with external signal sources. Reference numeral 1809 designates a telephone section which has various functions, such as an ordinary telephone function, an answering machine function, and the like.

Reference numeral 1810 designates a memory section, which comprises a ROM and a RAM, and stores system programs, manager programs, various application programs, fonts, dictionaries, text information or application programs loaded from the external memory device 1812, video data, and so on.

Reference numeral 1811 designates a key board section for inputting text data, various commands, and the like.

Reference numeral 1812 designates an external memory device employing a floppy disk or a hard disk, and the like, as recording medium. It stores text data, music or voice data, user's application programs, and the like.

Figure 16:
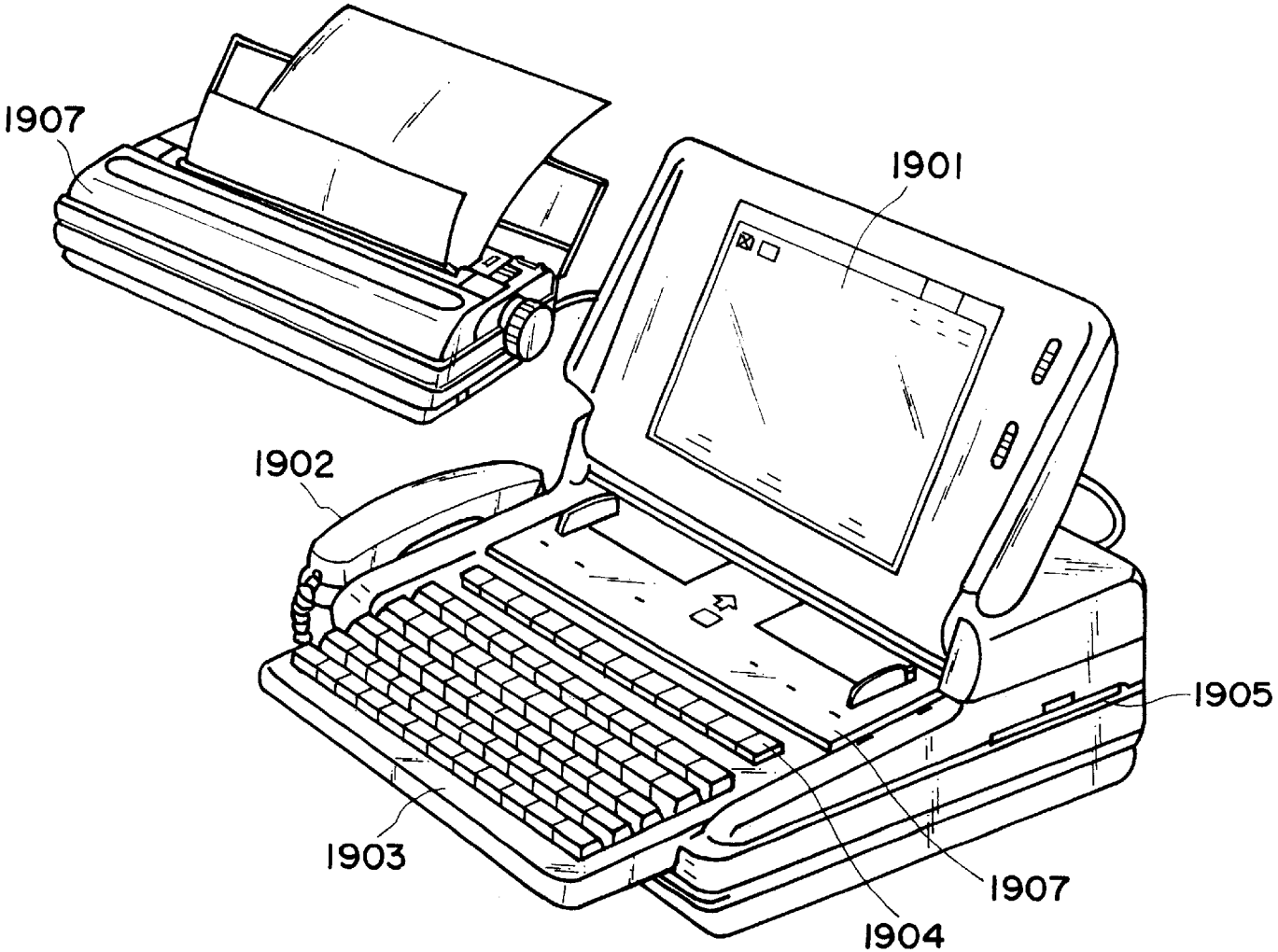
FIG. 16 is a schematic external view of the information processing apparatus illustrated in FIG. 15.

FIG. 16 is a schematic external view of the information processing apparatus depicted in FIG. 15.

In the drawing, reference numeral 1901 designates a flat panel display constituted of liquid crystal or the like. It displays various menus, text data, and the like. The surface of this display 1901 constitutes a touch panel 1803 of pressure sensitive type or coordinate based type, which a user can press or touch, on the location where the wanted selection is. Reference numeral 1902 designates a hand set to be used when the apparatus is used as a telephone. A keyboard 1903 is removably connected to the main assembly of the apparatus, with a cord. It is used to input various text data and others, and is provided with various function keys. A reference numeral 1905 designates an opening through which a floppy disk is inserted into the external memory device 1812.

Reference numeral 1906 designates a sheet mounting table section for mounting an original to be read by the image reader section 1807, and the read original is discharged from the rear of the apparatus. When the facsimile signal or the like is received, the image reflecting the signal is outputted as a print by an ink jet printer 1907.

Although the aforementioned display section 1802 may be constituted of a CRT, a flat panel such as a liquid crystal display constituted of highly dielectric liquid crystal is preferable. This is because the use of the latter makes it possible to reduce the size and weight of the apparatus.

When the aforementioned information processing apparatus is functioning as a personal computer or a word processor, various data inputted through the keyboard section 211 are processed by the control section 1801 and are outputted to the printer section 1806.

When it is functioning as a receiving facsimile, the facsimile data, which are transmitted through a communication line and inputted through the FAX receiving section 1808, are processed by the control section 1801 according to a predetermined program and outputted, as the image data, to the printer section 1806.

When it is functioning as a copying machine, an original is read in by the image reader section 1807, and the data read in from the original are outputted, as the image data, to the printer section 1806 by way of the control section 1801.

When it is functioning as transmitting a facsimile, the data read in from an original by the image reader section 1807 are processed for transmission, by the control section 1801, according to a predetermined program, and then, are transmitted onto a communication line, by way of the FAX transmitter section 1808.

Figure 17:
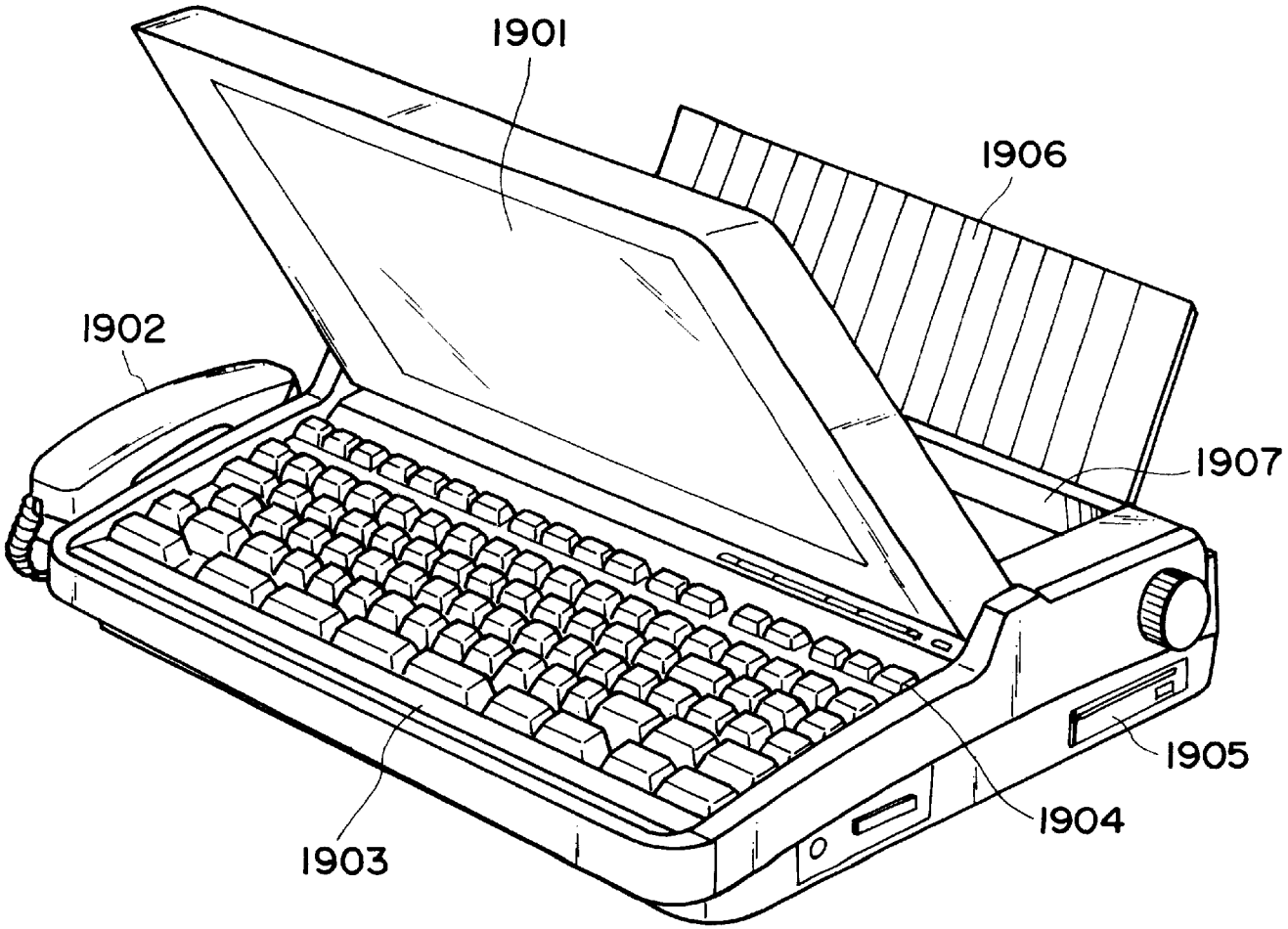
FIG. 17 is a schematic external view of another example of the information processing apparatus comprising the printing apparatus in accordance with the present invention.

The aforementioned information processing apparatus may be of a type comprising integrally an ink jet printer as illustrated in FIG. 17; the integration makes the apparatus more easily portable. In the same drawing, the sections having the same function as those in FIG. 16 are designated with corresponding reference numerals.

When a printing apparatus in accordance with the present invention is employed in the multi-functional information processing apparatus described above, a high quality print image can be produced at a high speed with low noise; namely, the functions of the aforementioned information processing apparatus can be further improved.

While the invention has been described with reference to the structures disclosed herein, it is not confined to the details set forth and this application is intended to cover such modifications or changes as may come within the purposes of the improvements or the scope of the following claims.

What is claimed is:

1. An ink jet printing method comprising the steps of:

ejecting ink on a printing material using an ink ejection portion of an ink jet recording apparatus;

ejecting liquid on the printing material, the liquid, which is for coagulating, or causing to be insoluble, coloring material of the ink, being ejected from a liquid ejecting portion of the ink jet recording apparatus such that the ink and the liquid are mixed or reacted on the printing material, and coagulating or causing to be insoluble the coloring material of the ink with the liquid; and changing an application mode among application modes of the liquid depending on a printing mode in which a printing operation is carried out, wherein each application mode includes one or more of an amount, a property and a manner of application of the liquid, wherein the liquid is ejected in any of the application modes, wherein the printing mode includes one or more of a number of scans on a same recording area, a color printing mode for printing an image using a plurality of color inks and a monochromatic printing mode for printing an image using only one color ink, and wherein said ink ejecting step and said liquid ejecting step are carried out one after the other, in either order.

2. A method as defined in claim 1, further comprising the step of using thermal energy for ejecting the ink and the liquid.

3. A method according to claim 2, wherein the scanning operations for effecting the scans are reciprocal.

4. A method according to claim 3, further comprising the step of arranging said liquid ejecting portion and said ink ejecting portion in a direction of reciprocal movement.

5. A method according to claim 4 further comprising the step of using a recording head which as an array of ejection outlets in a direction substantially perpendicular to the direction of the reciprocal movement.

6. An ink jet printing method comprising the steps of:

ejecting ink on a printing material using an ink ejection portion of an ink jet recording apparatus;

ejecting liquid on the printing material, the liquid, which is for coagulating, or causing to be insoluble, coloring material of the ink, being ejected from a liquid ejecting portion of the ink jet recording apparatus, and, once the ink is ejected, coagulating, or causing to be insoluble, the coloring material of the ink with the liquid; and changing the amount of the liquid applied depending an a printing mode of a plurality of operable printing modes, in which a printing operation is carried out, wherein each printing mode includes one or more of a number of the scans on a same recording area, a color printing mode for printing an image using a plurality of color inks and a monochromatic printing mode, for printing an image using only one color ink, wherein the liquid is ejected in any of the printing modes.

7. A method according to claim 6, further comprising the step of decreasing the amount of the liquid per unit area of the printing material with an increase of the number of scans on the same recording area.

8. An ink jet printing method comprising the steps of:

ejecting ink on a printing material using an ink ejection portion of an ink jet recording apparatus;

ejecting liquid on the printing material, the liquid, which is for coagulating or causing to be insoluble, coloring material of the ink, being ejected from a liquid ejecting portion of the ink jet recording apparatus, and, once the ink is ejected, coagulating, or causing to be insoluble, the coloring material of the ink with the liquid; and preparing kinds of liquids having different surface tension or seeping property and determining the kind of liquid depending on a printing mode of a plurality of operable printing modes, in which a printing operation is carried out, wherein each printing mode includes one or more of a number of the scans on a same recording area, a color printing mode for printing an image using a plurality of color inks and a monochromatic printing mode for printing an image using only one color ink, wherein the liquid is ejected in any of the printing modes.

9. A method according to claim 8, further comprising the steps of performing a plurality of scans of the printing material with recording means comprising the ink ejecting portion and the liquid ejecting portion and using the kind of liquid having a smaller surface tension than the surface tension of other kinds of the liquid, with an increase of the number of scans on the same recording medium.

10. An ink jet printing method comprising the steps of:

ejecting ink on a printing material using an ink ejection portion of an ink jet recording apparatus;

ejecting liquid on the printing material, the liquid, which is for coagulating, or causing to be insoluble, coloring material of the ink, being ejected from a liquid ejecting portion of the ink jet recording apparatus, and, once the ink is ejected, coagulating, or causing to be insoluble, the coloring material of the ink with the liquid; and applying different amounts of the liquid per unit area on the printing material depending on whether a printing mode is a color printing mode for printing an image using a plurality of color inks or a monochromatic printing mode for printing an image using only one color ink, in either of which the liquid is ejected.

11. A method according to claim 10, wherein the amount of liquid per unit area is larger for the monochromatic mode.

12. An ink jet printing method according to claim 10, wherein a ratio of an amount of the liquid ejected to a unit area which is to be printed by a plurality of ink droplets to a sum of the amount and an amount of the ink ejected to the unit area is smaller in the color mode than in the monochromatic mode.

13. An ink jet printing method comprising the steps of:

ejecting ink on a printing material using an ink ejection portion of an ink jet recording apparatus;

ejecting liquid on the printing material, the liquid, which is for coagulating, or causing to be insoluble, coloring material of the ink, being ejected from a liquid ejecting portion of the ink jet recording apparatus, and, once the ink is ejected coagulating, or causing to be insoluble, coloring material of the ink with the liquid; and applying different amounts of the liquid per unit area on the printing material depending on whether a printing datum to be printed by the ink jet recording apparatus is for black color or not.

14. A method according to claim 13, further comprising the step of applying a larger amount of liquid per unit area for a black color ink ejected in said ink ejecting step.

15. An ink jet printing method according to claim 13, wherein a ratio of an amount of the liquid ejected to a unit area which is to be printed by a plurality of ink droplets to a sum of the amount and an amount of the ink ejected to the unit area is smaller in the color mode than in the monochromatic mode.

16. An ink jet printing method comprising the steps of:

ejecting ink on a printing material using an ink ejection portion of an ink jet recording apparatus;

ejecting liquid on the printing material, the liquid, which is for coagulating, or causing to be insoluble, coloring material of the ink, being ejected from a liquid ejecting portion of the ink jet recording apparatus, and, once the ink is ejected, coagulating, or causing to be insoluble, the coloring material of the ink with the liquid; and preparing kinds of liquids having different surface tension or seeping property and determining the kind of liquid to be ejected depending on whether a printing mode of the ink jet recording apparatus is a color printing mode for printing an image using a plurality of color inks or a monochromatic printing mode for printing an image using only one color ink, in either of which the liquid is ejected.

17. A method according to claim 16, further comprising the step of using the kind of liquid having a smaller surface tension than the surface tension of others kinds of the liquid for black color ink ejected in said ink ejecting step.

18. An ink jet printing method comprising the steps of:

ejecting ink on a printing material using an ink ejection portion;

ejecting a liquid for improving a printing quality of the ejected ink on the printing material using a liquid ejecting portion; and performing a first scanning operation for ejecting the liquid and a second scanning operation for ejecting at least one of black, yellow, magenta and cyan colors, wherein the first scanning operation and the second scanning operation are performed in different scans.

19. An ink jet printing method comprising the steps of:

ejecting ink on a printing material using an ink ejection portion of an ink jet recording apparatus;

ejecting liquid on the printing material, the liquid, which is for coagulating, or causing to be insoluble, coloring material of the ink, being ejected from a liquid ejecting portion of the ink jet recording apparatus, and, once the ink is ejected, coagulating, or causing to be insoluble, the coloring material of the ink with the liquid;

disposing a recording head for ejecting the liquid between, in a direction of main scan, a recording head for black color and a recording head for yellow, magenta and cyan colors;

performing a scanning operation of the recording head for the black color and a scanning operation of the recording head for the yellow, magenta and cyan colors, which are different from each other; and using different kinds of liquid for the black color and for the yellow, magenta and cyan colors, respectively.

20. An ink jet apparatus comprising:

an ink ejecting portion for ejecting ink to a printing material;

a liquid ejecting portion for ejecting liquid, for coagulating or causing to be insoluble coloring material of the ink, to a printing material;

means for selecting a printing mode out of a plurality of printing modes having different application modes of the liquid, wherein the application modes include one or more of an amount, a property and a manner of application of the liquid, wherein the liquid is ejected in any of the application modes; and driving means for driving said ink ejecting portion and liquid ejecting portion in accordance with the mode selected by said selecting means, wherein the printing mode includes one or more of a number of scans on a same recording area, a color printing mode for printing an image using a plurality of color inks and a monochromatic printing mode for printing an image using only one color ink.

21. An apparatus according to claim 20, wherein said ink ejecting portion includes thermal energy generating members for generating thermal energy for ejecting the ink.

22. An ink jet printing apparatus comprising:

an ink ejecting portion for ejecting ink on a printing material;

a liquid ejecting portion for ejecting liquid, for improving a printing quality of the ejected ink on the printing material, and for coagulating or causing to be insoluble coloring material of the ink, to the printing material; and control means for controlling the liquid so as to be ejected only to a region on which the ink of a predetermined color of the colors is ejected or is to be ejected, and for controlling the liquid so as not to be ejected to other regions.

23. An apparatus according to claim 22, wherein the predetermined color is selectable.

24. An apparatus according to claim 22, wherein the predetermined color is black.

25. An ink jet printing apparatus comprising:

ejection means for ejecting ink having a coloring material onto a printing material;

ejection means for ejecting a liquid for coagulating, or causing to be insoluble, the coloring material of the ink;

selection means for selecting a printing mode from a plurality of printing modes having different application modes; and means for changing an application mode of the liquid depending on the printing mode selected, wherein the application mode includes one or more of an amount, a property and a manner of application of the liquid, and wherein the liquid is ejected in any of the application modes;

wherein the printing mode includes one or more of a number of scans on a same recording area, a color printing mode for printing an image using a plurality of color inks and a monochromatic printing mode for printing an image using only one color ink; and wherein said ink ejection and said liquid ejection are carried out one after the other.

26. An ink jet printing apparatus comprising:

ejection means for ejecting ink having a coloring material onto a printing material;

ejection means for ejecting a liquid for coagulating, or causing to be insoluble, the coloring material of the ink;

means for selecting a printing mode from a plurality of operable printing modes; and means for changing the amount of the liquid applied to the printing material depending on the printing mode selected from the plurality of operable printing modes, wherein the printing mode includes one or more of a number of scans on a same recording area, a color printing mode for printing an image using a plurality of color inks and a monochromatic printing mode for printing an image using only one color ink, wherein the liquid is ejected in any of the printing modes.

27. AN ink jet printing apparatus comprising;

ejection means for ejecting ink having a coloring material onto a printing material;

ejection means for ejecting a liquid for coagulating, or causing to be insoluble, the coloring material of the ink;

means for selecting a printing mode from a plurality of operable printing modes;

mans for preparing a plurality of liquids having different surface tensions or seeping properties; and means for selecting the liquid to be applied depending on the printing mode selected from the plurality of operable printing modes during a printing operation, wherein the printing mode includes one or more of a number of scans on a same recording area, a color printing mode for printing an image using a plurality of color inks and a monochromatic printing mode for printing an image using only one color ink, and wherein the liquid is ejected in any of the printing modes.

28. An ink jet printing apparatus comprising:

ejection means for ejecting ink having a coloring material onto a printing material;

ejection means for ejecting a liquid for coagulating, or causing to be insoluble, the coloring material of the ink; and means for selecting a color or monochromatic printing mode from a plurality of operable printing modes, wherein different amounts of the liquid are applied per unit area on the printing material depending on whether a printing mode is a color printing mode for printing an image using a plurality of color inks or a monochromatic printing mode for printing an image using only one color ink, in either of which the liquid is ejected.

29. An ink jet printing apparatus comprising:

ejection means for ejecting ink having a coloring material onto a printing material;

ejection means for ejecting a liquid for coagulating, or causing to be insoluble, the coloring material of the ink; and means for selecting a printing mode from a plurality of operable printing modes, wherein different amounts of the liquid are applied per unit area on the printing material depending on whether a printing datum to be printed by the ink jet printing apparatus is for black color or not.

30. An ink jet printing apparatus comprising:

ejection means for ejecting ink having a coloring material onto a printing material;

ejection means for ejecting a liquid for coagulating, or causing to be insoluble, the coloring material of the ink;

means for selecting a printing mode from a plurality of operable printing modes, including a color and a monochromatic printing mode;

means for preparing a plurality of liquids having different surface tensions or seeping properties; and means for selecting the liquid to be ejected depending on whether a printing mode of the ink jet printing apparatus is a color printing mode for printing an image using a plurality of color inks or a monochromatic printing mode for printing an image using only one color ink, in either of which the liquid is ejected.

31. An ink jet printing apparatus comprising:

ejection means for ejecting ink having a coloring material onto a printing material;

ejection means for ejecting a liquid for improving a printing quality of the ejected ink on the printing material; and scanning means for performing a first scanning operation for ejecting the liquid and a second scanning operation for ejecting at least one of black, yellow, magenta and cyan colors, wherein the first scanning operation and the second scanning operation are performed in different scans.

32. An ink jet printing apparatus comprising:

ejection means for ejecting ink having a coloring material onto a printing material;

ejection means for ejecting a liquid for coagulating, or causing to be insoluble, the coloring material of the ink;

means for disposing a recording head for ejecting the liquid between, in a direction of main scan, a recording head for black color and a recording head for yellow, magenta and cyan colors;

means for performing a scanning operation of the recording head for the black color and a scanning operation of the recording head for the yellow, magenta and cyan colors, which are different from each other; and means for selecting different kinds of liquid for the black color and for the yellow, magenta and cyan colors, respectively.

33. An ink jet printing method comprising the steps of:

ejecting ink on a printing material using an ink ejection portion of an ink jet recording apparatus;

ejecting liquid on the printing material, the liquid, which is for improving a printing quality of the ejected ink on the printing material, being ejected from a liquid ejecting portion of the ink jet recording apparatus such that the ink and the liquid are mixed or reacted on the printing material, and coagulating or causing to be insoluble the coloring material of the ink with the liquid; and changing an application mode among application modes of the liquid depending on a printing mode in which a printing operation is carried out, wherein each application mode includes one or more of an amount, a property and a manner of application of the liquid, wherein the liquid is ejected in any of the application modes, wherein the printing mode includes one or more of a n umber of scans on a same recording area, a color printing mode for printing an image using a plurality of color inks and a monochromatic printing mode for printing an image using only one color ink, and wherein said ink ejecting step and said liquid ejecting step are carried out one after the other.

34. A method according to claim 33, wherein the liquid improves color development of the ejected ink on the printing material.

35. An ink jet printing method comprising the steps of:

ejecting ink on a printing material using an ink ejection portion of an ink jet recording apparatus;

ejecting liquid on the printing material, the liquid, which is for improving a printing quality of the ejected ink on the printing material, being ejected from a liquid ejecting portion of the ink jet recording apparatus, and coagulating, or causing to be insoluble, the coloring material of the ink with the liquid; and changing the amount of the liquid applied depending on a printing mode of a plurality of operable printing modes, in which a printing operation is carried out, wherein each printing mode includes one or more of a number of the scans on a same recording area, a color printing mode for printing an image using a plurality of color inks and a monochromatic printing mode, for printing an image using only one color ink, wherein the liquid is ejected in any of the printing modes.

36. A method according to claim 35, wherein the liquid improves color development of the ejected ink on the printing material.

37. An ink jet printing method comprising the steps of:

ejecting ink on a printing material using an ink ejection portion of a ink jet recording apparatus;

ejecting liquid on the printing material, the liquid, which is for improving a printing quality of the ejected ink on the printing material, being ejected from a liquid ejecting portion of the ink jet recording apparatus, and coagulating, or causing to be insoluble, the coloring material of the ink with the liquid; and preparing kinds of liquids having different surface tension or seeping property and determining the kind of liquid depending on a printing mode of a plurality of operable printing modes, in which a printing operation is carried out, wherein each printing mode includes one or more of a number of the scans on a same recording area, a color printing mode for printing an image using a plurality of color inks and a monochromatic printing mode for printing an image using only one color ink, wherein the liquid is ejected in any of the printing modes.

38. A method according to claim 37, wherein the liquid improves color development of the ejected ink on the printing material.

39. An ink jet printing method comprising the steps of:

ejecting ink on a printing material using an ink ejection portion of an ink jet recording apparatus;

ejecting liquid on the printing material, the liquid, which is for improving a printing quality of the ejected ink on the printing material, being ejected from a liquid ejecting portion of the ink jet recording apparatus, and coagulating, or causing to be insoluble, the coloring material of the ink with the liquid; and applying different amounts of the liquid per unit area on the printing material depending on whether a printing mode is a color printing mode for printing an image using a plurality of color inks or a monochromatic printing mode for printing an image using only one color ink, in either of which the liquid is ejected.

40. A method according to claim 39, wherein the liquid improves color development of the ejected ink on the printing material.

41. An ink jet printing method comprising the steps of:

ejecting ink on a printing material using an ink ejection portion of a ink jet recording apparatus;

ejecting liquid on the printing material, the liquid which is for improving a printing quality of the ejected ink on the printing material, being ejected from a liquid ejecting portion of the ink jet recording apparatus, and coagulating, or causing to be insoluble, coloring material of the ink with the liquid; and applying different amounts of the liquid per unit area on the printing material depending on whether a printing datum to be printed by the ink jet recording apparatus is for black color or not.

42. A method according to claim 41, wherein the liquid improves color development of the ejected ink on the printing material.

43. An ink jet printing method comprising the steps of:

ejecting ink on a printing material using an ink ejection portion of a ink jet recording apparatus;

ejecting liquid on the printing material, the liquid, which is for improving a printing quality of the ejected ink on the printing material, being ejected from a liquid ejecting portion of the ink jet recording apparatus, and coagulating, or causing to be insoluble, the coloring material of the ink with the liquid; and preparing kinds of liquids having different surface tension or seeping property and determining the kind of liquid to be ejected depending on whether a printing mode of the ink jet recording apparatus is a color printing mode for printing an image using a plurality of color inks or a monochromatic printing mode for printing an image using only one color ink, in either of which the liquid is ejected.

44. A method according to claim 43, wherein the liquid performs improvement in color development of the ejected ink on the printing material.

45. An ink jet printing method comprising the steps of:

ejecting ink on a printing material using an ink ejection portion of an ink jet recording apparatus;

ejecting liquid on the printing material, the liquid which is for improving a printing quality of the ejected ink on the printing material, being ejected from a liquid ejecting portion of the ink jet recording apparatus, and coagulating, or causing to be insoluble, the coloring material of the ink with the liquid;

disposing a recording head for ejecting the liquid between, in a direction of main scan, a recording head for black color and a recording head for yellow, magenta and cyan colors;

performing a scanning operation of the recording head for the black color and a scanning operation of the recording head for the yellow, magenta and cyan colors, which are different from each other; and using different kinds of liquid for the black color and for the yellow, magenta and cyan colors, respectively.

46. A method according to claim 45, wherein the liquid improves color development of the ejected ink on the printing material.

47. An ink jet apparatus comprising:

an ink ejecting portion for ejecting ink to a printing material;

a liquid ejecting portion for ejecting liquid, for improving a printing quality of the ejected ink on the printing material, to a printing material;

means for selecting a printing mode out of a plurality of printing modes having different application modes of the liquid, wherein the application modes include one or more of an amount, a property and a manner of application of the liquid, wherein the liquid is ejected in any of the application modes; and driving means for driving said ink ejecting portion and liquid ejecting portion in accordance with the mode selected by said selecting means, wherein the printing mode includes one or more of a number of scans on a same recording area, a color printing mode for printing an image using a plurality of color inks and a monochromatic printing mode for printing an image using only one color ink.

48. An apparatus according to claim 47, wherein the liquid improves development of the ejected ink of the printing material.

49. An ink jet printing apparatus comprising:

an ink ejecting portion for ejecting ink on a printing material;

a liquid ejecting portion for ejecting liquid, for improving a printing quality of the ejected ink on the printing material, to the printing material; and control means for ejecting the liquid to only to the region in which the ink of a predetermined color of the colors is ejected or is to be ejected and for not ejecting the liquid to the other regions.

50. An apparatus according to claim 49, wherein the liquid improves color development of the ejected ink on the printing material.

51. An ink jet printing apparatus comprising:

ejection means for ejecting ink having a coloring material onto a printing material;

ejection means for ejecting a liquid for improving a printing quality of the ejected ink on the printing material;

selection means for selecting a printing mode from a plurality of printing modes having different application modes; and means for changing an application mode of the liquid depending on the printing mode selected, wherein the application mode includes one or more of an amount, a property and a manner of application of the liquid, and wherein the liquid is ejected in any of the application modes;

wherein the printing mode includes one or more of a number of scans on a same recording area, a color printing mode for printing an image using a plurality of color inks and a monochromatic printing mode for printing an image using only one color ink; and wherein said ink ejection and said liquid ejection are carried out one after the other.

52. A apparatus according to claim 51, wherein the liquid improves color development of the ejected ink on the printing material.

53. An ink jet printing apparatus comprising:

ejection means for ejecting ink having a coloring material onto a printing material;

ejection means for ejecting a liquid for improving a printing quality of the ejected ink on the printing material;

means for selecting a printing mode from a plurality of operable printing modes; and means for changing the amount of the liquid applied to the printing material depending on the printing mode selected from the plurality of operable printing modes, wherein the printing mode includes one or more of a number of scans on a same recording area, a color printing mode for printing an image using a plurality of color inks and a monochromatic printing mode for printing an image using only one color ink, wherein the liquid is ejected in any of the printing modes.

54. An apparatus according to claim 53, wherein the liquid improves color development of the ejected ink on the printing material.

55. An ink jet printing apparatus comprising:

ejection means for ejecting ink having a coloring material onto a printing material;

ejection means for ejecting a liquid for improving a printing quality of the ejected ink on the printing material;

means for selecting a printing mode from a plurality of operable printing modes;

means for preparing a plurality of liquids having different surface tensions or seeping properties; and means for selecting the liquid to be applied depending on the printing mode selected from the plurality of operable printing modes during a printing operation, wherein the printing mode includes one or more of a number of scans on a same recording area, a color printing mode for printing an image using a plurality of color inks and a monochromatic printing mode for printing an image using only one color ink, and wherein the liquid is ejected in any of the printing modes.

56. An apparatus according to claim 55, wherein the liquid performs improvement in color development of the ejected ink on the printing material.

57. An ink jet printing apparatus comprising:

ejection means for ejecting ink having a coloring material onto a printing material;

ejection means for ejecting a liquid for improving a printing quality of the ejected ink on the printing material; and means for selecting a color or monochromatic printing mode from a plurality of operable printing modes, wherein different amounts of the liquid are applied per unit area on the printing material depending on whether a printing mode is a color printing mode for printing an image using a plurality of color inks or a monochromatic printing mode for printing an image using only one color ink, in either of which the liquid is ejected.

58. An apparatus according to claim 57, wherein the liquid improves color development of the ejected ink on the printing material.

59. An ink jet printing apparatus comprising:

ejection means for ejecting ink having a coloring material onto a printing material;

ejection means for ejecting a liquid for improving a printing quality of the ejected ink on the printing material; and means for selecting a printing mode from a plurality of operable printing modes, wherein different amounts of the liquid are applied per unit area on the printing material depending on whether a printing datum to be printed by the ink jet printing apparatus is for black color or not.

60. An apparatus according to claim 59, wherein the liquid improves color development of the ejected ink on the printing material.

61. An ink jet printing apparatus comprising:

ejection means for ejecting ink having a coloring material onto a printing material;

ejection means for ejecting a liquid for improving a printing quality of the ejected ink on the printing material;

means for selecting a printing mode from a plurality of operable printing modes, including a color and a monochromatic printing mode;

means for preparing a plurality of liquids having different surface tensions or seeping properties; and means for selecting the liquid to be ejected depending on whether a printing mode of the ink jet printing apparatus is a color printing mode for printing an image using a plurality of color inks or a monochromatic printing mode for printing an image using only one color ink, in either of which the liquid is ejected.

62. A apparatus according to claim 61, wherein the liquid improves color development of the ejected ink on the printing material.

63. An ink jet printing apparatus comprising:

ejection means for ejecting ink having a coloring material onto a printing material;

ejection means for ejecting a liquid for improving a printing quality of the ejected ink on the printing material;

means for disposing a recording head for ejecting the liquid between, in a direction of main scan, a recording head for black color and a recording head for yellow, magenta and cyan colors;

means for performing a scanning operation of the recording head for the black color and a scanning operaton of the recording head for the yellow, magenta and cyan colors, which are different from each other; and means for selecting different kinds of liquid for the black color and for the yellow, magenta and cyan colors, respectively.

64. An apparatus according to claim 63, wherein the liquid improves color development of the ejected ink on the printing material.

* * * * *

UNITED STATES PATENT AND TRADEMARK OFFICE

CERTIFICATE OF CORRECTION

PATENT NO. : 6,412,934 B1
DATED : July 2, 2002
INVENTOR(S) : Moriyama et al.

It is certified that error appears in the above-identified patent and that said Letters Patent is hereby corrected as shown below:

Title page,
Item [56], References Cited, FOREIGN PATENT DOCUMENTS,
"51006725" should read -- 51-6725 --;
"53024486" should read -- 53-24486 --;
"54043733" should read -- 54-43733 --;
"54056847" should read -- 54-56847 --;
"55150396" should read -- 55-150396 --;
"56084992" should read -- 56-84992 --;
"58128862" should read -- 58-128862 --;
"59123670" should read -- 59-123670 --;
"59138461" should read -- 59-138461 --;
"60017260" should read -- 6-71260 --;
"61231284" should read -- 61-231284 --;
"63299971" should read -- 63-299971 --;
"64063185" should read -- 64-63185 --; and
"1141085" should read -- 1-141085 --.

Column 5,
Line 10, "Per" should read -- per --.

Column 8,
Line 4, "liquid" should read -- liquid ejecting --; and
Line 11, "FIG. 33" should begin a new paragraph.

Column 10,
Line 55, "a, printing" should read -- a printing --.

Column 13,
Line 54, "Embodiment 3" should begin a new paragraph, and "When" should begin a separate new paragraph.

UNITED STATES PATENT AND TRADEMARK OFFICE

CERTIFICATE OF CORRECTION

PATENT NO. : 6,412,934 B1
DATED : July 2, 2002
INVENTOR(S) : Moriyama et al.

It is certified that error appears in the above-identified patent and that said Letters Patent is hereby corrected as shown below:

Column 14,
Line 9, "relative" should read -- relatively --;
Line 59, "In" should begin a new paragraph; and
Lines 60-67, left margins should be closed up.

Column 15,
Lines 1 and 2, left margins should be closed up.

Column 16,
Line 29, "describe" should read -- described --.

Column 24,
Line 65, "unnecessary:" should read -- unnecessary, --.

Column 26,
Line 3, "Anionic" should begin a new paragraph; and
Lines 4-17, left margins should be closed up.

Column 32,
Line 65, "23.0 wt.%" should read -- 2.3 wt.% --.

Column 35,
Line 54, "Step 1:" should begin a new paragraph.

Column 36,
Line 35, "resistant;" should read -- resistant, --.

Column 40,
Line 52, "μAm" should read -- μm --.

UNITED STATES PATENT AND TRADEMARK OFFICE

CERTIFICATE OF CORRECTION

PATENT NO. : 6,412,934 B1
DATED : July 2, 2002
INVENTOR(S) : Moriyama et al.

It is certified that error appears in the above-identified patent and that said Letters Patent is hereby corrected as shown below:

Column 41,
Line 53, right margin should be closed up; and
Line 54, left margin should be closed up.

Column 45,
Line 33, "above" should read -- above- --.

Column 48,
Line 61, "claim 4" should read -- claim 4, --; and
Line 62, "as" should read -- has --.

Column 49,
Line 7, "an" should read -- on --.

Column 50,
Line 45, "others" should read -- other --.

Column 51,
Line 9, "liquid" should read -- liquids --.

Column 52,
Line 22, "AN" should read -- An --, and "comprising;" should read -- comprising: --; and
Line 30, "mans" should read -- means --.

Column 53,
Line 44, "liquid" should read -- liquids --;
Line 66, "a n" should read -- a --; and
Line 67, "umber" should read -- number --.

Column 54,
Line 33, "a" should read -- an --.

UNITED STATES PATENT AND TRADEMARK OFFICE

CERTIFICATE OF CORRECTION

PATENT NO. : 6,412,934 B1
DATED : July 2, 2002
INVENTOR(S) : Moriyama et al.

It is certified that error appears in the above-identified patent and that said Letters Patent is hereby corrected as shown below:

Column 55,
Line 8, "a" should read -- an --;
Line 9, "liquid" should read -- liquid, --;
Line 24, "a" should read -- an --;
Line 45, "liquid" should read -- liquid, --; and
Line 60, "liquid" should read -- liquids --.

Column 58,
Line 49, "liquid" should read -- liquids --.

Signed and Sealed this

Eighteenth Day of March, 2003

JAMES E. ROGAN
*Director of the United States Patent and Trademark Office*